US005693450A

United States Patent [19]

Makuta et al.

[11] Patent Number: 5,693,450

[45] Date of Patent: Dec. 2, 1997

[54] SILVER HALIDE COLOR PHOTOGRAPHIC LIGHT-SENSITIVE MATERIAL

[75] Inventors: Toshiyuki Makuta; Koki Nakamura; Kiyoshi Takeuchi; Hiroo Takizawa, all of Minami-ashigara, Japan

[73] Assignee: Fuji Photo Film Co., Ltd., Kanagawa-ken, Japan

[21] Appl. No.: 653,346

[22] Filed: May 24, 1996

[30] Foreign Application Priority Data

May 24, 1995 [JP] Japan ..... 7-149492

[51] Int. Cl.[6] ..... G03C 1/06

[52] U.S. Cl. ..... 430/264; 430/505; 430/543; 430/546; 430/601; 430/610; 430/613

[58] Field of Search ..... 430/264, 613, 430/546, 601, 610, 505, 543

[56] References Cited

U.S. PATENT DOCUMENTS

| | | | |
|---|---|---|---|
| 4,639,413 | 1/1987 | Kawagishi et al. | 430/601 |
| 4,902,599 | 2/1990 | Yamamoto et al. | 430/264 |
| 5,244,773 | 9/1993 | Muramatsu et al. | 430/264 |
| 5,374,498 | 12/1994 | Fujita et al. | 430/264 |

FOREIGN PATENT DOCUMENTS

| | | |
|---|---|---|
| 0 545 491 A1 | 6/1993 | European Pat. Off. . |
| 0 565 165 A1 | 10/1993 | European Pat. Off. . |

*Primary Examiner*—Thorl Chea

*Attorney, Agent, or Firm*—Birch, Stewart, Kolasch & Birch, LLP

[57] ABSTRACT

There is disclosed a silver halide color photographic light-sensitive material having at least one photographic constitutional layer on a support, wherein at least one reducing agent for color formation, which is a specific hydrazine compound, at least one dye-forming coupler, and at least one high-boiling-point organic solvent whose electron-donative parameter $\Delta v_D$ at 25° C. is 80 or more, are contained in at least one of said photographic constitutional layers. The above light-sensitive material enables low replenishment and reduced discharge of a color developer; can form colors favorably even when the coating film's pH is low; and is reduced in stain due to long-term storage of the light-sensitive material or stain after the processing of the light-sensitive material.

19 Claims, No Drawings

SILVER HALIDE COLOR PHOTOGRAPHIC LIGHT-SENSITIVE MATERIAL

FIELD OF THE INVENTION

The present invention relates to color photography technology, and particularly to a silver halide color photographic light-sensitive material excellent in environmental conservation and safety and good in color-forming properties and hue, even when subjected to simple quick processing; and to a color image-forming method.

BACKGROUND OF THE INVENTION

Generally, when a color photographic light-sensitive material is exposed to light and color-developed, the oxidized p-phenylenediamine derivative reacts with couplers to form an image. In this system, a color reproduction method by the subtractive color technique is used, and to reproduce blue, green, and red, images are formed that are yellow, magenta, and cyan in color, complementary, respectively, to blue, green, and red.

Color development is achieved by immersing an exposed color photographic light-sensitive material in an aqueous alkali solution having a p-phenylenediamine derivative dissolved therein (color developer). However, there is a problem that the p-phenylenediamine derivative in the form of an aqueous alkali solution is unstable and is apt to deteriorate over time, and in order to retain stable development performance, the color developer must be replenished frequently. Further, the disposal of used color developers containing a p-phenylenediamine derivative is complicated, and together with the above frequent replenishment, the treatment of used color developers discharged in large quantities gives rise to a serious problem. Thus, there is a strong demand for the attainment of low replenishment and reduced discharge of color developers.

One effective measure for attaining low replenishment and reduced discharge of color developers is a method wherein an aromatic primary amine developing agent or its precursor is built in a hydrophilic colloid layer, and examples of the aromatic primary amine developing agents or their precursors that can be built in include compounds described, for example, in U.S. Pat. No. 4,060,418 and JP-A ("JP-A" means unexamined published Japanese patent application) No. 192031/1983. However, since these aromatic primary amines and their precursors are unstable, there is the defect that, when the unprocessed light-sensitive material is stored for a long period of time or is color-developed, stain occurs. Another effective measure is a method wherein a sulfonhydrazide-type compound, as described, for example, in European Patent Nos. 0545491A1 and 565165A1, is built in a hydrophilic colloid layer. However, the sulfonhydrazide-type compounds listed therein still cannot give satisfactory Color density when chromogenically developed, and there is the problem that, when the sulfonhydrazide-type compound is used with a two-equivalent coupler, the color formation is little. In comparison with four-equivalent couplers, two-equivalent couplers have such merits that stain originating in the couplers can be reduced, the activity of the couplers is easily adjusted, and coupling split-off groups can be allowed to have various functions.

It is desired to develop a technique that can utilize these merits.

On the other hand, dyes obtained from hydrazine compounds and dye-forming couplers are dissociation-type dyes and form color only when dissociated. Therefore, unless they are color-developed and then are immersed in an alkali solution, a color image cannot be obtained. However, there is the problem that, if the coating film's pH after the color formation is high, the remaining hydrazine compound is apt to react with couplers, and considerable stain occurs.

Therefore, the development of a technique for color formation that takes place at as low a pH as possible is desired.

SUMMARY OF THE INVENTION

An object of the present invention is to provide a light-sensitive material that enables low replenishment and reduced discharge of a color developer; that can form colors favorably even when the coating film's pH is low; and that is reduced in stain due to long-term storage of the light-sensitive material or stain after the processing of the light-sensitive material.

Other and further objects, features, and advantages of the invention will appear more evident form the following description.

DETAILED DESCRIPTION OF THE INVENTION

The present inventions have discovered that the object of the present invention can be attained by the following means:

(1) A silver halide color photographic light-sensitive material having at least one photographic constitutional layer on a support, wherein at least one reducing agent for color formation represented by the following formula (I):

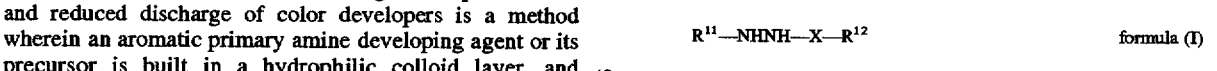

$$R^{11}—NHNH—X—R^{12} \qquad \text{formula (I)}$$

wherein $R^{11}$ represents an aryl group or a heterocyclic group; $R^{12}$ represents an alkyl group, an alkenyl group, an alkynyl group, an aryl group, or a heterocyclic group; and X represents $—SO_2—$, —CO—, —COCO—, —CO—O—, $—CON(R^{13})—$, —COCO—O—, $—COCO—N(R^{13})—$ or $—SO_2—N(R^{13})—$, in which $R^{13}$ represents a hydrogen atom or a group represented by $R^{12}$ that is defined above, at least one dye-forming coupler, and at least one high-boiling-point organic solvent whose electron-donative parameter $\Delta v_D$ at 25° C. is 80 or more, are contained in at least one of said photographic constitutional layers (In this specification and claims, "contained in at least one" means the compound of formula (I), the dye-forming coupler, and the high-boiling-point organic solvent may be contained in the same layer or contained in different layers, when two or more layers are present.).

(2) The silver halide color photographic light-sensitive material as stated in item (1), wherein the reducing agent for color formation represented by formula (I) and the dye-forming coupler are dissolved/dispersed, to be contained in the high-boiling-point organic solvent whose electron-donative parameter $\Delta v_D$ at 25° C. is 80 or more.

(3) The silver halide color photographic light-sensitive material as stated in item (1) or (2), wherein the compound represented by formula (I) is represented by formula (II) or (III):

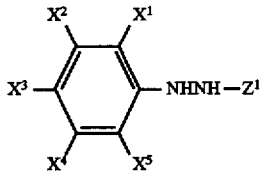

formula (II)

$R^3-NHNH-Z^2$ formula (III)

wherein $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$, and $X^5$ each represent a hydrogen atom or a substituent, provided that the combined sum of the Hammett substituent constant σp values of $X^1$, $X^3$, and $X^5$, with the sum of the Hammett substituent constant σm values of $X^2$ and $X^4$, is 0.08 or more but 3.80 or below; and $R^3$ represents a heterocyclic group.

(4) The silver halide color photographic light-sensitive material as stated in item (3), wherein the compound represented by formula (II) or (III) is represented by formula (IV) or (V), respectively:

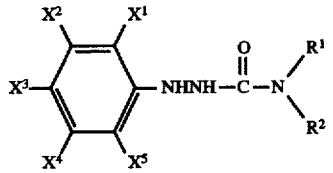

formula (IV)

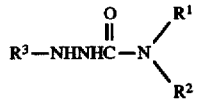

formula (V)

wherein $R^1$ and $R^2$ each represent a hydrogen atom or a substituent; $X^1$, $X^2$, $X^3$, $X^4$, and $X^5$ each represent a hydrogen atom or a substituent, provided that the combined value of the sum of the Hammett substituent constant σp values of $X^1$, $X^3$, and $X^5$, with the sum of the Hammett substituent constant σm values of $X^2$ and $X^4$, is 0 80 or more but 3.80 or below; and $R^3$ represents a heterocyclic group.

(5) The silver halide color photographic light-sensitive material as stated in item (4), wherein the compound represented by formula (IV) or (V) is represented by formula (VI) or (VII), respectively:

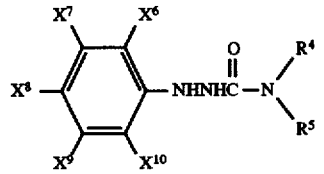

formula (VI)

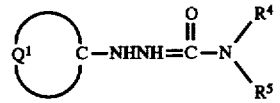

formula (VII)

wherein $R^4$ and $R^5$ each represent a hydrogen atom or a substituent, and $X^6$, $X^7$, $X^8$, $X^9$, and $X^{10}$ each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, provided that the combined value of the sum of the Hammett substituent constant σp values of $X^6$, $X^8$, and $X^{10}$, with the sum of the Hammett substituent constant σm values of $X^7$ and $X^9$, is 1 20 or more but 3.80 or below;

$Q^1$ represents a group of nonmetal atoms required to form, together with the C, a nitrogen-containing 5- to 8-membered heterocyclic ring.

(6) The silver halide color photographic light-sensitive material as stated in item (5), wherein the compound represented by formula (VI) or (VII) is represented by formula (VIII) or (IX), respectively:

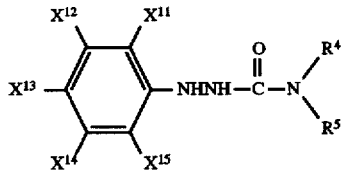

formula (VIII)

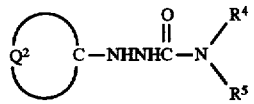

formula (IX)

wherein $R^4$ and $R^5$ each represent a hydrogen atom or a substituent, and $X^{11}$, $X^{12}$, $X^{13}$, $X^{14}$, and $X^{15}$ each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, provided that the combined value of the sum of the Hammett substituent constant σp values of $X^{11}$, $X^{13}$, and $X^{15}$, with the sum of the Hammett substituent constant σm values of $X^{12}$ and $X^{14}$, is 1.50 or more but 3.80 or below;

$Q^2$ represents a group of nonmetal atoms required to form, together with the C, a nitrogen-containing 5-membered to 8-membered heterocyclic ring, to which a benzene ring or a heterocyclic ring is condensed.

(7) The silver halide color photographic light-sensitive material as stated in any of item (1), (2), (3), (4), (5), or (6), wherein the high-boiling-point organic solvent having a $\Delta\nu_D$ of 80 or more is selected from compounds represented by the following formula (S):

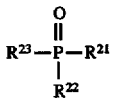

formula (S)

wherein $R^{21}$, $R^{22}$, and $R^{23}$ each independently represent an aliphatic acid group, an aryl group, an aliphatic acid oxy group, an aryloxy group, or an amino group, provided that $R^{21}$, $R^{22}$, and $R^{23}$ do not represent aryloxy groups simultaneously.

The dye obtained from the reducing agent for color formation according to the present invention and a dye-forming coupler can form color only when dissociated. Since the higher the coating film's pH is, the more likely stain after processing is to occur, in order to reduce stain after processing, it is required that color by dissociation can be formed at a low pH.

It has been found that when these compounds are dissolved/dispersed in a high-boiling-point organic solvent whose electron-donative parameter $\Delta\nu_D$ at 25° C. is 80 or more, the dye can be dissociated to form color, even if the pH of the alkali liquid in which immersion is carried out to make the dye dissociate, is low. It has also be found that this effect is particularly high when the compound represented by formula (S) is selected for use as the high-boiling-point organic solvent whose electron-donative parameter $\Delta\nu_D$ at 25° C. is 80 or more.

Now, the specific constitution of the present invention is described in detail below.

The reducing agent for color formation used in the present invention is described in detail below.

The reducing agent for color formation represented by formula (I) used in the present invention is a compound characterized in that the compound undergoes, in all alkali solution, an oxidation-reduction reaction with an auxiliary developing agent oxidized with an exposed silver halide and is oxidized, and its oxidized product further reacts with a dye-forming coupler, to form a dye.

The structure of the reducing agent for color formation represented by formula (I) is described in detail below.

In formula (I), $R^{11}$ represents an aryl group or a heterocyclic group, which may be substituted. The aryl group represented by $R^{11}$ has preferably 6 to 14 carbon atoms, and examples are phenyl and naphthyl. The heterocyclic group represented by $R^{11}$ is preferably a saturated or unsaturated 5-membered, 6-membered, or 7-membered heterocyclic ring containing at least one of nitrogen, oxygen, sulfur, and selenium, to which a benzene ring or a heterocyclic ring may be condensed. Examples of the heterocyclic ring represented by $R^{11}$ are furanyl, thienyl, oxazolyl, thiazolyl, imidazolyl, triazolyl, pyrrolidinyl, benzoxazolyl, benzthiazolyl, pyridyl, pyridazyl, pyrimidinyl, pyrazinyl, triazinyl, quinolinyl, isoquinolinyl, phthalazinyl, quinoxalinyl, quinazolinyl, purinyl, pteridinyl, azepinyl, and benzooxepinyl.

The substituent possessed by $R^{11}$ includes, for example, an alkyl group, an alkenyl group, an alkynyl group, an aryl group, a heterocyclic group, an alkoxy group, an aryloxy group, a heterocyclic oxy group, an alkylthio group, an arylthio group, a heterocyclic thio group, an acyloxy group, an acylthio group, an alkoxycarbonyloxy group, an aryloxycarbonyloxy group, a carbamoyloxy group, an alkylsulfonyloxy group, an arylsulfonyloxy group, an amino group, an alkylamino group, an arylamino group, an amido group, an alkoxycarbonylamino group, an aryloxycarbonylamino group, a ureido group, a sulfonamido group, a sulfamoylamino group, an acyl group, an alkoxycarbonyl group, an aryloxycarbonyl group, a carbamoyl group, an acylcarbamoyl group, a carbamoylcarbamoyl group, a sulfonylcarbamoyl group, a sulfamoylcarbamoyl group, an alkylsulfonyl group, an arylsulfonyl group, an alkylsulfinyl group, an arylsulfinyl group, an alkoxysulfonyl group, an aryloxysulfonyl group, a sulfamoyl group, an acylsulfamoyl group, a carbamoylsulfamoyl group, a halogen atom, a nitro group, a cyano group, a carboxyl group, a sulfo group, a phosphono group, a hydroxyl group, a mercapto group, an imido group, and an azo group.

$R^{12}$ represents an alkyl group, an alkenyl group, an alkynyl group, an aryl group, or a heterocyclic group, which may be substituted.

The alkyl group represented by $R^{12}$ is a straight-chain, branched, or cyclic alkyl group having preferably 1 to 16 carbon atoms, such as methyl, ethyl, hexyl, dodecyl, 2-octyl, t-butyl, cyclopentyl, and cylooctyl. The akenyl group represented by $R^{12}$ is a chain or cyclic alkenyl group having preferably 2 to 16 carbon atoms, such as vinyl, 1-octenyl, and cyclohexenyl.

The alkynyl group represented by $R^{12}$ is an alkynyl group having preferably 2 to 16 carbon atoms, such as 1-butynyl and phenylethynyl. The aryl group and the heterocyclic group represented by $R^{12}$ include those mentioned for $R^{11}$. The substituent possessed by $R^{12}$ includes those mentioned for the substituent of $R^{11}$.

X includes $—SO_2—$, —CO—, —COCO—, —CO—O—, $—CON(R^{13})—$, —COCO—O—, $—COCO—N(R^{13})—$ or $—SO_2—N(R^{13})—$, in which $R^{13}$ represents a hydrogen atom or a group represented by $R^{12}$ that is defined above.

Among those groups, —CO—, $—CON(R^{13})—$, and —CO—O— are preferable, and $—CON(R^{13})—$ is particularly preferable for giving the particularly excellent color-forming properties.

Out of the compounds represented by formula (I), the compounds represented by formulae (II) and (III) are preferable, the compounds represented by formulae (IV) and (V) are more preferable, the compounds represented by formulae (VI) and (VII) are further more preferable, and the compounds represented by formulae (VIII) and (IX) are particularly preferable.

Now, the compounds represented by formulae (II) to (IX) are described in detail.

In formulae (II) and (III), $Z^1$ represents an acyl group, a carbamoyl group, an alkoxycarbonyl group, or an aryloxycarbonyl group, and $Z^2$ represents a carbamoyl group, an alkoxycarbonyl group, or an aryloxycarbonyl group. The acyl group preferably has 1 to 50 carbon atoms, and more preferably 2 to 40 carbon atoms. Specific examples include an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoyl group, and a 3-(N-hydroxy-N-methylaminocarbonyl)propanoyl group.

With respect to the case wherein $Z^1$ and $Z^2$ each represent a carbamoyl group, a description is made in detail in formulas (VI) to (IX).

Preferably the alkoxycarbonyl group and the aryloxycarbonyl group have 2 to 50 carbon atoms, and more preferably 2 to 40 carbon atoms. Specific examples include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2-hydroxymethylphenoxycarbonyl group, and a 2-dodecyloxyphenoxycarbonyl group.

$X^1$, $X^2$, $X^3$, $X^4$, and $X^5$ each represent a hydrogen atom or a substituent. Examples of the substituent include a straight-chain alkyl group, a branched-chain alkyl group, or a cycloalkyl group, having 1 to 50 carbon atoms (e.g. trifluoromethyl, methyl, ethyl, propyl, heptafluoropropyl, isopropyl, butyl, t-butyl, t-pentyl, cyclopentyl, cyclohexyl, octyl, 2-ethylhexyl, and dodecyl); a straight-chain alkenyl group, a branched-chain alkenyl group, or a cycloalkenyl group, having 2 to 50 carbon atoms (e.g. vinyl, 1-methylvinyl, and cyclohexen-1-yl); an alkynyl group having 2 to 50 carbon atoms in all (e.g. ethynyl and 1-propinyl), an aryl group having 6 to 50 carbon atoms (e.g. phenyl, naphthyl, and anthryl), an acyloxy group having 1 to 50 carbon atoms (e.g. acetoxy, tetradecanoyl, and benzoyloxy), a carbamoyloxy group having 1 to 50 carbon atoms (e.g. N,N-dimethylcarbamoyloxy), a carbonamido group having 1 to 50 carbon atoms (e.g. formamido, N-methylacetamido, acetamido, N-methylformamido, and benzamido), a sulfonamido group having 1 to 50 carbon atoms (e.g. methanesulfonamido, dodecansulfonamido, benzenesulfonamido, and p-toluenesulfonamido), a carbamoyl group having 1 to 50 carbon atoms (e.g. N-methylcarbamoyl, N,N-diethylcarbamoyl, and N-mesylcarbamoyl), a sulfamoyl group having 0 to 50 carbon atoms (e.g. N-butylsulfamoyl, N,N-diethylsulfamoyl, and N-methyl-N-(4-methoxyphenyl) sulfamoyl), an alkoxy group having 1 to 50 carbon atoms (e.g. methoxy, propoxy, isopropoxy, octyloxy, t-octyloxy, dodecyloxy, and 2-(2,4-di-t-pentylphenoxy)ethoxy), an aryloxy group having 6 to 50 carbon atoms (e.g. phenoxy, 4-methoxyphenoxy, and naphthoxy), an aryloxycarbonyl group having 7 to 50 carbon atoms (e.g. phenoxycarbonyl and naphthoxycarbonyl), an alkoxycarbonyl group having 2 to 50 carbon atoms (e.g. methoxycarbonyl and t-butoxycarbonyl), an N-acylsulfamoyl group having 1 to 50 carbon atoms (e.g. N-tetradecanoylsulfamoyl and N-benzoylsulfamoyl), an alkylsulfonyl group having 1 to 50 carbon atoms (e.g. methanesulfonyl, octylsulfonyl, 2-methoxyethylsulfonyl, and 2-hexyldecylsulfonyl), an arylsulfonyl group having 6 to 50 carbon atoms (e.g. benzenesulfonyl, p-toluenesulfonyl, and 4-phenylsulfonylphenylsulfonyl), an alkoxycarbonylamino group having 2 to 50 carbon atoms (e.g. ethoxycarbonylamino), an aryloxycarbonylamino group having 7 to 50 carbon atoms (e.g. phenoxycarbonylamino and naphthoxycarbonylamino), an amino group having 0 to 50 carbon atoms (e.g. amino, methylamino, diethylamino, diisopropylamino, anilino, and morpholino), a cyano group, a nitro group, a carboxyl group, a hydroxy group, a sulfo group, a mercapto group, an alkylsulfinyl group having 1 to 50 carbon atoms (e.g. methanesulfinyl and octanesulfinyl), an arylsulfinyl having 6 to 50 carbon atoms (e.g. benzenesulfinyl, 4-chlorophenylsulfinyl, and p-toluenesulfinyl), an alkylthio group having 1 to 50 carbon atoms (e.g. methylthio, octylthio, and cyctohexylthio), an arylthio group having 6 to 50 carbon atoms (e.g. phenylthio and naphthylthio), a ureido group having 1 to 50 carbon atoms (e.g. 3-methylureido, 3,3-dimethylureido, and 1,3-diphenylureido), a heterocyclic group having 2 to 50 carbon atoms (e.g. a 3-membered to 12-membered monocyclic ring or condensed ring having at least one hetero atom(s), such as nitrogen, oxygen, and sulfur, for example, 2-furyl, 2-pyranyl, 2-pyridyl, 2-thienyl, 2-imidazolyl, morpholino, 2-quinolyl, 2-benzimidazolyl, 2-benzothiazolyl, and 2-benzoxazolyl), an acyl group having 1 to 50 carbon atoms (e.g. acetyl, benzoyl, and trifluoroacetyl), a sulfamoylamino group having 0 to 50 carbon atoms (e.g. N-butylsulfamoylamino and N-phenylsulfamoylamino), a silyl group having 3 to 50 carbon atoms (e.g. trimethylsilyl, dimethyl-t-butylsilyl, and triphenylsilyl), and a halogen atom (e.g. a fluorine atom, a chlorine atom, and a bromine atom). The above substituents may have a substituent, and examples of such a substituent include those mentioned above. Further, $X^1$, $X^2$, $X^3$, $X^4$, and $X^5$ may bond together to form a condensed ring.

The number of carbon atoms of the substituent is preferably 50 or below, more preferably 42 or below, and most preferably 34 or below, and there is preferably 1 or more carbon atom(s).

With respect to $X^1$, $X^2$, $X^3$, $X^4$, and $X^5$ in formulae (II) and (III), the sum of the Hammett substituent constant σp values of $X^1$, $X^3$, and $X^5$ and the Hammett substituent constant σm values of $X^2$ and $X^4$ is 0.80 or more but 3.80 or below. $X^6$, $X^7$, $X^8$, $X^9$, $X^{10}$, $X^{11}$, $X^{12}$, $X^{13}$, $X^{14}$, and $X^{15}$ in formula (VI) and (VIII) each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, which may have a substituent and may bond together to form a condensed ring. Specific examples of $X^6$ through $X^{15}$ are the same as those described for $X^1$, $X^2$, $X^3$, $X^4$, and $X^5$. In formula (VI), the sum of the Hammett substituent constant σp values of $X^6$, $X^8$, and $X^{10}$ and the Hammett substituent constant σm values of $X^7$ and $X^9$ is 1.20 or more but 3.80 or below; in formula (VIII), the sum of the Hammett substituent constant σp values of $X^{11}$, $X^{13}$, and $X^{15}$ and Hammett substituent constant σm values of $X^{12}$ and $X^{14}$ is 1.50 or more but 3.80 or below, more preferably 1.70 or more but 3.80 or below.

Herein, if the sum of the σp values and the σm values is less than 0.80, the problem arises that the color formation is unsatisfactory, while if the sum of the σp values and the σm values is over 3.80, the synthesis and availability of the compounds themselves become difficult.

Parenthetically, Hammett substituent constants σp and σm are described in detail in such books as "Hammett no Hosoku/Kozo to Hannousei," written by Naoki Inamoto (Maruzen); "Shin-jikken Kagaku-koza 14/Yukikagoubutsu no Gosei to Hanno V," page 2605 (edited by Nihonkagakukai, Maruzen); "Riron Yukikagaku Kaisetsu," written by Tadao Nakaya, page 217 (Tokyo Kagakudojin); and "Chemical View" (Vol. 91), pages 165 to 195 (1991).

$R^1$ and $R^2$ in formulae (IV) and (V), and $R^4$ and $R^5$ in formulae (VI), (VII), (VIII), and (IX) each represent a hydrogen atom or a substituent, and examples of the substituent are the same as those described for $X^1$, $X^2$, $X^3$, $X^4$, and $X^5$; preferably each represent a hydrogen atom, a substituted or unsubstituted alkyl group having 1 to 50 carbon atoms, a substituted or unsubstituted aryl group having 6 to 50 carbon atoms, or a substituted or unsubstituted heterocyclic group having 1 to 50 carbon atoms, and more preferably at least one of $R^1$ and $R^2$, and at least one of $R^4$ and $R^5$, are each a hydrogen atom.

In formulae (III) and (V), $R^3$ represents a heterocyclic group. Herein, a preferable heterocyclic group has 1 to 50 carbon atoms, and the heterocyclic group contains at least one hetero atom, such as a nitrogen atom, an oxygen atom, and a sulfur atom, and further the heterocyclic group is a saturated or unsaturated 3-membered to 12-membered (preferably 3-membered to 8-membered) monocyclic or condensed ring. Specific examples of the heterocyclic ring are furan, pyran, pyridine, thiophene, imidazole, quinoline, benzimidazole, benzothiazole, benzoxazole, pyrimidine, pyrazine, 1,2,4-thiadiazole, pyrrole, oxazole, thiazole, quinazoline, isothiazole, pyridazine, indole, pyrazole, triazole, and quinoxaline. These heterocyclic groups may have a substituent, and preferably they have one or more electron-attracting groups. Herein, the term "an electron-attracting group" means one wherein the Hammett σp value is a positive value. As the electron-attracting group, a known electron-attracting group can be used such as, specifically, a halogenated alkyl group (particularly, a trifluoromethy group), an aryl group (particularly, a phenyl group), a halogen atom (particularly, a chlorine atom), an alkoxycarbonyl group, a sulfamoyl group, a nitro group, an alkylsulfonyl or arlysulfonyl group, and a cyano group.

When the reducing agent for color formation according to the present invention is built in a light-sensitive material, preferably at least one of $Z^1$, $Z^2$, $R^1$ to $R^5$, and $X^1$ to $X^{10}$, has a ballasting group. Herein, a "ballasting group" means a group, having 5 to 50, preferably 8 to 40 carbon atoms, which makes the reducing agent for color formation that has a ballasting group, easily-soluble in a high-boiling organic solvent, and been hardly deposited even after emulsifying and dispersing, and which makes the reducing agent for color formation immobilized in a hydrophilic colloid. When the reducing agent for color formation according to the present invention is contained in a processing solution, preferably at least one group of $Z^1$, $Z^2$, $R^1$ to $R^5$, and $X^1$ to $X^{10}$, have a hydrophilic group. Herein, a "hydrophilic group" means a polar group that makes the reducing agent for color formation, which has a hydrophilic group, easily solubilized in a processing solution. As the hydrophilic group, a known hydrophilic group can be used such as, specifically, a substituent having at least one —OH or —NH—, and more specifically a hydroxyl group, a hydroxyalkyl group, a hydroxyphenyl group, a carboxyl group, an amino group, a carbamoyl group, and a sulfamoyl group.

Now, novel reducing agents for color formation used in the present invention are described specifically, but the scope of the present invention is not limited to them.

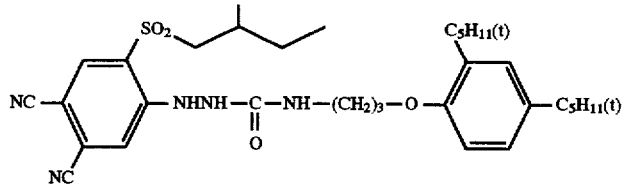

(1)

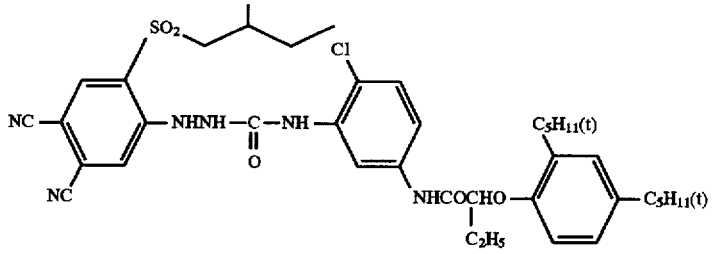

(2)

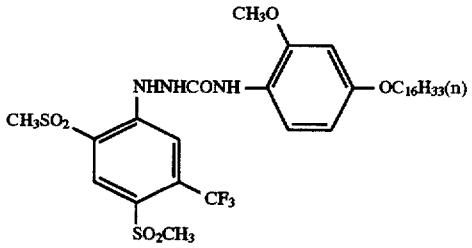

(3)

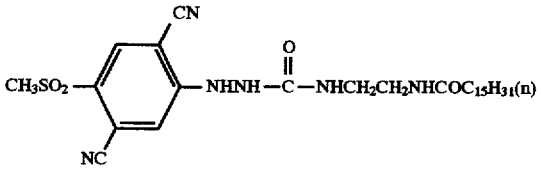

(4)

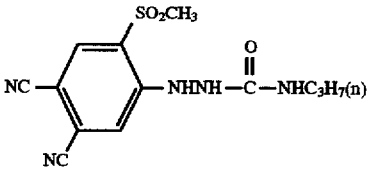

(5)

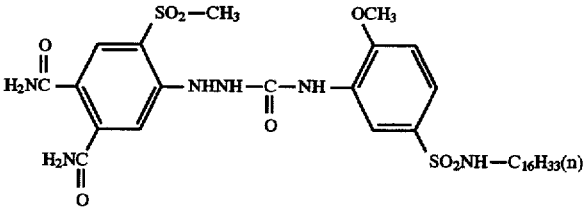

(6)

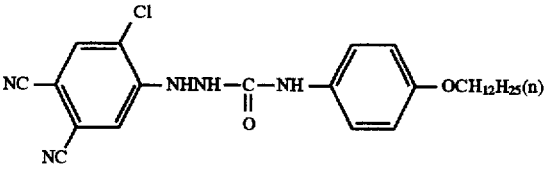

(7)

-continued
(8)
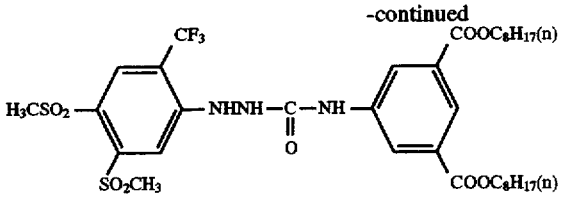
(9)
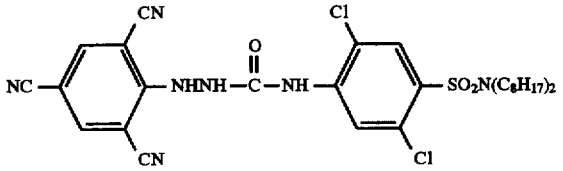
(10)
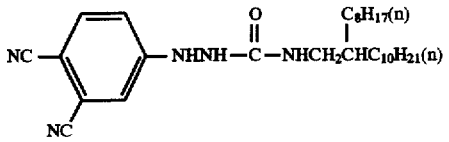
(11)
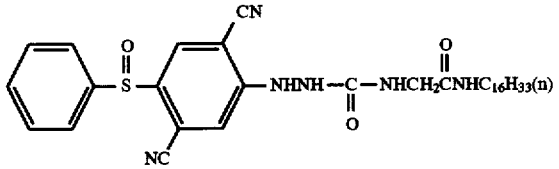
(12)
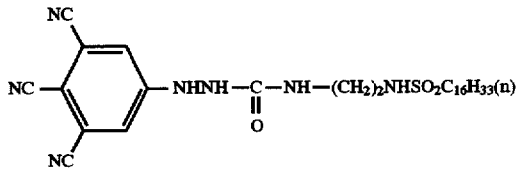
(13)
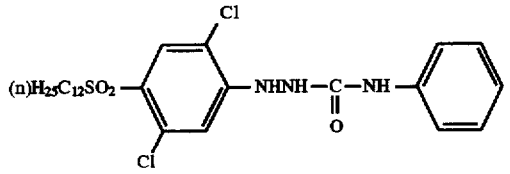
(14)
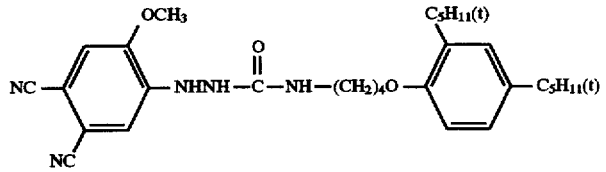
(15)
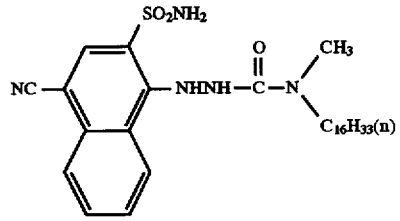
(16)
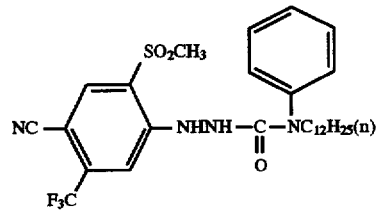

-continued
(17)
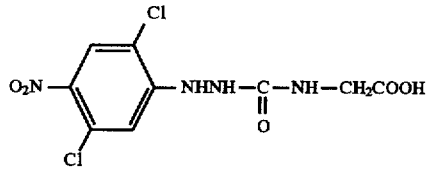
(18)
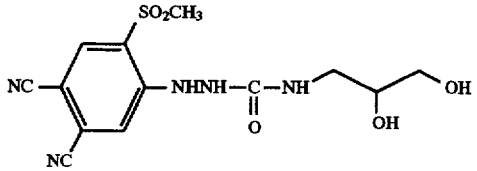
(19)
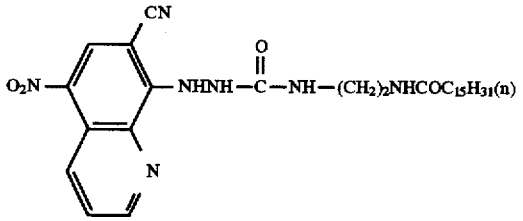
(20)
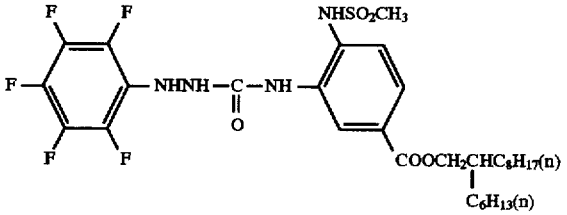
(21)
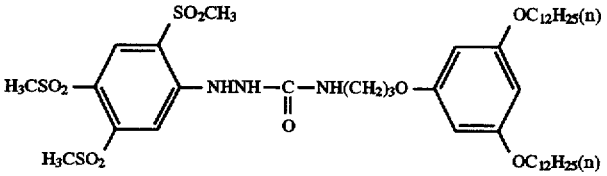
(22)
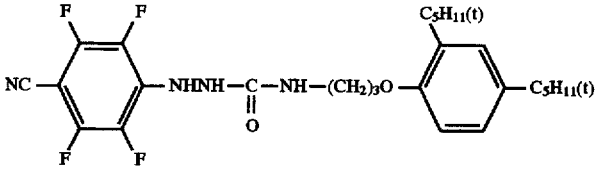
(23)
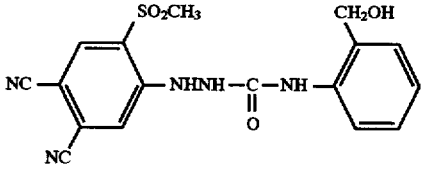
(24)
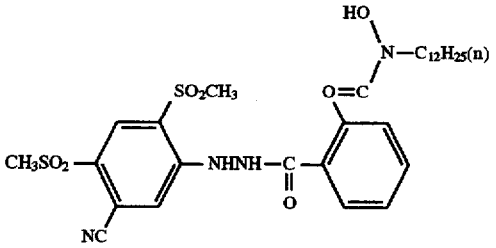

-continued
(25)
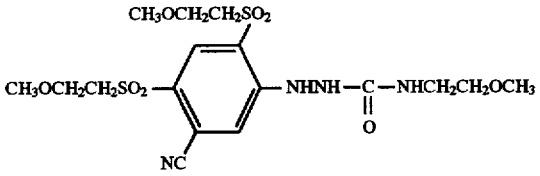
(26)
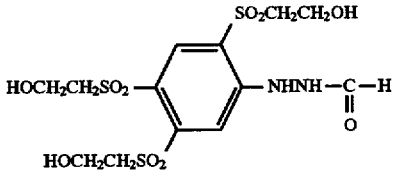
(27)
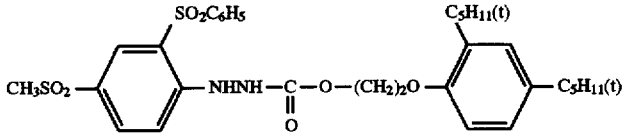
(28)
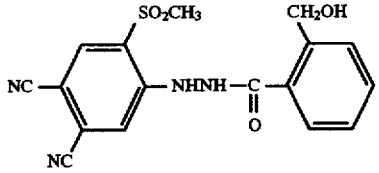
(29)
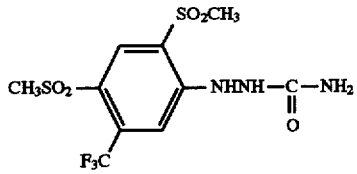
(30)
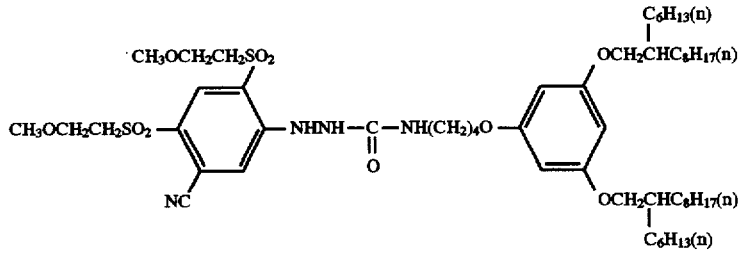
(31)
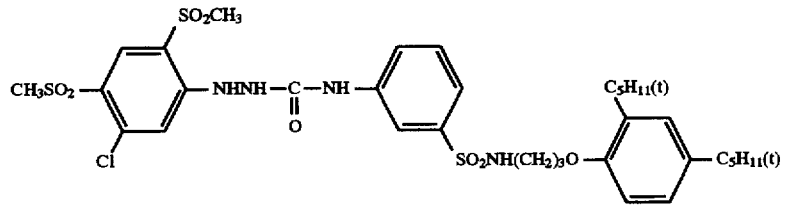
(32)
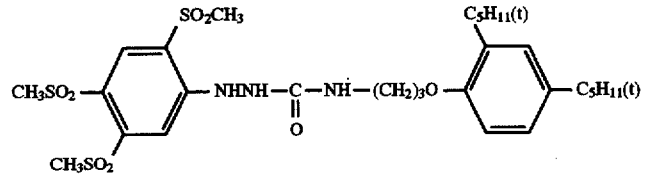

-continued
(33)
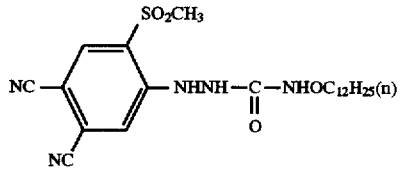
(34)
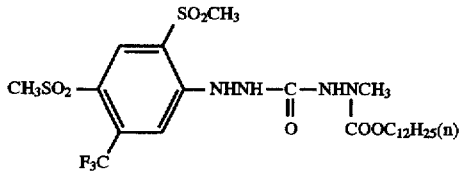
(35)
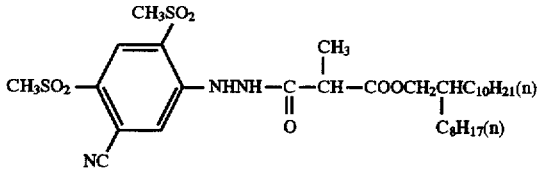
(36)
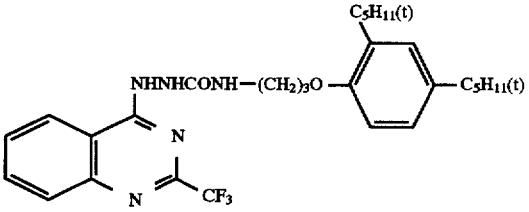
(37)
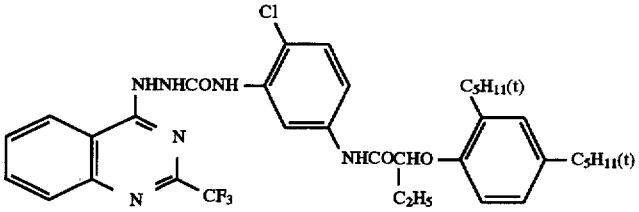
(38)
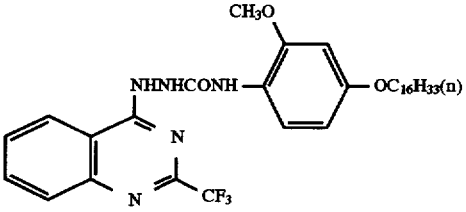
(39)
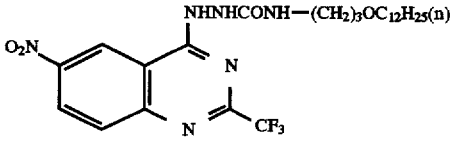
(40)
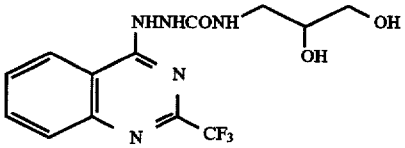

-continued
(41)
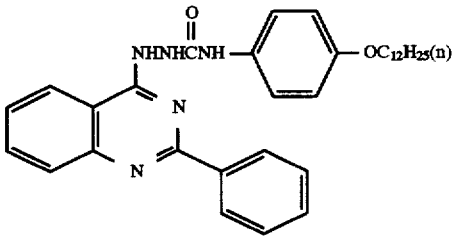
(42)
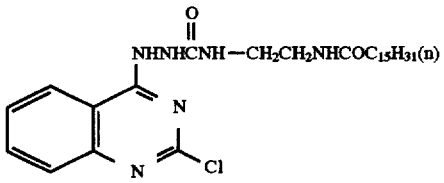
(43)
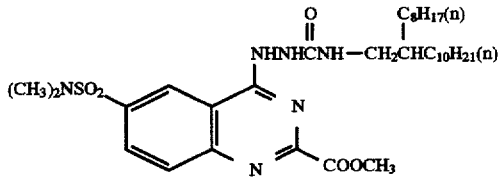
(44)
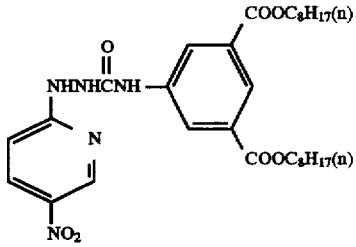
(45)
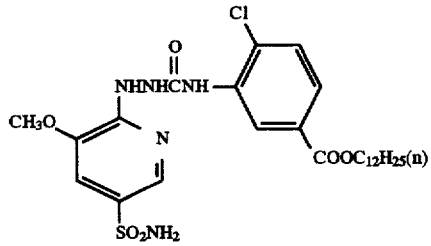
(46)
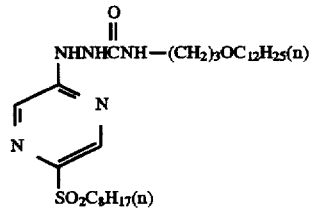
(47)
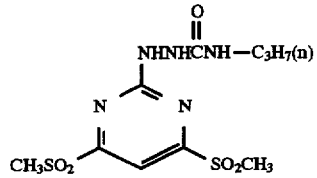

-continued
(48)
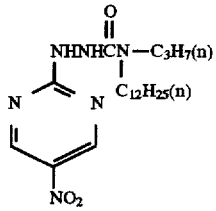
(49)
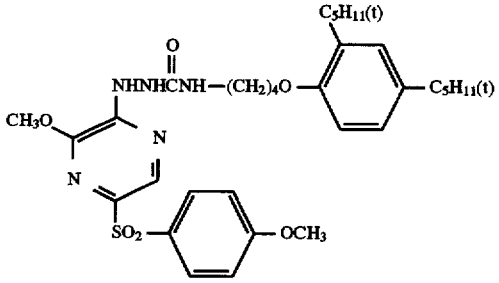
(50)
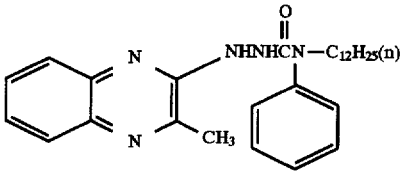
(51)
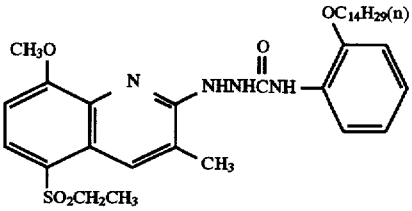
(52)
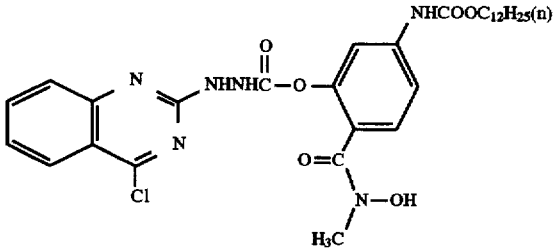
(53)
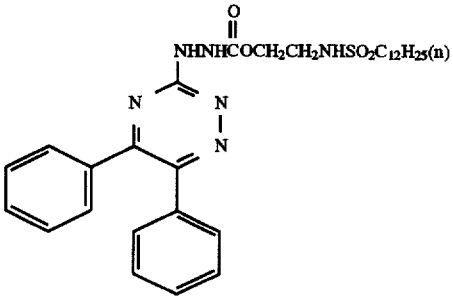
(54)
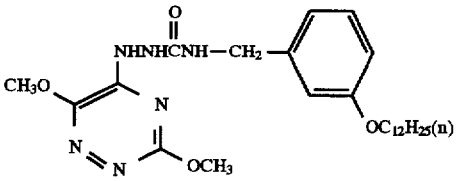

-continued
(55)
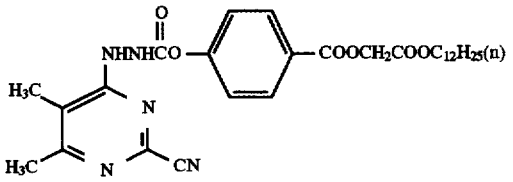
(56)
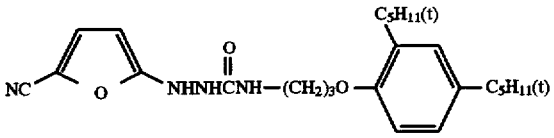
(57)
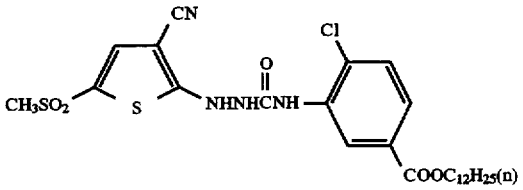
(58)
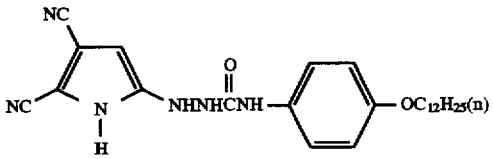
(59)
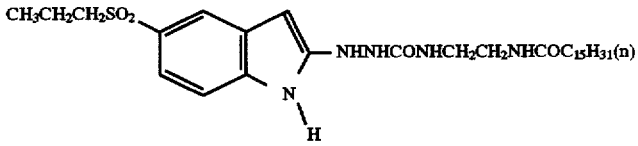
(60)
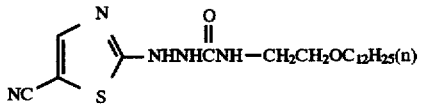
(61)
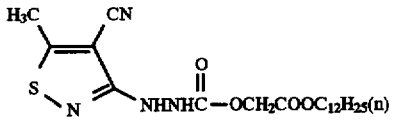
(62)
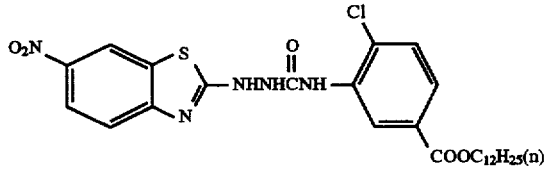
(63)
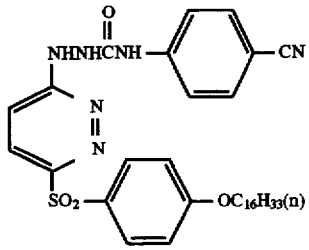

-continued
(64)
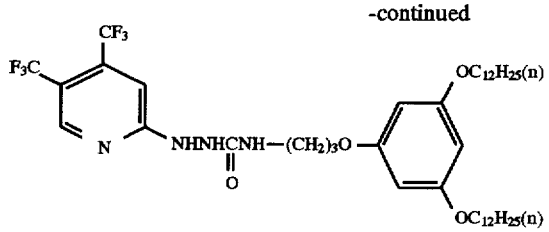
(65)
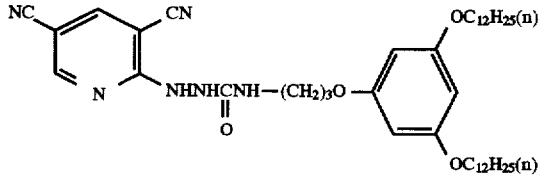
(66)
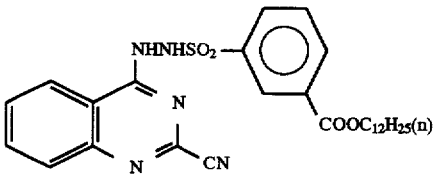
(67)
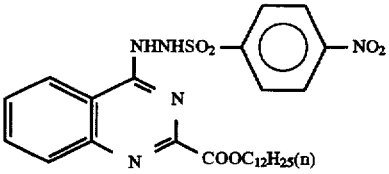
(68)
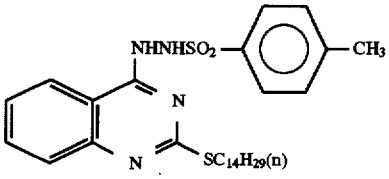
(69)
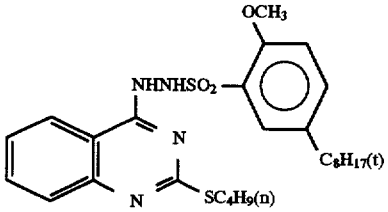
(70)
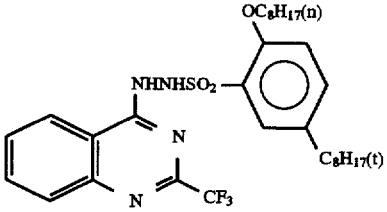
(71)
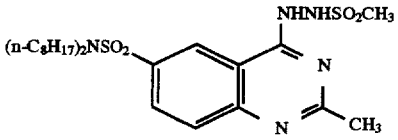
(72)
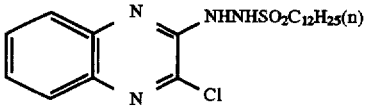

-continued
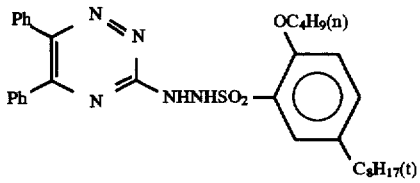
(73)
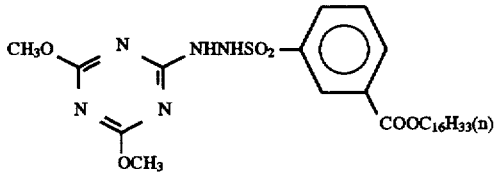
(74)
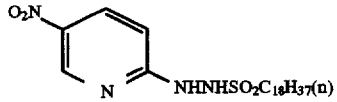
(75)
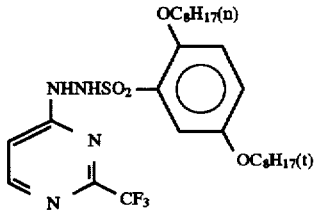
(76)
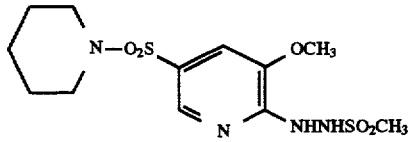
(77)
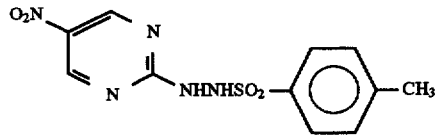
(78)
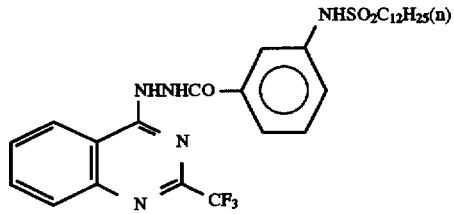
(79)
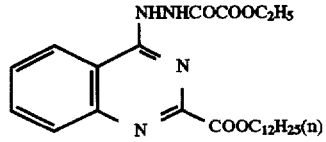
(80)

-continued
(81)
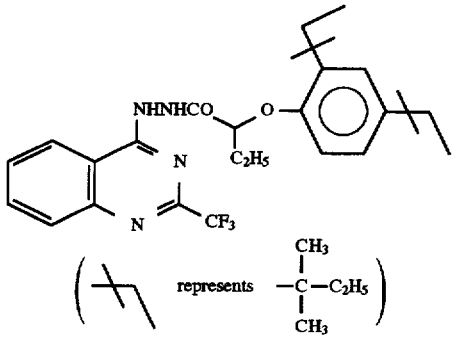
(82)
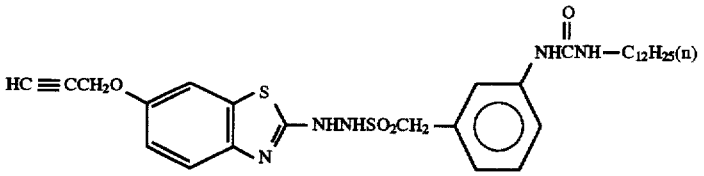
(83)
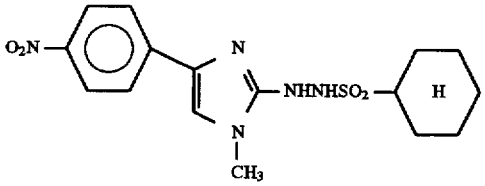
(84)
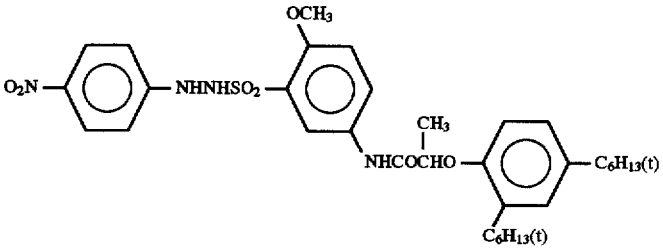
(85)
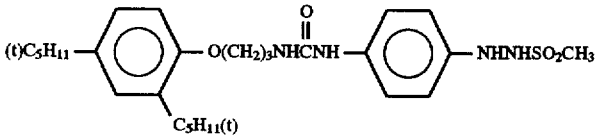
(86)
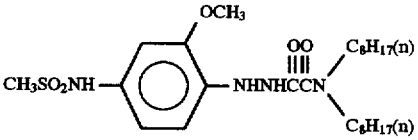
(87)
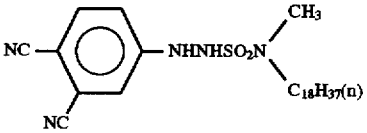
(88)
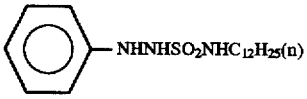

-continued
(89)
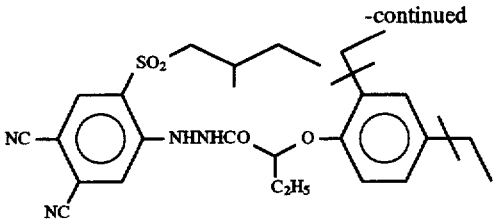
(90)
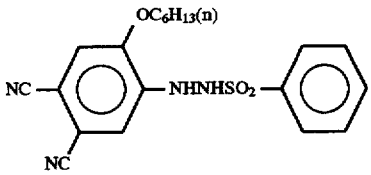
(91)
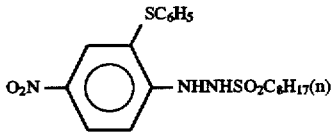
(92)
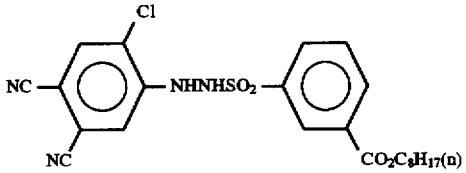
(93)
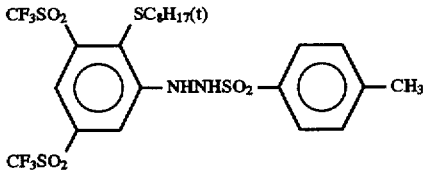
(94)
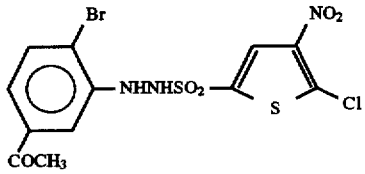
(95)
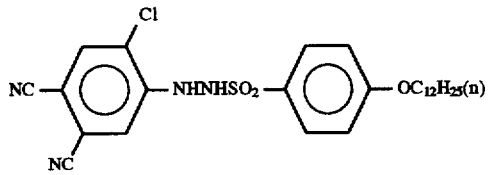
(96)
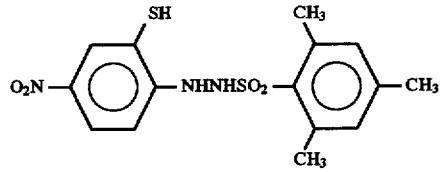
(97)
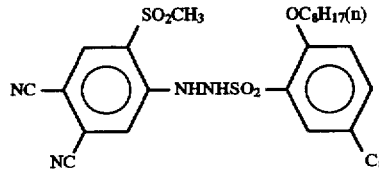

-continued (98)

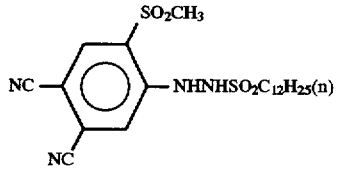

(99)

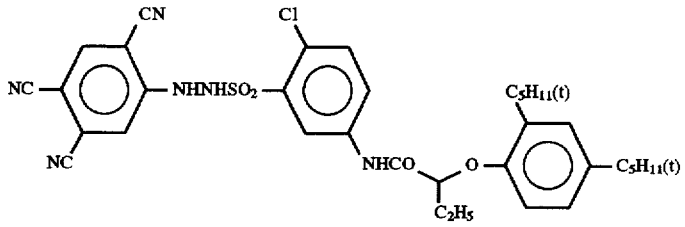

(100)

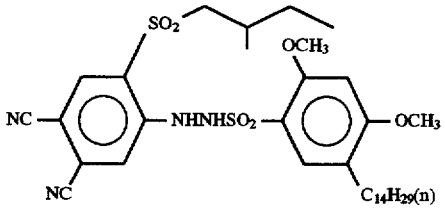

(101)

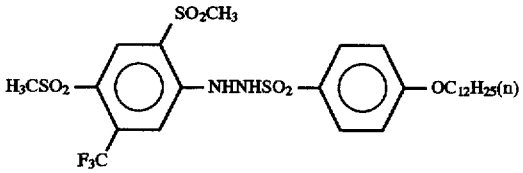

As couplers that are preferably used in the present invention, compounds having structures described by the following formulae (1) to (12) are mentioned. They are compounds collectively generally referred to as active methylenes, pyrazolones, pyrazoloazoles, phenols, naphthols, and pyrrolotriazoles, respectively, which are compounds known in the art.

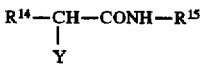

(1)

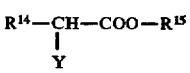

(2)

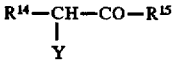

(3)

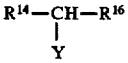

(4)

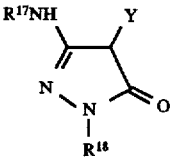

(5)

-continued

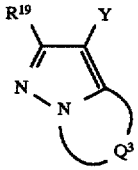

(6)

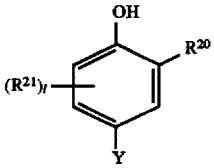

(7)

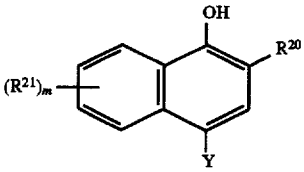

(8)

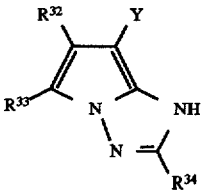

(9)

-continued (10)

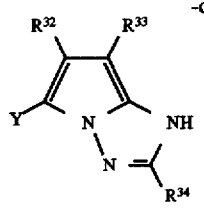

(11)

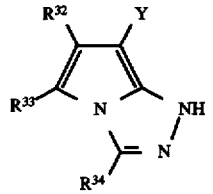

(12)

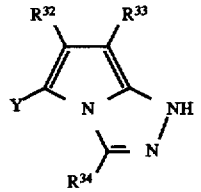

Formulae (1) to (4) represent couplers that are called active methylene couplers, and, in the formulae, $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, optionally substitued.

In formulae (1) to (3), $R^{15}$ represents an optionally substituted alkyl group, aryl group, or heterocyclic residue. In formula (4), $R^{16}$ represents an optionally substituted aryl group or heterocyclic residue. Examples of the substituent that may be possessed by $R^{14}$, $R^{15}$, and $R^{16}$ include those mentioned for $X^1$ to $X^5$.

In formulae (1) to (4), Y represents a hydrogen atom or a group capable of coupling split-off by coupling reaction with the oxidized product of the reducing agent for color formation. Examples of Y are a heterocyclic group (a saturated or unsaturated 5-membered to 7-membered monocyclic or condensed ring having as a hetero atom at least one nitrogen atom, oxygen atom, sulfur atom, or the like, e.g. succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzthiazolin-2-one, 2-pyrrolin-5-one, 2-imidazolin-5-one, indolin-2,3-dione, 2,6-dioxypurine, parabic acid, 1,2,4-triazolidin-3,5-dione, 2-pyridone, 4-pyridone, 2-pyrimidone, 6-pyridazone, 2-pyrazone, 2-amino-1,3,4-thiazolidine, and 2-imino-1,3,4-thiazolidin-4-one), a halogen atom (e.g. a chlorine atom and a bromine atom), an aryloxy group (e.g. phenoxy and 1-naphthoxy), a heterocyclic oxy group (e.g. pyridyloxy and pyrazolyoxy), an acyloxy group (e.g. acetoxy and benzoyloxy), an alkoxy group (e.g. methoxy and dodecyloxy), a carbamoyloxy group (e.g. N,N-diethylcarbamoyloxy and morpholinocarbonyloxy), an aryloxycarbonyloxy group (e.g. phenylcarbonyloxy), an alkoxycarbonyloxy group (e.g. methoxycarbonyloxy and ethoxycarbonyloxy), an arylthio group (e.g. phenylthio and naphthylthio), a heterocyclic thio group (e.g. tetrazolylthio, 1,3,4-thiadiazolylthio, 1,3,4-oxadiazolylthio, and benzimidazolylthio), an alkylthio group (e.g. methylthio, octylthio, and hexadecylthio), an alkylsulfonyloxy group (e.g. methanesulfonyloxy), an arylsulfonyloxy group (e.g. benzenesulfonyloxy and toluenesulfonyloxy), a carbonamido group (e.g. acetamido and trifluoroacetamido), a sulfonamido group (e.g. methanesulfonamido and benzenesulfonamido), an alkylsulfonyl group (e.g. methanesulfonyl), an arylsulfonyl group (e.g. benzenesulfonyl), an alkylsulfinyl group (e.g. methanesulfinyl), an arylsulfinyl group (e.g. benzenesulfinyl), an arylazo group (e.g. phenylazo and naphthylazo), and a carbamoylamino group (e.g. N-methylcarbamoylamino).

Y may be substituted, and examples of the substituent that may be possessed by Y include those mentioned for $X^1$ to $X^5$.

Preferably Y represents a halogen atom, an aryloxy group, a heterocyclic oxy group, an acyloxy group, an aryloxycarbonyloxy group, an alkoxycarbonyloxy group, or a carbamoyloxy group.

In formulae (1) to (4), $R^{14}$ and $R^{15}$, and $R^{14}$ and $R^{16}$, may bond together to form a ring.

Formula (5) represents a coupler that is called a 5-pyrazolone coupler, and in the formula, $R^{17}$ represents an alkyl group, an aryl group, an acyl group, or a carbamoyl group. $R^{18}$ represents a phenyl group or a phenyl group that is substituted by one or more halogen atoms, alkyl groups, cyano groups, alkoxy groups, alkoxycarbonyl groups, or acylamino groups.

Preferable 5-pyrazolone couplers represented by formula (5) are those wherein $R^{17}$ represents an aryl group or an acyl group, and $R^{18}$ represents a phenyl group that is substituted by one or more halogen atoms.

With respect to these preferable groups, more particularly, $R^{17}$ is an aryl group, such as a phenyl group, a 2-chlorophenyl group, a 2-methoxyphenyl group, a 2-chloro-5-tetradecaneamidophenyl group, a 2-chloro-5-(3-octadecenyl-1-succinimido)phenyl group, a 2-chloro-5-octadecylsulfonamidophenyl group, and a 2-chloro-5-[2-(4-hydroxy-3-t-butylphenoxy)tetradecaneamido]phenyl group; or $R_{17}$ is an acyl group, such as an acetyl group, a 2-(2,4-di-t-pentylphenoxy)butanoyl group, a benzoyl group, and a 3-(2,4-di-t-amylphenoxyacetamido)benzoyl group, any of which may have a substituent, such as a halogen atom or an organic substituent that is bonded through a carbon atom, an oxygen atom, a nitrogen atom, or a sulfur atom. Y has the same meaning as defined above.

Preferably $R^{18}$ represents a substituted phenyl group, such as a 2,4,6-trichlorophenyl group, a 2,5-dichlorophenyl group, and a 2-chlorophenyl group.

Formula (6) represents a coupler that is called a pyrazoloazole coupler, and, in the formula, $R^{19}$ represents a hydrogen atom or a substituent. $Q^3$ represents a group of nonmetal atoms required to form a 5-membered azole ring containing 2 to 4 nitrogen atoms, which azole ring may have a substituent (including a condensed ring).

Preferable pyrazoloazole couplers represented by formula (6), in view of spectral absorption characteristics of the color-formed dyes, are imidazo[1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067.

Details of substituents of the azole rings represented by the substituents $R^{19}$ and $Q^3$ are described, for example, in U.S. Pat. No. 4,540,654, the second column, line 41, to the eighth column, line 27. Preferable pyrazoloazole couplers are pyrazoloazole couplers having a branched alkyl group directly bonded to the 2-, 3-, or 6-position of the pyrazolotriazole group, as described in JP-A No. 65245/1986; pyrazoloazole couplers containing a sulfonamido group in the molecule, as described in JP-A No. 65245/1986; pyrazoloazole couplers having an alkoxyphenylsulfonamido ballasting group, as described in JP-A No. 147254/1986; pyrazolotriazole couplers having an alkoxy group or an aryloxy group at the 6-position, as described in JP-A No. 209457/1987 or 307453/1988; and pyrazolotriazole couplers having a carbonamido group in the molecule, as described in Japanese Patent Application No. 22279/1989. Y has the same meaning as defined above.

Formulae (7) and (8) are respectively called phenol couplers and naphthol couplers, and in the formulae $R^{20}$ represents a hydrogen atom or a group selected from the group consisting of —$CONR^{22}R^{23}$, —$SO_2NR^{22}R^{23}$, —$NHCOR^{22}$, —$NHCONR^{22}R^{23}$, and —$NHSO_2NR^{22}R^{23}$. $R^{22}$ and $R^{23}$ each represent a hydrogen atom or a substituent. In formulae (7) and (8), $R^{21}$ represents a substituent, 1 is an integer selected from 0 to 2, and m is an integer selected from 0 to 4. When 1 and m are 2 or more, $R^{21}$'s may be different. The substituents of $R^{21}$ to $R^{23}$ include those mentioned above as examples for $X^1$ to $X^5$. Y has the same meaning as defined above.

Preferable examples of the phenol couplers represented by formula (7) include 2-acylamino-5-alkylphenol couplers described, for example, in U.S. Pat. Nos. 2,369,929, 2801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Patent Publication No. 3,329,729, and JP-A No. 166956/1984; and 2-phenylureido-5-acylaminophenol couplers described, for example, in U.S. Pat. Nos. 3,446,622, 4,333,999, 4,451,559, and 4,427,767. Y has the same meaning as defined above.

Preferable examples of the naphthol couplers represented by formula (8) include 2-carbamoyl-1-naphthol couplers described, for example, in U.S. Pat. Nos. 2,474,293, 4,052,212, 4,146,396, 4,282,233, and 4,296,200; and 2-carbamoyl-5-amido-1-naphthol couplers described, for example, in U.S. Pat. No. 4,690,889. Y has the same meaning as defined above.

Formulas (9) to (12) are couplers called pyrrolotriazoles, and $R^{32}$, $R^{33}$, and $R^{34}$ each represent a hydrogen atom or a substituent. Y has the same meaning as defined above. Examples of the substituent of $R^{32}$, $R^{33}$, and $R^{34}$ include those mentioned for $X^1$, $X^2$, $X^3$, $X^4$, and $X^5$. Preferable examples of the pyrrolotriazole couplers represented by formulae (9) to (12) include those wherein at least one of $R^{32}$ and $R^{33}$ is an electron-attracting group, which specific couplers are described in European Patent Nos. 488,248A1, 491,197A1, and 545,300. Y has the same meaning as defined above.

Further, couplers having such structures as a fused-ring phenol, an imidazole, a pyrrole, a 3-hydroxypyridine, an active methylene, an active methine, a 5,5-fused-ring heterocyclic ring, and a 5,6-fused-ring heterocyclic ring, can be used.

As the fused phenol couplers, those described, for example, in U.S. Pat. Nos. 4,327,173, 4,564,586, and 4,904,575, can be used.

As the imidazole couplers, those described, for example, in U.S. Pat. Nos. 4,818,672 and 5,051,347, can be used.

As the 3-hydroxypyridine couplers, those described, for example, in JP-A No. 315736/1989, can be used.

As the active methylene and active methine couplers, those described, for example, in U.S. Pat. Nos. 5,104,783 and 5,162,196, can be used.

As the 5,5-fused-ring heterocyclic ring couplers, for example, pyrrolopyrazole couplers described in U.S. Pat. No. 5,164,289, and pyrroloimidazole couplers described in JP-A No. 174429/1992, can be used.

As the 5,6-fused ring heterocyclic ring couplers, for example, pyrazolopyrimidine couplers described in U.S. Pat. No. 4,950,585, pyrrolotriazine couplers described in JP-A No. 204730/1992, and couplers described in European Patent No. 556,700, can be used.

In the present invention, in addition to the above couplers, use can be made of couplers described, for example, in West Germany Patent Nos. 3,819,051A and 3,823,049, U.S. Pat. Nos. 4,840,883, 5,024,930, 5,051,347, and 4,481,268, European Patent Nos. 304,856A2, 329,036, 354,549A2, 374,781A2, 379,110A2, and 386,930A1, and JP-A Nos. 141055/1988, 32260/1989, 32261/1989, 297547/1990, 44340/1990, 110555/1990, 7938/1991, 160440/1991, 172839/1991, 172447/1992, 179949/1992, 182645/1992, 184437/1992, 188138/1992, 188139/1992, 194847/1992, 204532/1992, 204731/1992, and 204732/1992.

Specific examples of the couplers that can be used in the present invention are shown below, but, of course, the present invention is not limited to them:

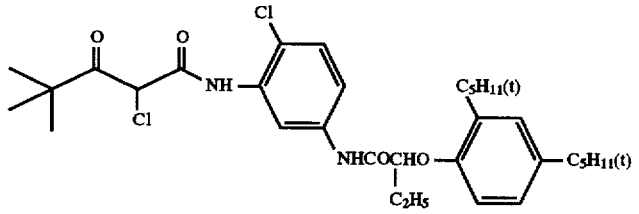

(C-1)

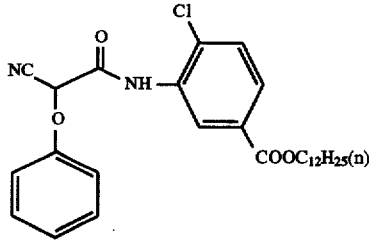

(C-2)

-continued
(C-3)
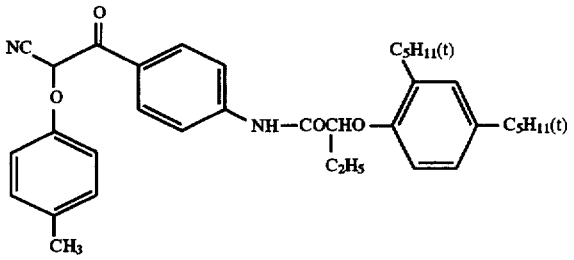
(C-4)
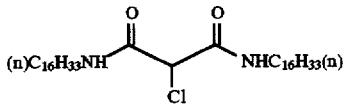
(C-5)
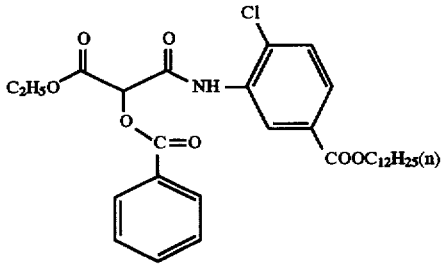
(C-6)
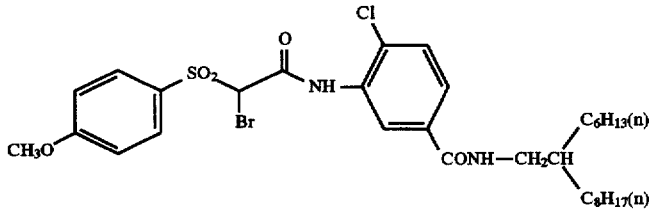
(C-7)
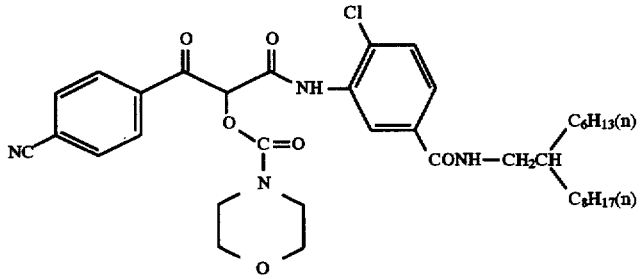
(C-8)
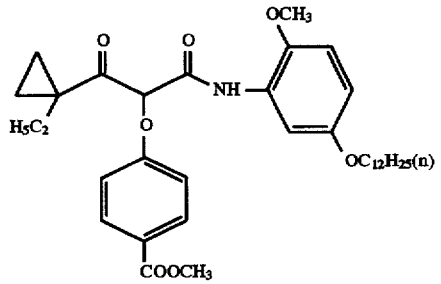
(C-9)
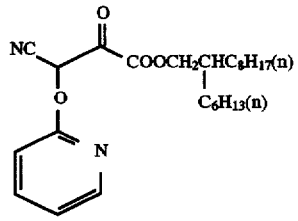

-continued
(C-10)
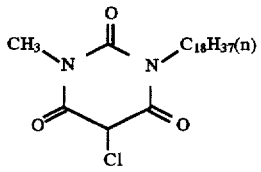
(C-11)
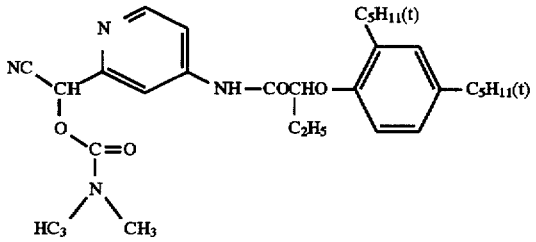
(C-12)
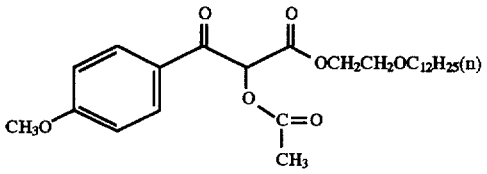
(C-13)
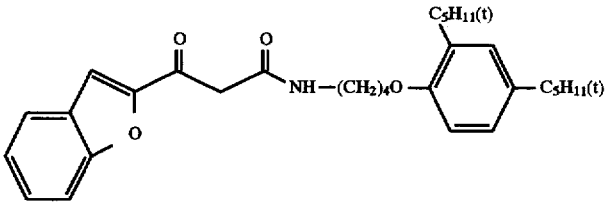
(C-14)
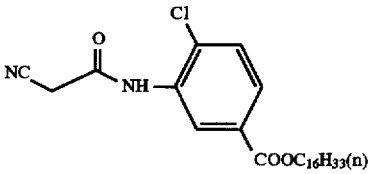
(C-15)
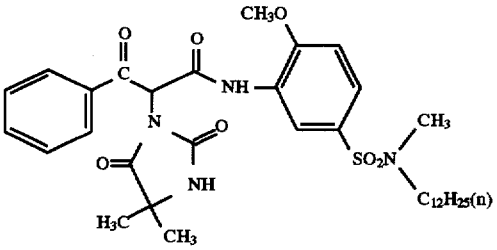
(C-16)
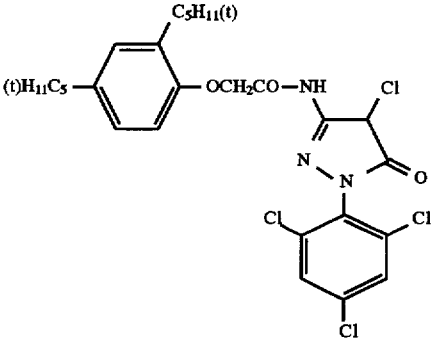

-continued
(C-17)
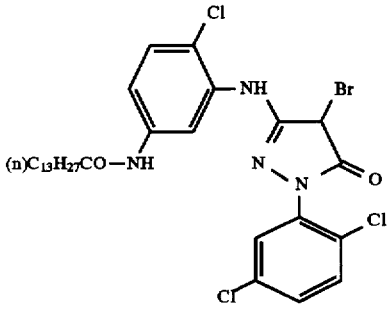
(C-18)
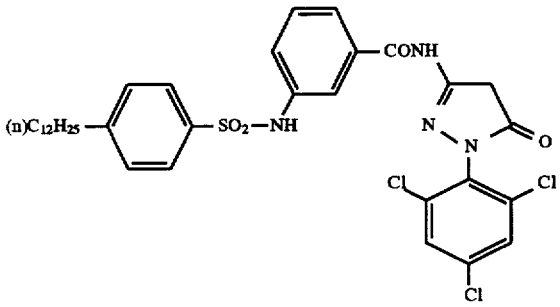
(C-19)
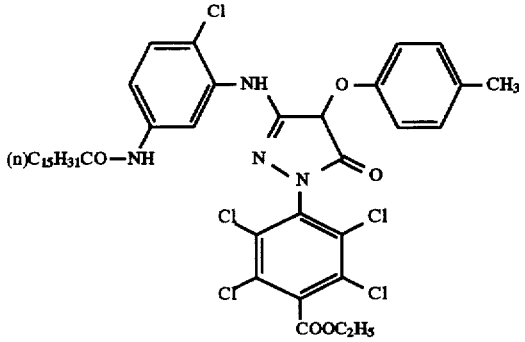
(C-20)
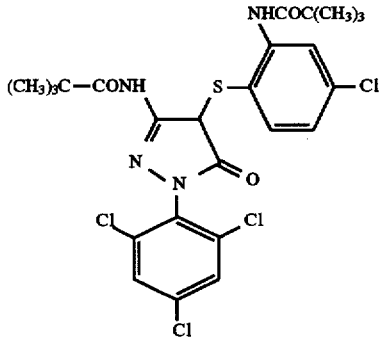
(C-21)
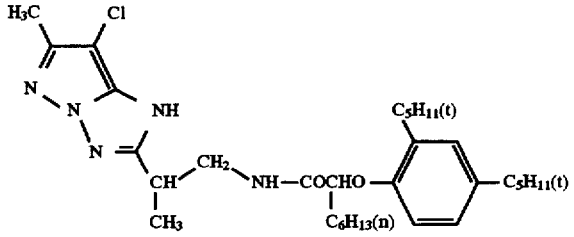

-continued
(C-22)
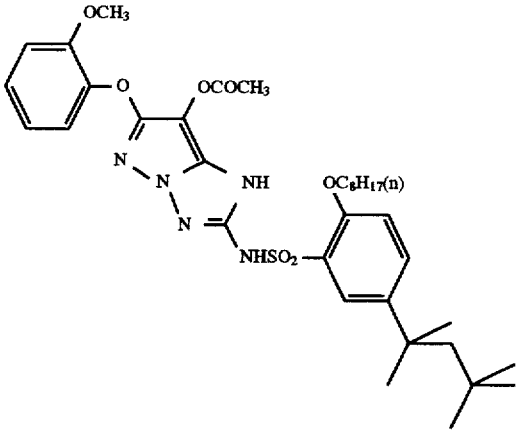
(C-23)
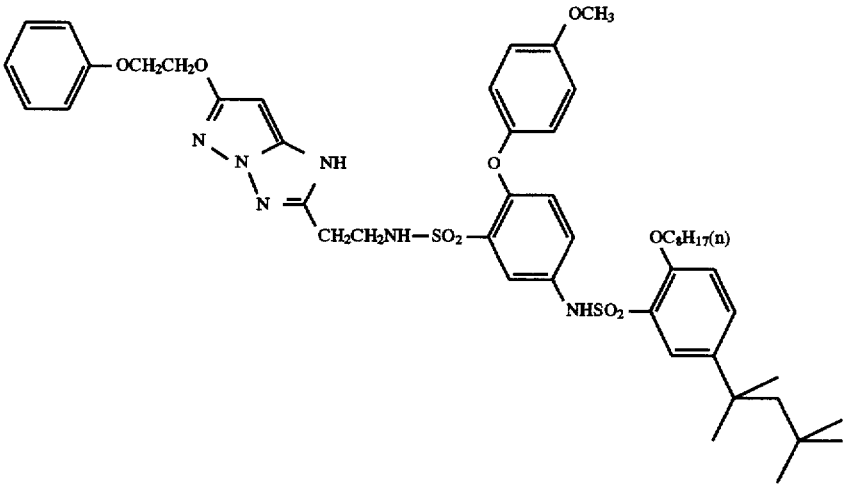
(C-24)
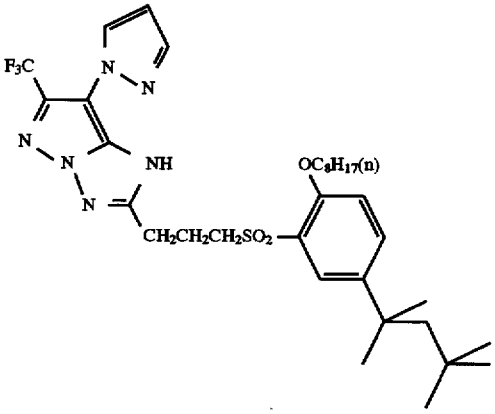

-continued
(C-25)
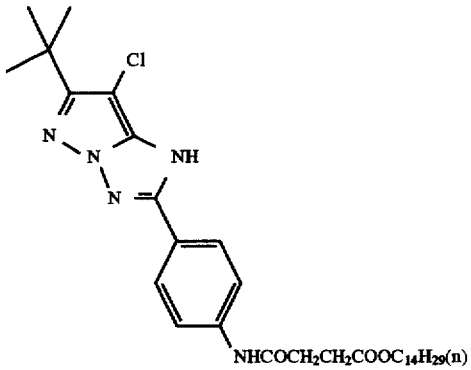
(C-26)
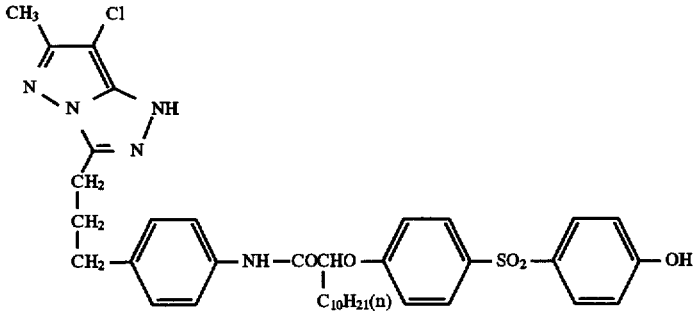
(C-27)
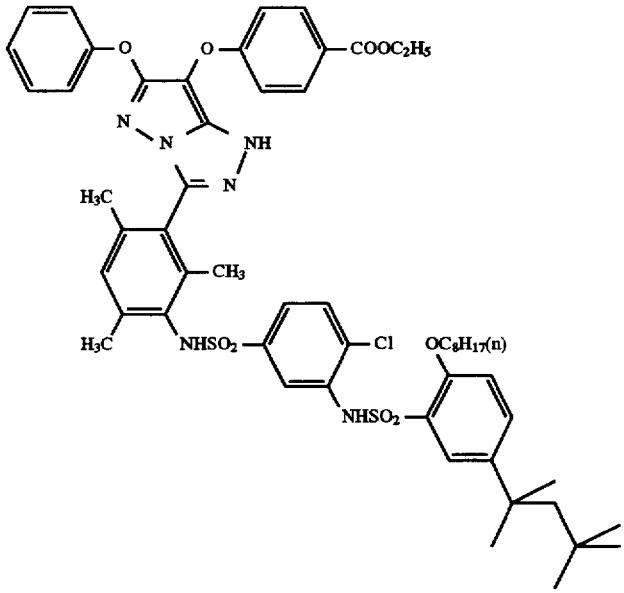

-continued
(C-28)
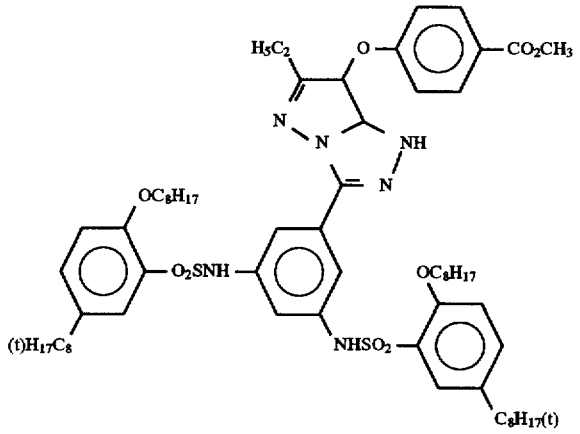
(C-29)
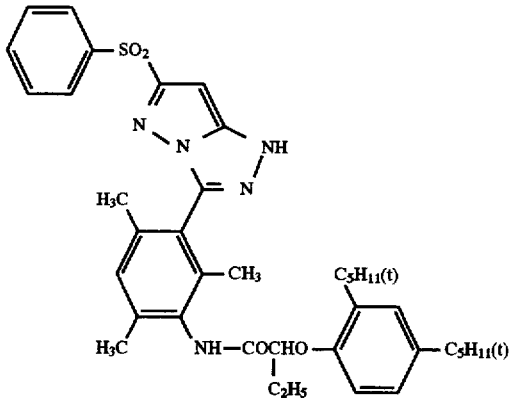
(C-30)
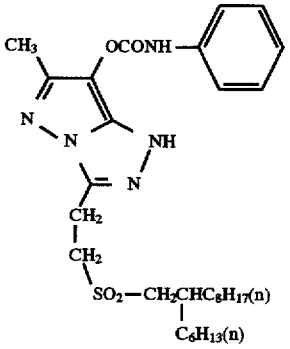
(C-31)
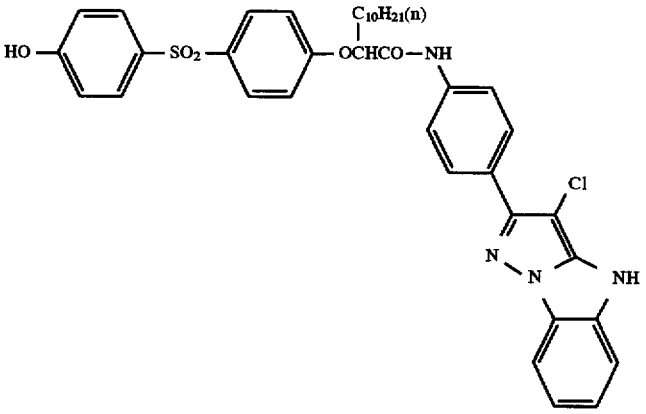

-continued
(C-32)
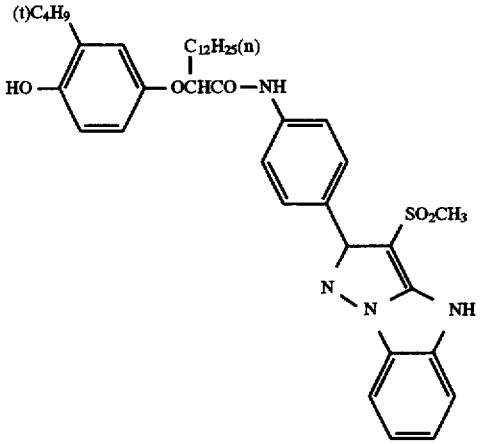
(C-33)
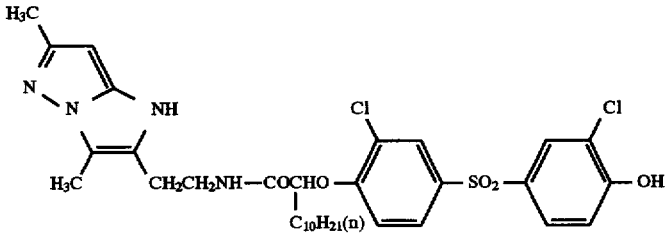
(C-34)
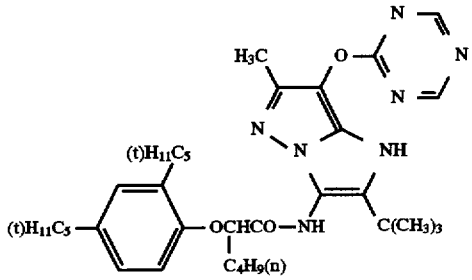
(C-35)
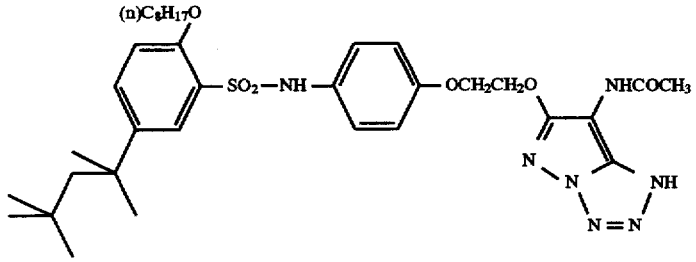
(C-36)
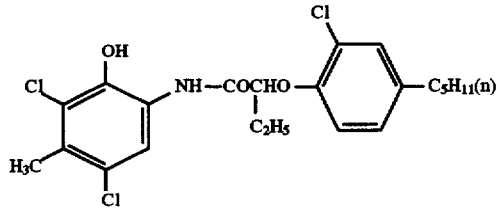

-continued
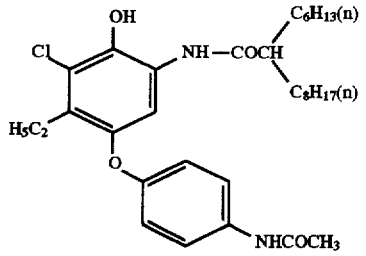
(C-37)
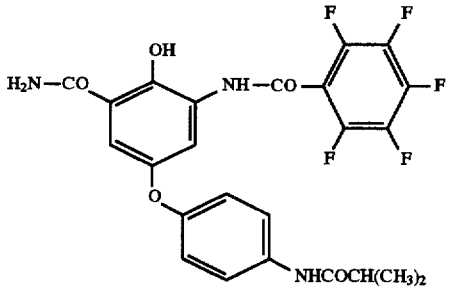
(C-38)
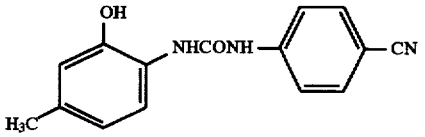
(C-39)
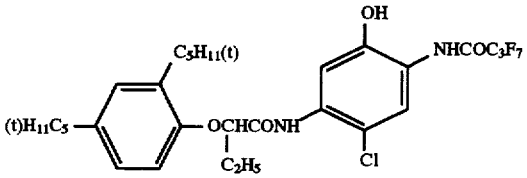
(C-40)
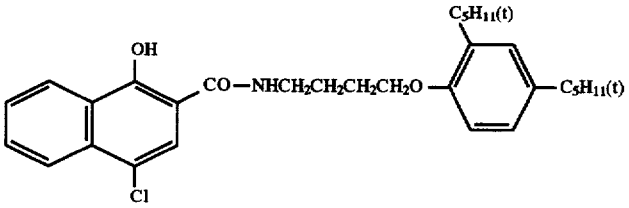
(C-41)
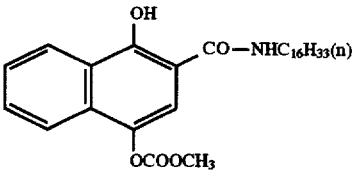
(C-42)
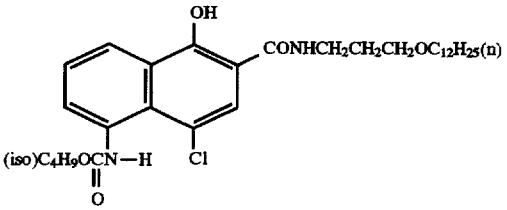
(C-43)

-continued
(C-44)
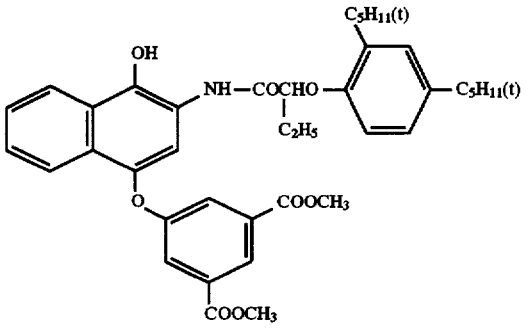
(C-45)
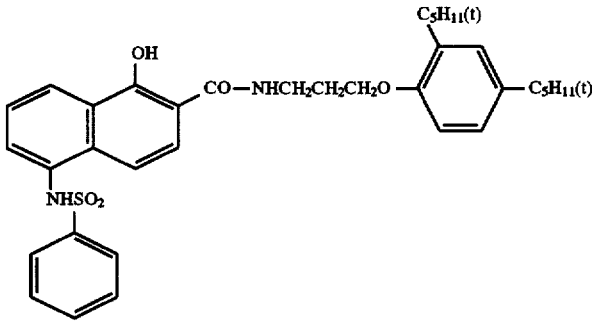
(C-46)
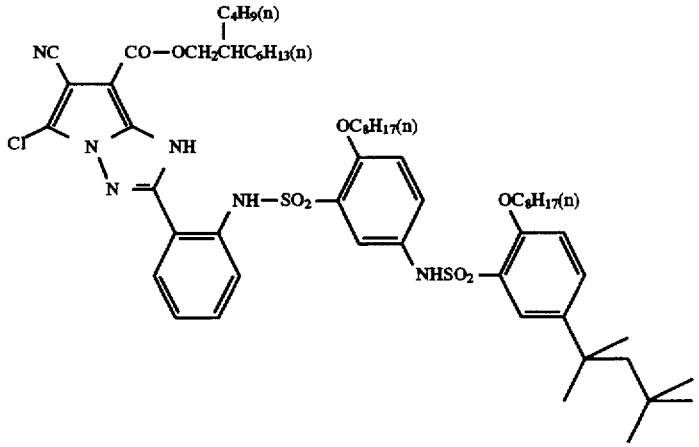
(C-47)
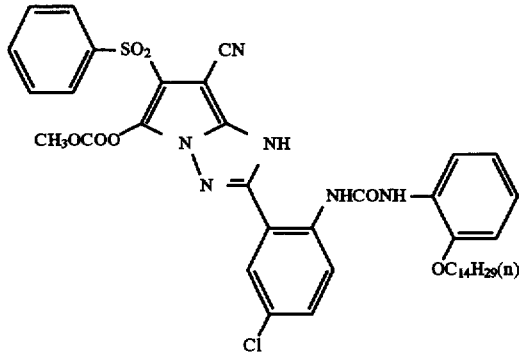

-continued
(C-48)
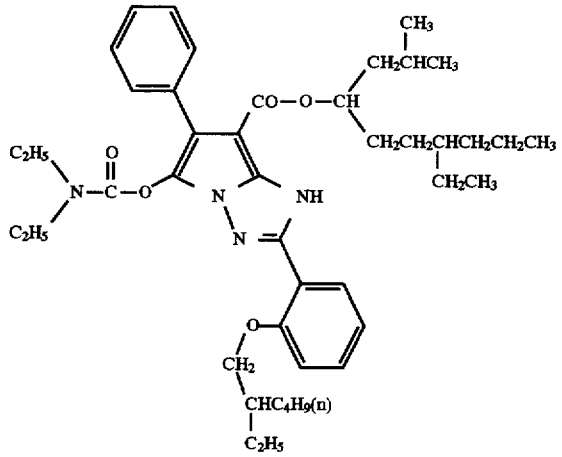
(C-49)
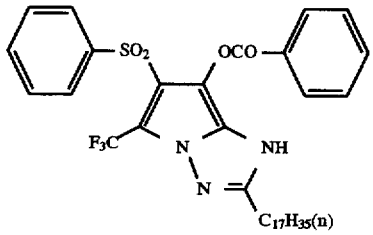
(C-50)
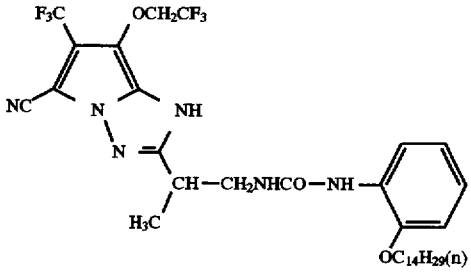
(C-51)
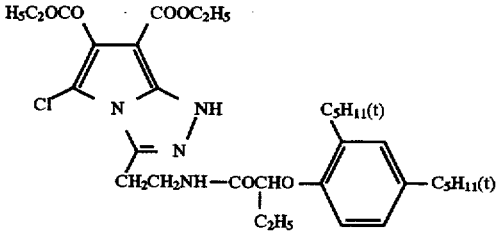
(C-52)
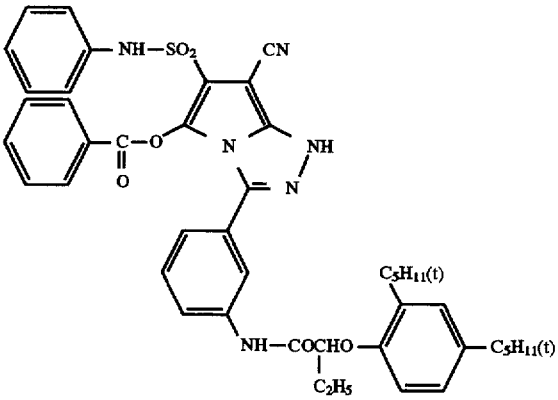

-continued
(C-53)
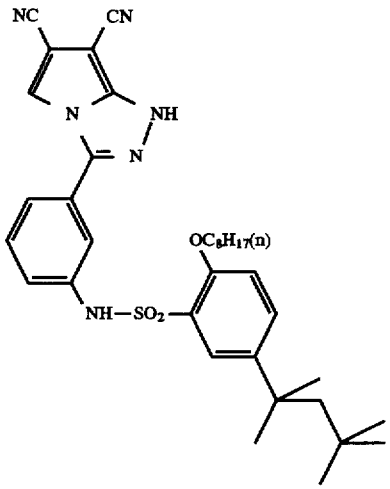
(C-54)
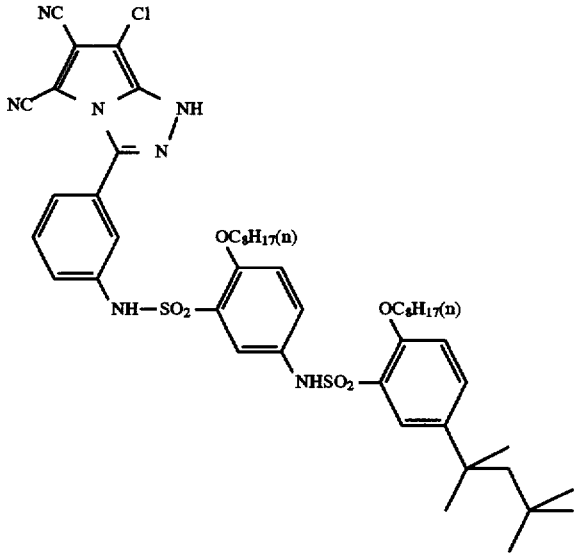
(C-55)
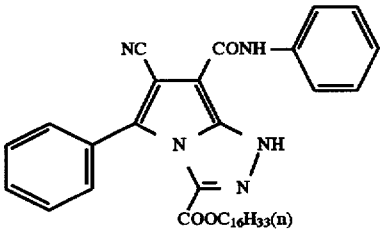
(C-56)
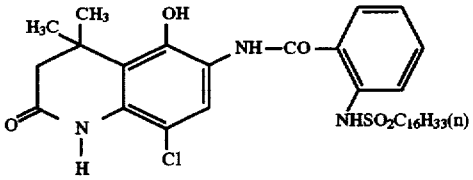
(C-57)
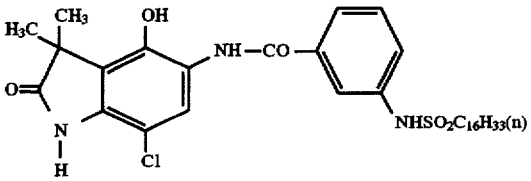

-continued
(C-58)
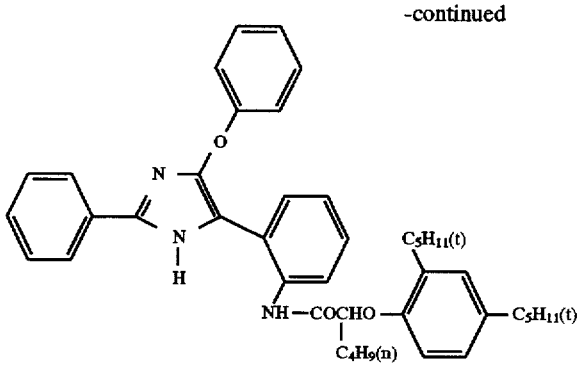
(C-59)
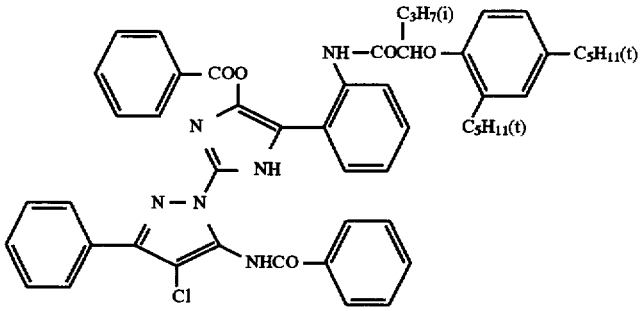
(C-60)
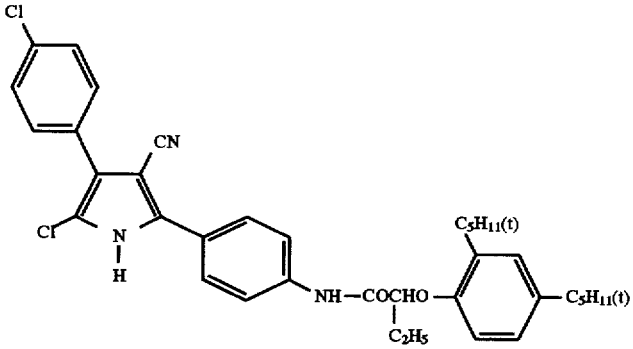
(C-61)
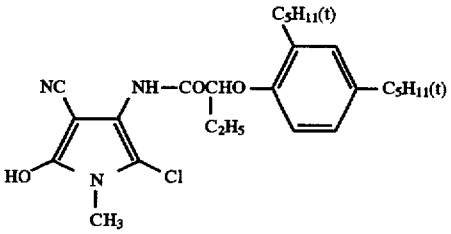
(C-62)
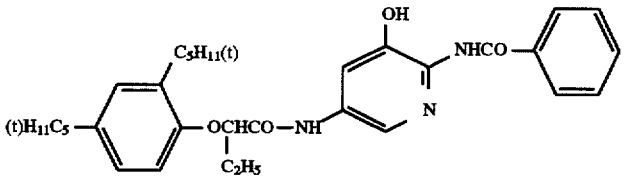
(C-63)
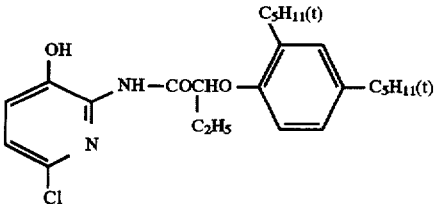

-continued
(C-64)
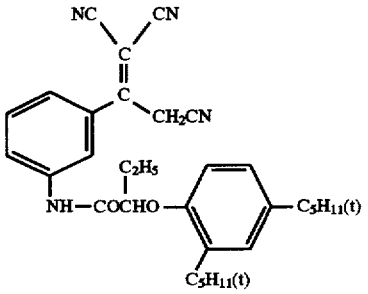
(C-65)
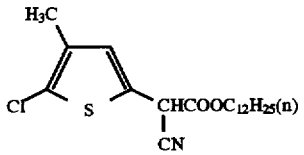
(C-66)
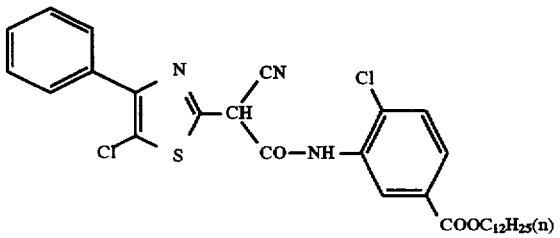
(C-67)
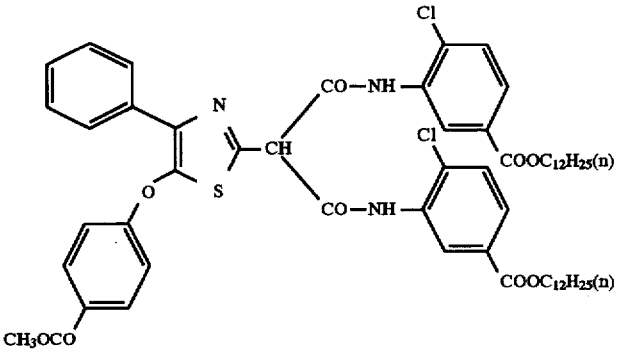
(C-68)
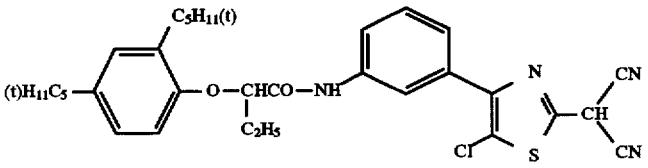
(C-69)
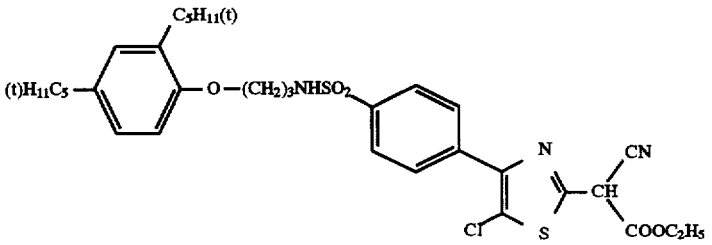

-continued
(C-70)
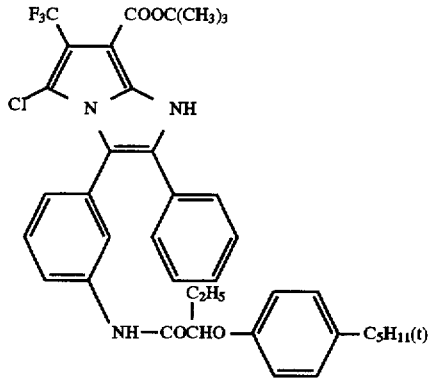
(C-71)
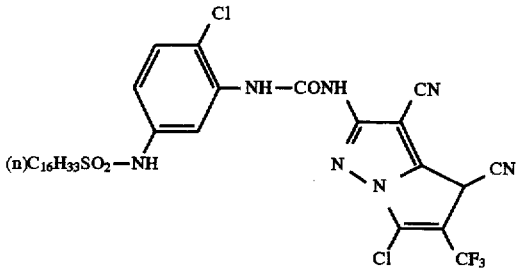
(C-72)
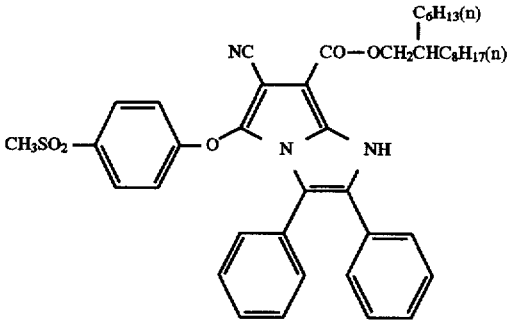
(C-73)
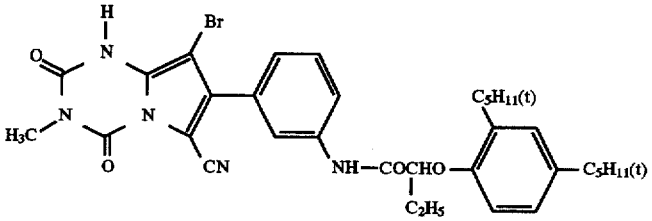
(C-74)
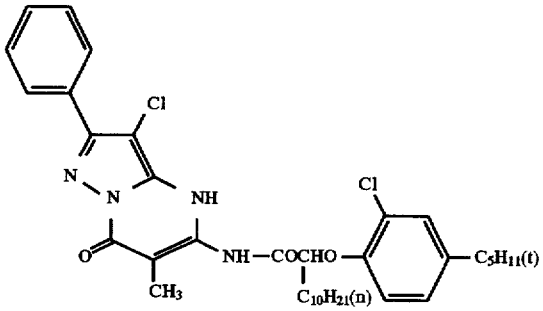

-continued (C-75)

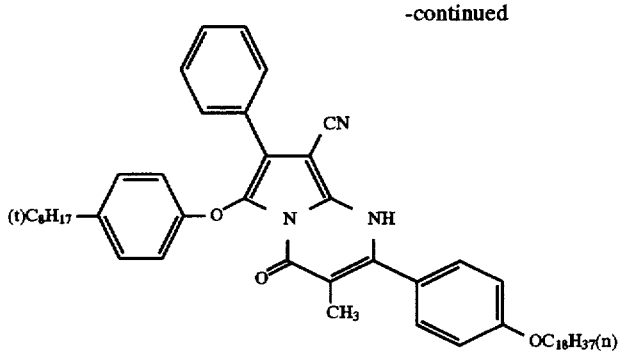

The reducing agent for color formation according to the present invention is preferably used in an amount of 0.01 mmol/m$^2$ to 10 mmol/m$^2$ in one color-forming layer, in order to obtain satisfactory color density. More preferably the amount to be used is 0.05 mmol/m$^2$ to 5 mmol/m$^2$, and particularly preferably 0.1 mmol/m$^2$ to 1 mmol/m$^2$.

A preferable amount of the coupler to be used in the color-forming layer in which the reducing agent for color formation according to the present invention is used, is 0.05 to 20 times, more preferably 0.1 to 10 times, and particularly preferably 0.2 to 5 times, the amount of the reducing agent for color formation in terms of mol.

The color light-sensitive material of the present invention comprises, basically, at least one photographic constitutional layer comprising a hydrophilic colloid layer coated on a support, and in at least one photographic constitutional layers are contained a photosensitive silver halide, a coupler for dye formation, a reducing agent for color formation, and a high-boiling-point organic solvent according to the present invention.

The coupler for dye formation and the reducing agent for color formation to be used in the present invention are added to the same layer, which is the most typical mode, but they may be added separately to separate layers if they are placed in the reactive state. Preferably these components are added to a silver halide emulsion layer of the light-sensitive material or a layer adjacent to it, and particularly preferably both of these components are added to a silver halide emulsion layer.

Now, the high-boiling-point organic solvent according to the present invention is described in detail.

The high-boiling-point organic solvent according to the present invention is a high-boiling-point organic solvent whose electron-donative parameter $\Delta\nu_D$ at 25° C. is 80 or more.

"The electron-donative parameter $\Delta\nu_D$" refers to the value obtained by the difference in the infrared absorption spectrum of methanol-d ($CH_3OD$) between the wave number of the O-D stretching vibration in the high-boiling-point organic solvent and the wave number 2668 cm$^{-1}$ of the O-D stretching vibration in benzene, the standard solvent.

When the heavy hydrogen atom of methanol-d forms a hydrogen bond with the solvent, the constant of the force of the O-D bond changes, and the stretching vibration is shifted to a lower wave number. The width of the shift on the basis of the wave number 2668 cm$^{-1}$ found in benzene that is little electron-donative, is used as a scale of the degree of electron donation of the solvent.

The electron-donative parameter $\Delta\nu_D$ was devised and measured by Kagiya et al., and the method of measuring electron-donative parameters $\Delta\nu_D$ followed the method described by Kagiya et al. in Bull. Chem. Soc. Japan, 41 767 (1968).

Examples of $\Delta\nu_D$ measured for high-boiling-point organic solvents are described in Nihon Shashin Gakkai-shi Vol. 57, No. 5, 333 (1994).

Values of the electron-donative parameters $\Delta\nu_D$ of typical high-boiling-point organic solvents are listed in Tables 1 and 2.

TABLE 1

| | High-boiling-point organic solvent | Electron-donative parameter $\Delta\nu_D$ | Remarks |
|---|---|---|---|
| S-1 | $(C_4H_9CH(C_2H_5)CH_2)_3P{=}O$ | 168 | This invention |
| S-2 | 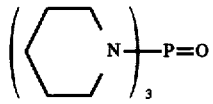 | 168 | " |
| S-3 | 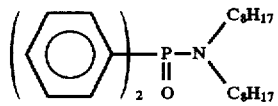 | 159 | " |

TABLE 1-continued

| | High-boiling-point organic solvent | Electron-donative parameter $\Delta\nu_D$ | Remarks |
|---|---|---|---|
| S-4 | 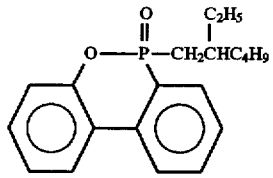 | 121 | " |
| S-5 | $C_8H_{17}-\underset{\underset{O}{\|}}{P}(OC_8H_{17})_2$ | 121 | " |
| S-6 | 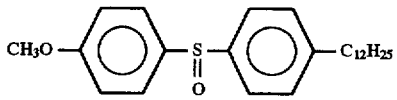 | 117 | " |
| S-7 | 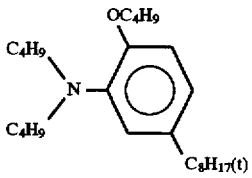 | 117 | " |
| S-8 | $(C_6H_{13}O)_3P=O$ | 109 | " |
| S-9 | $(C_4H_9\underset{\underset{C_2H_5}{\|}}{C}HCH_2O)_3P=O$ | 106 | " |
| S-10 | $(CH_3\overset{\overset{CH_3}{\|}}{\underset{\underset{CH_3}{\|}}{C}}CH_2\overset{\overset{CH_3}{\|}}{C}HCH_2CH_2O)_3P=O$ | 106 | " |

TABLE 2

(continued from Table 1)

| | High-boiling-point organic solvent | Electron-donative parameter $\Delta\nu_D$ | Remarks |
|---|---|---|---|
| S-11 | $C_{11}H_{23}\underset{\underset{O}{\|}}{C}-N(C_2H_5)_2$ | 106 | This invention |
| S-12 | $(C_2H_5)_2HC(=O)N(CH_2\overset{\overset{C_2H_5}{\|}}{C}HC_4H_9)_2$ | 106 | " |
| S-13 | 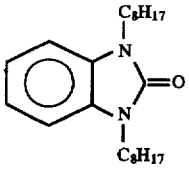 | 98 | " |

TABLE 2-continued (continued from Table 1)

| | High-boiling-point organic solvent | Electron-donative parameter $\Delta\nu_D$ | Remarks |
|---|---|---|---|
| S-14 | 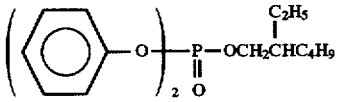 | 87 | " |
| S-15 | 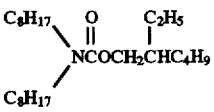 | 80 | " |
| RS-1 | 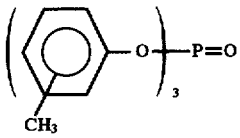 | 76 | Comparative Example |
| RS-2 | 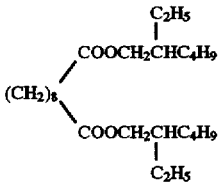 | 39 | Comparative Example |
| RS-3 | 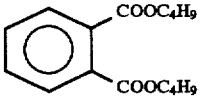 | 33 | Comparative Example |
| RS-4 | $C_{14}H_{24}Cl_6$ | 0 | Compartive Example |

As is apparent from Tables 1 and 2, preferably the high-boiling-point organic solvent according to the present invention, whose electron-donative parameter $\Delta\nu_D$ at 25° C. is 80 or more, includes, for example, phosphoric acid trialkyl esters {e.g. tri(2-ethylhexyl) phosphate, tri(3,5,5-trimethylhexyl) phosphate, trihexyl phosphate, tri(2-butoxyethoxy) phosphate, tri(2,3-dibromopropyl) phosphate, tri(2,3-dichloropropyl) phosphate}, phosphoric acid dialkylmonoaryl esters or phosphoric acid diarylmonoalkyl esters {e.g. diphenyl-2-ethylhexyl phosphate and di(2-ethylhexyl)phenyl phosphate}, phosphine oxides {e.g. trioctylphosphine oxide, triphenylphosphine oxide, and tri (2-ethylhexyl)phosphine oxide}, phosphonic acid esters or phosphinic acid esters {e.g. octylphosphonic acid dioctyl ester, phenylphosphonic acid di(2-ethylhexyl) ester, and diphenyl phosphinate 2-ethylhexyl ester}, phosphoric acid amides (e.g. N,N-dioctyldiphenylphosphinic acid amide, N,N,N',N'-tetraoctytphenyl-phosphonic acid amide, and phosphoric acid tripiperazide), sulfoxides (e.g. dioctyl sulfoxide, diphenyl sulfoxide, and 4-dodecyl-4'-methoxydiphenyl sulfoxide), amines (e.g. trioctylamine and N,N-dibutyl-2-butoxy-5-t-octylaniline), carbonamides (e.g. N,N-diethyllauric acid amide, N-laurylpyrrolidone, and N,N,N',N'-diethylsebacic acid diamide), ureas {e.g. N,N-diethyl-N',N'-di( 2-ethylhexyl)urea and N,N-dioctylbenzoimidazolidone}, and urethanes (e.g. N,N-dioctyl-2-ethylhexyl urethane), with preference given to phosphoric acid trialkyl esters, phosphine oxides, phosphonic acid esters, phosphinic acid esters, phosphoric acid amides, sulfoxides, carbonamides, ureas, phosphoric acid dialkylmonoaryl esters, or phosphoric acid diarylmonoalkyl esters.

The high-boiling-point organic solvent according to the present invention has preferably an electron-donative parameter $\Delta\nu_D$ of 90 or more, more preferably 100 or more, and particularly preferably 120 or more. If the $\Delta\nu_D$ is over 180, the synthesis and availability of the compound itself become difficult, and therefore the upper limit is preferably 180 or below.

The high-boiling-point organic solvent used in the present invention is selected more preferably from compounds represented by the following formula [S] with the electron-donative parameter in the specified range.

formula [S]

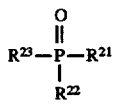

In formula [S], $R^{21}$, $R^{22}$, and $R^{23}$ each independently represent an aliphatic group, an aryl group, an aliphatic oxy group, an aryloxy group, or an amino group, provided that $R^{21}$, $R^{22}$, and $R^{23}$ are not aryloxy groups simultaneously.

Herein, if $R^{21}$ to $R^{23}$ are aliphatic groups or groups containing an aliphatic group, the aliphatic groups may be any of straight-chain, branched-chain, or cyclic aliphatic groups; they may contain unsaturated bonds; and they may have substituents (e.g. a halogen atom, an aryl group, an alkoxy group, an aryloxy group, an alkoxycarbonyl group, an acyloxy group, and an epoxy group). If $R^{21}$ to $R^{23}$ are cycloaliphatic groups, that is, cycloalkyl groups, or groups containing a cycloalkyl group, the cycloalkyl group is preferably a 3- to 8-membered ring, and the ring may contain unsaturated bonds in the ring and may have substituents (e.g. a halogen atom, an aliphatic group, an aryl group, an epoxy group, an alkoxy group, and an aryloxy group) or a cross-linking group capable of forming a dimer (e.g. methylene, ethylene, and isopropylidene). If $R^{21}$ to $R^{23}$ are aryl groups or groups containing an aryl group, the aryl group may be a condensed ring (e.g. a naphthyl group) or may have substituents (e.g. a halogen atom, an alkyl group, a cycloalkyl group, an aryl group, an alkoxy group, an aryloxy group, an alkoxycarbonyl group, an acyloxy group, and an acyl group).

Further, if $R^{21}$ to $R^{23}$ are amino groups, an aliphatic group or an aryl group may be substituted on the nitrogen atom of the amino group, and the amino group may be part of a heterocyclic ring (e.g. a pyrrolidine ring, a piperidine ring, and a morpholine ring).

Out of the compounds represented by formula [S], compounds further preferable in the present invention are described below.

In formula [S], $R^{21}$, $R^{22}$, and $R^{23}$ each independently represent an aliphatic group having a total carbon number (hereinafter referred to as a C-number) of 1 to 24 (preferably 4 to 18, and more preferably 4 to 8) [e.g. methyl, t-butyl, n-hexyl, 2-ethylhexyl, n-dodecyl, oleyl, 2-chloroethyl, 2,3-dibromopropyl, benzyl, methoxyethyl, 3,5,5-trimethylhexyl, 2-hexyldecyl, 10,11-epoxyundecyl, cyclohexyl, 4-t-butylcyclohexyl], an aryl group having a C-number of 6 to 24 (preferably 6 to 18) [e.g. phenyl, cresyl, xylyl, p-nonylphenyl, p-methoxyphenyl, p-t-butylphenyl, and p-methoxycarbonylphenyl], an aliphatic oxy group having a C-number of 1 to 24 (preferably 4 to 18, and more preferably 4 to 8) [e.g. methoxy, ethoxy, i-propoxy, t-butoxy, butoxy, hexyloxy, 2-ethylhexyloxy, n-dodecyloxy, oleyloxy, stearyloxy, 2-hexyldecyloxy, 2-chloroethoxy, 3-chloropropoxy, 2,3-dichlropropoxy, 2,3-dibromopropoxy, 3-phenylpropoxy, 2-butoxyethoxy, 3,5,5-trimethylhexyloxy, 10,11-epoxyundecyloxy, 2-phenoxyethoxy, cyclopentyloxy, cyclohexyloxy, 4-t-butylcyclohexyloxy, bornyloxy, and methyloxy], an aryloxy group having a C-number of 6 to 24 (preferably 6 to 18) (e.g. phenoxy, 4-methylphenoxy, 3-methylphenoxy, 3,4-dimethylphenoxy, 4-(i-propyl) phenoxy, 4-nonylphenoxy, 4-methoxyphenoxy, 4-t-butylphenoxy, and 4-methoxycarbonylphenoxy), or an amino group having a C-number of 0 to 40 (preferably 2 to 18) (e.g. N,N-diethylamino, N-octylamino, N-cyclohexylamino, N-oleylamino, N,N-distearylamino, N-methyl-N-phenylamino, N-phenylamino, N,N-diphenylamino, piperidino, morpholino, and pyrrolidino); and more preferably $R^{21}$, $R^{22}$, and $R^{23}$each represent an aliphatic group, an aryl group, aliphatic oxy group, or an aryloxy group, and particularly preferably an aliphatic oxy group.

When all of $R^{21}$, $R^{22}$, and $R^{23}$ represent aliphatic oxy groups, preferably they represent the same group, and most preferably they represent the same alkoxy group.

Further, when all of $R^{21}$, $R^{22}$, and $R^{23}$ represent aliphatic groups, aryl groups, or amino groups, preferably they represent the same group.

However, $R^{21}$, $R^{22}$, and $R^{23}$ do not represent aryloxy groups at the same time.

The sum of the C-numbers of $R^{21}$, $R^{22}$, and $R^{23}$ is preferably 12 to 54, more preferably 12 to 36, and further more preferably 18 to 24.

In formula [S], $R^{21}$ may represent a divalent group, and the thus formed bisphosphate compound having two groups shown below bonded in the compound, can be used in the present invention:

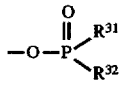

In addition to the above-mentioned S-1 to S-15, specific examples of the high-boiling-point organic solvent according to the present invention, whose electron-donative parameter $\Delta\nu_D$ value at 25° C. is 80 or more, are shown below:

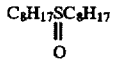

S-16

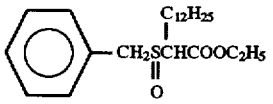

S-17

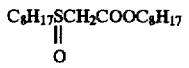

S-18

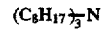

S-19

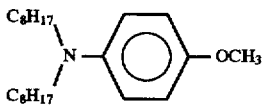

S-20

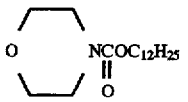

S-21

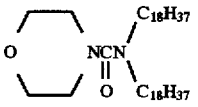

S-22

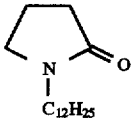

S-23

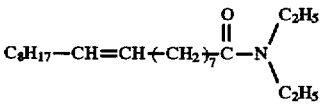

S-24

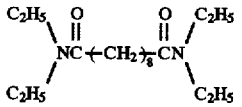

S-25

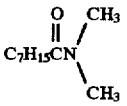

S-26

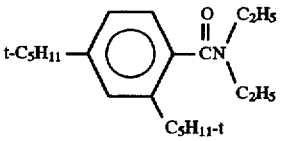

S-27

-continued

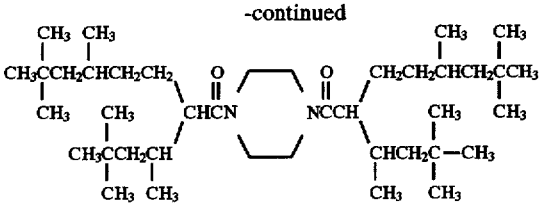

S-28

$(C_4H_9O)_3P{=}O$ S-29

$(i\text{-}C_{10}H_{21}O)_3P{=}O$ S-30

$(C_{12}H_{25}O)_3P{=}O$ S-31

$(C_{18}H_{37}O)_3P{=}O$ S-32

$(C_8H_{17}{-}CH{=}CH{-}(CH_2)_8O)_3P{=}O$ S-33

$(ClCH_2CH_2CH_2O)_3P{=}O$ S-34

$(ClCH_2CH(Cl)CH_2O)_3P{=}O$ S-35

$(BrCH_2CH(Br)CH_2O)_3P{=}O$ S-36

$(C_4H_9O{-}(CH_2)_2O)_3P{=}O$ S-37

$(C_4H_9CH(C_2H_5)CH_2O)_2P(C_4H_9O){=}O$ S-38

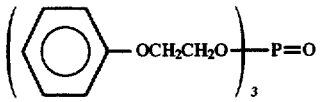

S-39

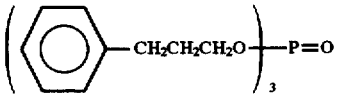

S-40

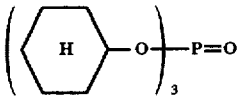

S-41

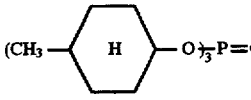

S-42

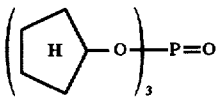

S-43

$(C_4H_9O)_2PO{-}(CH_2)_6OP{-}(OC_4H_9)_2$ S-44

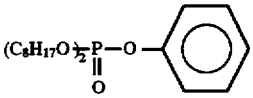

S-45

$(C_8H_{17})_3P{=}O$ S-46

-continued

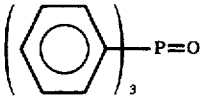

S-47

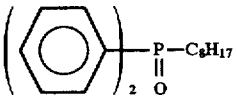

S-48

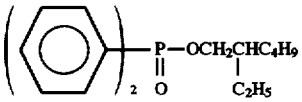

S-49

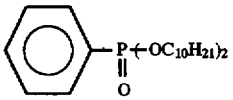

S-50

$(C_8H_{17})_2P(=O){-}OC_8H_{17}$ S-51

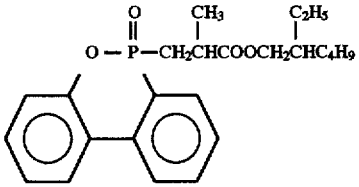

S-52

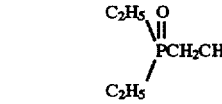

S-53

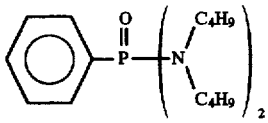

S-54

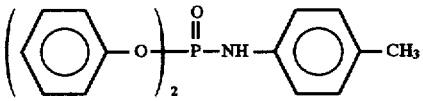

S-55

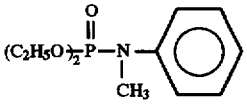

S-56

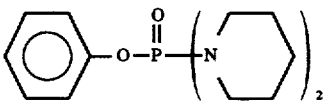

S-57

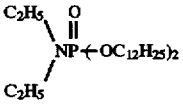

S-58

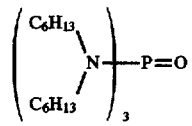

S-59

Specific examples of phosphoric acid ester-series high-boiling-point organic solvents represented by formula [S], other than those mentioned above, and/or the method for synthesizing them, are described, for example, in U.S. Pat.

Nos. 2,322,027, 3,676,137, 4,220,711, and 4,278,757, European Patent No. 286,253, and JP-A No. 1520/1978.

In the present invention, the high-boiling-point organic solvent having a specified electron-donative parameter can be used in combination with another high-boiling-point organic solvent and can also serve as an additive, such as a stabilizer. Herein, "a high boiling point" means preferably a boiling point of 175° C. or over under normal pressures.

It is enough that the high-boiling-point organic solvent according to the present invention is contained in at least one of the photographic constitutional layers; preferably it is contained in a hydrophilic colloid layer; and particularly preferably it is contained in a photosensitive silver halide emulsion layer containing a coupler.

The amount of the high-boiling-point organic solvent according to the present invention to be used can be varied to meet the purpose and is not particularly restricted. The amount to be used is preferably in the range of from 0.01 to 20, more preferably from 0.01 to 10, and further more preferably from 0.02 to 5, in terms of weight ratio to the reducing agent for color formation to be used.

Additionally, if the compound according to the present invention is used in combination with a known high-boiling-point organic solvent, the compound according to the present invention is used preferably in a weight ratio of 10% or more to 100% or less, and more preferably 25% or more to 100% or less, to the total amount of the high-boiling-point organic solvents.

Examples of other high-boiling-point organic solvents that can be used in combination with the high-boiling-point organic solvent for use in the present invention are described, for example, in U.S. Pat. No. 2,322,027. Specific examples of high-boiling-point organic solvents having a boiling point of 175° C. or more under normal pressures are phthalates [e.g. dibutyl phthalate, dicyclohexyl phthalate, di-2-ethylhexyl phthalate, decyl phthalate, bis(2,4-di-tert-aminophenyl) phthalate, bis(2,4-di-tert-amylphenyl) isophthalate, and bis(1,1-diethylpropyl) phthalate], phosphoric acid aryl esters (e.g. triphenyl phosphate, tricresyl phosphate), benzoates (e.g. 2-ethylhexyl benzoate, dodecyl benzoate, and 2-ethylhexyl-p-hydroxy benzoate), sulfonamides (e.g. N-butylbenzene sulfonamide), alcohols or phenols (e.g. isosteary alcohol and 2,4-di-tert-amylphenol), aliphatic carboxylic acid esters (e.g. bis(2-ethylhexyl) sebacate, dioctyl azelate, glycerol tributylate, isostearyl lactate, and trioctyl citrate), hydrocarbons (e.g., paraffin, dodecylbenzene, and diisopropylnaphthalene), and chlorinated paraffins. Further, as co-solvents, organic solvents having a boiling point of 30° C. or over, and preferably 50° C. or over to about 160° C. or below, can be used, and typical examples are ethyl acetate, butyl acetate, ethyl propionate, methyl ethyl ketone, cyclohexanone, 2-ethoxyethyl acetate, and dimethylformamide.

The preferable means of placing the reducing agent for color formation and the dye-forming coupler to be used in the present invention contained in any one of photographic constitutional layers, is that these compounds are dissolved in the high-boiling-point organic solvent for use in the present invention (if necessary, used in combination with the above co-solvent); the solution is finely emulsified and dispersed in a hydrophilic colloid; and the resulting emulsified dispersion (in admixture with a silver halide emulsion as a preferable mode) is coated on a support.

To emulsify and disperse the compounds to be used in the present invention, a known polymer dispersion method may be used. Specific examples of the steps and the effects of the latex dispersion method, which is a polymer dispersion method, and specific examples of latexes for impregnation, are described, for example, in U.S. Pat. No. 4,199,363, West German Patent Application (OLS) Nos. 2,541,274 and 2,541,230, JP-B ("JP-B" means examined Japanese patent publication) No. 41091/1978, and European Patent Laid-Open Publication No. 029104; and the dispersion method using a polymer that is insoluble in water but soluble in an organic solvent is described in PCT International Laid-Open Publication No. WO 88/00723.

The average particle size of the lipophilic fine particles containing the reducing agent for color formation according to the present invention is not particularly limited, and the average particle size is preferably 0.05 to 0.3 μm, and more preferably 0.05 to 0.2 μm, in view of the color-forming properties.

Making the average particle size of the lipophilic fine particles small is generally attained, for example, by selecting an appropriate type of surface-active agent; by increasing the amount of a surface-active agent to be used; by increasing the viscosity of the hydrophilic colloid solution; by lowering the viscosity of the lipophilic organic layer by, for example, the combined use of a low-boiling-point organic solvent; by increasing the shearing force, for example, by intensifying the rotation of the stirring blades of an emulsifying apparatus; by prolonging the emulsifying period.

The particle size of lipophilic fine particles can be measured, for example, by such an apparatus as a Nanosizer, manufactured by British Coulter.

As the support to be used in the present invention, any support can be used if it is a transmissible support or a reflective support on which a photographic emulsion layer can be coated, such as glass, paper, and plastic film.

As the plastic film to be used in the present invention, for example, polyester films made, for example, of polyethylene terephthalates, polyethylene naphthalates, cellulose triacetate, or cellulose nitrate; polyamide films, polycarbonate films, and polystyrene films can be used.

"The reflective support" that can be used in the present invention refers to a support that increases the reflecting properties to make bright the dye image formed in the silver halide emulsion layer, and such a reflective support includes a support coated with a hydrophilic resin containing a light-reflecting substance, such as titanium oxide, zinc oxide, calcium carbonate, and calcium sulfate, dispersed therein, or a support made of a hydrophilic resin itself containing a dispersed light-reflecting substance. Examples are a polyethylene-coated paper, a polyester-coated paper, a polypropylene-series synthetic paper, a support having a reflective layer or using a reflecting substance, such as a glass sheet; a polyester film made, for example, of a polyethylene terephthalate, cellulose triacetate, or cellulose nitrate; a polyamide film, a polycarbonate film, a polystyrene film, and a vinyl chloride resin. As the polyester-coated paper, particularly a polyester-coated paper whose major component is a polyethylene terephthalate, as described in European Patent EP 0,507,489, is preferably used.

The reflective support to be used in the present invention is preferably a paper support, both surfaces of which are coated with a water-resistant resin layer, and at least one of the water-resistant resin layers contains fine particles of a white pigment. Preferably the particles of a white pigment are contained in a density of 12% or more by weight, and more preferably 14% or more by weight. Preferably the light-reflecting white pigment is kneaded well in the presence of a surface-active agent, and the surface of the pigment particles is treated with a dihydric to tetrehydric alcohol.

In the present invention, a support having a diffuse reflective surface of a second kind can also be used, preferably. "Diffuse reflectivity of a second kind" means diffuse reflectivity obtained by making a specular surface uneven, to form finely divided specular surfaces facing different directions, which finely divided surfaces, specular surfaces, are dispersed in their directions. The unevenness of the diffuse reflective surface of the second kind has a three-dimensional average coarseness of 0.1 to 2 μm, and preferably 0.1 to 1.2 μm, for the center surface. Details about such a support are described in JP-A No. 239244/1990.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of three layers of a blue-sensitive layer, a green-sensitive layer, and a red-sensitive layer, and a combination of a green-sensitive layer, a red-sensitive layer, and an infrared-sensitive laser, and the like can be coated on the above support. The photosensitive layers can be arranged in various orders known generally for color light-sensitive materials. Further, each of these light-sensitive layers can be divided into two or more layers if necessary.

In the light-sensitive material, photographic constitutional layers comprising various auxiliary layers can be provided, such as above photosensitive layer, a protective layer, an underlayer, an intermediate layer, an antihalation layer, and a back layer. Further, in order to improve the color separation, various filter dyes can be added to the photographic constitutional layer.

The silver halide grains used in the present invention are made of silver bromide, silver chloride, silver iodide, silver chlorobromide, silver chloroiodide, silver iodobromide, or silver chloroiodobromide. Other silver salts, such as silver rhodanate, silver sulfide, silver selenide, silver carbonate, silver phosphate, or a silver salt of an organic acid, may be contained in the form of independent grains or as part of silver halide grains. If it is desired to make the development/desilvering (bleaching, fixing, and bleach-fix) step rapid, silver chlorobromide grains or silver chloride grains having a high silver chloride content (preferably 95 mol % or more) are desirable. Further, if the development is to be restrained moderately, it is preferable to contain silver iodide. The preferable silver iodide content varies depending on the intended light-sensitive material. For example, in the case of X-ray photographic materials, the preferable silver iodide content is in the range of 0.1 to 15 mol %, and in the case of graphic art and micro photographic materials, the preferable silver iodide content is in the range of 0.1 to 5 mol %. In the case of photographic materials represented by color negatives, preferably silver halide contains 1 to 30 mol %, more preferably 5 to 20 mol %, and particularly preferably 8 to 15 mol %, of silver iodide. It is preferable to incorporate silver chloride in silver iodobromide grains, because the lattice strain can be made less intense. For a reflect-type light-sensitive material that is necessary to be rapidly processed, the silver iodide content is preferably 0, or 1 mol % or below.

In the silver halide grains used in the present invention, in accordance with the purpose, any of regular crystals having no twin plane, and those described in "Shashin Kogyo no Kiso, Ginen Shashin-hen", edited by Nihon Shashin-gakkai (Corona Co.), page 163, such as single twins having one twin plane, parallel multiple twins having two or more parallel twin planes, and nonparallel multiple twins having two or more nonparallel twin planes, can be chosen and used. An example in which grains different in shape are mixed is disclosed in U.S. Pat. No. 4,865,964, and if necessary this method can be chosen. In the case of regular crystals, cubes having (100) planes, octahedrons having (111) planes, and dodecahedral grains having (110) planes, as disclosed in JP-B No. 42737/1980 and JP-A No. 222842/1985, can be used. Further, (h11) plane grains represented by (211), (hh1) plane grains represented by (331), (hk0) plane grains represented by (210) planes, and (hk1) plane grains represented by (321) planes, as reported in "Journal of Imaging Science", Vol. 30, page 247 (1986), can be chosen and used in accordance with the purpose, although the preparation is required to be adjusted. Grains having two or more planes in one grain, such as tetradecahedral grains having (100) and (111) planes in one grain, grains having (100) and (110) planes in one grain, or grains having (111) and (110) planes in one grain, can be chosen and used in accordance with the purpose.

The value obtained by dividing the diameter of the projected area, which is assumed to be a circle, by the thickness of the grain, is called an aspect ratio, which defines the shape of tabular grains. Tabular grains having an aspect ratio of 1 or more can be used in the present invention. Tabular grains can be prepared by methods described, for example, by Clear in "Photography Theory and Practice" (1930), page 131; by Gutof in "Photographic Science and Engineering", Vol. 14, pages 248 to 257 (1970); and in U.S. Pat. Nos. 4,434,226, 4,414,310, 4,433,048, and 4,439,520, and British Patent No. 2,112,157. When tabular grains are used, such merits are obtained that the covering power is increased and the color sensitization efficiency due to a sensitizing dye is increased, as described in detail in the above-mentioned U.S. Pat. No. 4,434,226. The average aspect ratio of 80% or more of all the projected areas of grains is desirably 1 or more but less than 100, more preferably 2 or more but less than 20, and particularly preferably 3 or more but less than 10. As the shape of tabular grains, a triangle, a hexagon, a circle, and the like can be chosen. A regular hexagonal shape having six approximately equal sides, described in U.S. Pat. No. 4,798,354, is a preferable mode.

In many cases, the grain size of tabular grains is expressed by the diameter of the projected area assumed to be a circle, and grains having an average diameter of 0.6 microns or below, as described in U.S. Pat. No. 4,748,106, are preferable, because the quality of the image is made high. An emulsion having a narrow grain size distribution, as described in U.S. Pat. No. 4,775,617, is also preferable. It is preferable to restrict the shape of tabular grains so that the thickness of the grains may be 0.5 microns or below, and more preferably 0.3 microns or below, because the sharpness is increased. Further, an emulsion in which the grains are highly uniform in thickness, with the deviation coefficient of grain thickness being 30% or below, is also preferable. Grains in which the thickness of the grains and the plane distance between twin planes are defined, as described in JP-A No. 163451/1988, are also preferable.

In the case of tabular grains, the dislocation lines can be observed by a transmission electron microscope. In accordance with the purpose, it is preferable to choose grains having no dislocation lines, grains having several dislocation lines, or grains having many dislocation lines. Dislocation introduced straight in a special direction in the crystal orientation of grains, or curved dislocation, can be chosen, and it is possible to choose from, for example, dislocation introduced throughout grains, dislocation introduced in a particular part of grains, and dislocation introduced limitedly to the fringes of grains. In addition to the case of introduction of dislocation lines into tabular grains, also preferable is the case of introduction of dislocation lines into regular crystalline grains or irregular grains, represented by potato grains. In this case, a preferable mode is that introduction is limited to a particular part of grains, such as vertexes and edges.

The silver halide emulsion used in the present invention may be subjected to a treatment for making grains round, as disclosed, for example, in European Patent Nos. 96,727B1 and 64,412B1, or it may be improved in the surface, as disclosed in West Germany Patent No. 2,306,447C2 and JP-A No. 221320/1985.

Generally, the grain surface has a flat structure, but it is also preferable in some cases to make the grain surface uneven intentionally. Examples are a technique in which part of crystals, for example, vertexes and the centers of planes, are formed with holes, as described in JP-A Nos. 106532/1983 and 221320/1985, and ruffled grains, as described in U.S. Pat. No. 4,643,966.

The grain size of the emulsion used in the present invention is evaluated, for example, by the diameter of the projected area equivalent to a circle using an electron microscope; by the diameter of the grain volume equivalent to a sphere, calculated from the projected area and the grain thickness; or by the diameter of a volume equivalent to a sphere, using the Coulter Counter method. A selection can be made from ultrafine grains having a sphere-equivalent diameter of 0.05 microns or below, and coarse grains having a sphere-equivalent diameter of 10 microns or more. Preferably grains of 0.1 microns or more but 3 microns or below are used as photosensitive silver halide grains.

As the emulsion used in the present invention, an emulsion having a wide grain size distribution, that is, a so-called polydisperse emulsion, or an emulsion having a narrow grain size distribution, that is, a so-called monodisperse emulsion, can be chosen and used in accordance with the purpose. As the scale for representing the size distribution, the deviation coefficient of the diameter of the projected area of the grain equivalent to a circle, or the deviation coefficient of the sphere-equivalent diameters of the volume, is used. If a monodisperse emulsion is used, it is good to use an emulsion having such a size distribution that the deviation coefficient is 25% or below, more preferably 20% or below, and further more preferably 15% or below.

Further, in order to allow the light-sensitive material to satisfy the intended gradation, in an emulsion layer having substantially the same color sensitivity, two or more monodisperse silver halide emulsions different in grain size are mixed and applied to the same layer or are applied as overlaid layers. Further, two or more polydisperse silver halide emulsions can be used as a mixture; or they can be used to form overlaid layers; or a combination of a monodisperse emulsion and a polydisperse emulsion can be used as a mixture; or the combination can be used to form overlaid layers.

The photographic emulsion used in the present invention can be prepared by a method described, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964. That is, any of the acid process, the neutral process, the ammonia process, and the like can be used; and to react a soluble silver salt with a soluble halogen salt, any of the single-jet method, the double-jet method, a combination thereof, and the like can be used. A method wherein grains are formed in the presence of excess silver ions (the so-called reverse precipitation process) can also be used. As one type of the double-jet method, a method wherein pAg in the liquid phase, in which a silver halide will be formed, is kept constant, that is, the so-called controlled double-jet method, can also be used. According to this method, a silver halide emulsion wherein the crystals are regular in shape and whose grain size is approximately uniform, can be obtained.

When the emulsion according to the present invention is prepared, in accordance with the purpose, it is preferable to allow a salt of a metal ion to be present, for example, at the time when grains are formed, in the step of desalting, at the time when the chemical sensitization is carried out, or before the application. When the grains are doped, the addition is preferably carried out at the time when the grains are formed; or after the formation of the grains, when the surface of the grains is modified or when the salt of a metal ion is used as a chemical sensitizer; or before the completion of the chemical sensitization. As to the doping of grains, selection can be made from a case in which the whole grains are doped, one in which only the core parts of the grains are doped, one in which only the shell parts of the grains are doped, one in which only the epitaxial parts of the grains are doped, and one in which only the substrate grains are doped. For example, Mg, Ca, Sr, Ba, Al, Sc, Y, La, Cr, Fin, Fe, Co, Ni, Cu, Zn, Ga, Ru, Rh, Pd, Re, Os, Ir, Pt, Au, Cd, Hg, Tl, In, Sn, Pb, and Bi can be used. These metals can be added if they are in the form of a salt that is soluble at the time when grains are formed, such as an ammonium salt, an acetate, a nitrate, a sulfate, a phosphate, a hydroxide, a six-coordinate complex, and a four-coordinate complex. Examples include $CdBr_2$, $CdCl_2$, $Cd(NO_3)_2$, $Pd(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. As a ligand of the coordination compound, one can be selected from a halogen, $H_2O$, a cyano group, a cyanate group, a thiocyanate group, a nitrosyl group, a thionitrosyl group, an oxo group, and a carbonyl group. With respect to these metal compounds, only one can be used, but two or more can also be used in combination.

In some cases, a method wherein a chalcogen compound is added during the preparation of the emulsion, as described in U.S. Pat. No. 3,772,031, is also useful. In addition to S, Se, and Te, a cyanate, a thiocyanate, a selenocyanate, a carbonate, a phosphate, or an acetate may be present.

The silver halide grains according to the present invention can be subjected to at least one of sulfur sensitization, selenium sensitization, tellurium sensitization (these three are called chalcogen sensitization, collectively), noble metal sensitization, and reduction sensitization, in any step of the production for the silver halide emulsion. A combination of two or more sensitizations is preferable. Various types of emulsions can be produced, depending on the steps in which the chemical sensitization is carried out. There are a type wherein chemical sensitizing nuclei are embedded in grains, a type wherein chemical sensitizing nuclei are embedded at parts near the surface of grains, and a type wherein chemical sensitizing nuclei are formed on the surface. In the emulsion according to the present invention, the location at which chemical sensitizing nuclei are situated can be selected in accordance with the purpose, and generally preferably at least one type of chemical sensitizing nucleus is formed near the surface.

Chemical sensitizations that can be carried out preferably in the present invention are chalcogen sensitization and noble metal sensitization, which may be used singly or in combination; and the chemical sensitization can be carried out by using active gelatin as described by T. H. James in "The Theory of the Photographic Process," 4th edition, Macmillan, 1997, pages 67 to 76, or by using sulfur, selenium, tellurium, gold, platinum, palladium, or iridium, or a combination of these sensitizing agents, at a pAg of 5 to 10, a pH of 5 to 8, and a temperature of 30° to 80° C., as described in Research Disclosure, Item 12008 (April 1974); Research Disclosure, Item 13452 (June 1975); Research Disclosure, Item 307105 (November 1989); U.S. Pat. Nos. 2,642,361, 3,297,446, 3,772,031, 3,857,711, 3,901,714, 4,266,018, and 3,904,415, and British Patent No. 1,315,755.

In the photographic emulsion used in the present invention, various compounds can be incorporated for the purpose of preventing fogging during the process of the production of the light-sensitive material, during the storage of the light-sensitive material, or during the photographic processing, or for the purpose of stabilizing the photographic performance. That is, compounds known as antifoggants or stabilizers can be added, such as thiazoles including benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole) and the like; mercaptopyrimidines; mercaptotriazines; thioketo compounds, such as oxazolinthione; and azaindenes, such as triazaindenes; tetraazaindenes (particularly 4-hydroxy-6-methyl-1,3,3a,7-tetraazaindenes), and pentaazaindenes. For examples, those described in U.S. Pat. Nos. 3,954,474 and 3,982,947, and JP-B No. 28660/1987, can be used. A preferable compound is a compound described in Japanese Patent Application No. 47225/1987. In accordance with the purpose, the antifoggant and the stabilizer can be added at various times, for example, before the formation of the grains, during the formation of the grains, after the formation of the grains, in the step of washing with water, at the time of dispersion after the washing with water, before the chemical sensitization, during the chemical sensitization, after the chemical sensitization, and before the application. In addition to the case wherein the antifoggant and the stabilizer are added during the preparation of the emulsion, so that the antifogging effect and the stabilizing effect, which are their essential effects, may be achieved, they can be used for various other purposes, for example, for controlling the habit of the crystals, for making the grain size small, for reducing the solubility of the grains, for controlling the chemical sensitization, and for controlling the arrangement of the dyes.

In order to exhibit the effect of the present invention, the photographic emulsion used in the present invention is preferably spectrally-sensitized by methin dyes or other dyes. Dyes that can be used include a cyanine dye, a merocyanine dye, a composite cyanin dye, a composite merocyanine dye, a halopolar cyanine dye, a hemicyanine dye, a styryl dye, and a hemioxonol dye. Particularly useful dyes are those belonging to a cyanine dye, a merocyanine dye, and a composite merocyanine dye. In these dyes, any of nuclei generally used in cyanine dyes as base heterocyclic ring nuclei can be applied. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; and a nucleus formed by fusing an cycloaliphatic hydrocarbon ring or an aromatic hydrocarbon ring to these nuclei, such as an indolenine nucleus, a benzindolenine nucleus, an indole nucleus, a benzoxazole nucleus, a naphthooxazole nucleus, a benzothiazole nucleus, a naphthothiazole nucleus, a benzoselenazole nucleus, a benzimidazole nucleus, and a quinoline nucleus can be applied. These nuclei may be substituted on the carbon atom.

In the merocyanine dye or the composite merocyanine dye, as a nucleus having a ketomethylene structure, a 5- to 6-membered heterocyclic ring nucleus, such as a pyrazolin-5-one nucleus, a thiohydantoine nucleus, a 2-thiooxazolidin-2,4-dione nucleus, a thiazolidin-2,4-dione nucleus, a rhodanine nucleus, and a thiobarbituric acid nucleus, can be applied.

Further, as the red-sensitive spectrally sensitizing dye of silver halide emulsion grains high in silver halide content, red-sensitive spectrally sensitizing dyes described in JP-A No. 123340/1991 are quite preferable, in view of the stability, the powerfulness of the absorption, the dependency of exposure on temperature, etc.

In the light-sensitive material of the present invention, if the infrared region is to be spectrally sensitized efficiently, sensitizing dyes described in JP-A No. 15049/1991 (the left upper column, page 12, to the left lower column, page 21), JP-A No. 20730/1991 (the left lower column, page 4, to the left lower column, page 15), EP-0,420,011 (page 4, line 21, to page 6, line 54), EP-0,420,012 (page 4, line 12, to page 10, line 33), EP-0,443,466, and U.S. Pat. No. 4,975,362 are preferably used.

The time at which the sensitizing dye is added to the emulsion may be at any stage for preparing the emulsion that is known to be useful. Most generally, although the addition of the sensitizing dye is carried out at a time after the completion of chemical sensitization and before the coating, the sensitizing dye may be added together with a chemical sensitizer simultaneously, to carry out the spectral sensitization and the chemical sensitization at the same time, as described in U.S. Pat. Nos. 3,628,969 and 4,225,666; or the sensitizing dye may be added before the chemical sensitization, as described in JP-A No. 113,928/1983; or the sensitizing dye may be added before the completion of the formation of the silver halide grain precipitation, to start the spectral sensitization. Further, as taught in U.S. Pat. No. 4,225,666, the above compounds may be added in portions; that is, it is possible that part of these compounds is added before the chemical sensitization, with the remaining part added after the chemical sensitization; thus they may be added at any time during the formation of silver halide grains, for example, as shown in a method disclosed in U.S. Pat. No. 4,183,756.

In the present invention, in combination with the water-soluble dye, a colored layer that can be decolored by processing is used. The colored layer to be used that can be decolored by processing may be directly adjacent to the emulsion layer, or it may be arranged to be adjacent to the emulsion layer through an intermediate layer containing a processing color-mixing inhibitor, such as gelatin and hydroquinone. Preferably the colored layer is arranged below ion the side of the support) an emulsion layer that will form the same primary color as the color of the colored layer. All or some of colored layers corresponding to respective primary colors may be arranged. Also, colored layer corresponding to primary color regions may be arranged. The optical reflection density of the colored layer is preferably such that the optical density value at the wavelength having the highest optical density in the wavelength region used for exposure (the visible light region of from 400 nm to 700 nm, in the case of usual printer exposure, and the wavelength of the scanning exposure light source to be used, in the case of scanning exposure) is 0.2 or more to 3.0 or less, more preferably 0.5 or more to 2.5 or less, and particularly preferably 0.8 or more to 2.0 or less.

To form the colored layer, conventionally known methods can be applied in combination. For example, use can be made of a method wherein dyes described in JP-A No. 282244/1990 (page 3, the right upper column, to page 8), or dyes described in JP-A No. 7931/1991 (page 3, the right upper column, to page 11, the left lower column), are made into a solid fine particle dispersion state and are contained in a hydrophilic colloid layer; a method wherein a cationic polymer is mordanted with an anionic dye; a method wherein a dye is adsorbed to fine particles, for example, of a silver halide, and is fixed in a layer; and a method, as described in JP-A No. 239544/1989, wherein colloidal silver is used. One method wherein a fine powder of a dye is dispersed in the solid state is described in JP-A No. 308244/1990 (pages 4 to 13); in the method, for example, a fine powder dye, which is substantially insoluble in water, at least at a pH of 6 or below, but which is substantially soluble in water, at least at a pH of 8 or over, is contained. Further, a method wherein a cation polymer is mordanted with an anionic dye is described in JP-A No. 84637/1990 (pages 18 to 26). Methods of the preparation of colloidal silver as a light absorber are described in U.S. Pat. Nos. 2,688,601 and 3,459,563. Among these methods, one in which a fine powder dye is contained, and one in which colloidal silver is used, are preferable.

As a binder or a protective colloid that can be used in the light-sensitive material according to the present invention, a gelatin is advantageously used, and other hydrophilic colloids can be used alone or in combination with a gelatin. As the gelatin, a low-calcium gelatin having a calcium content of 800 ppm or less, and more preferably 200 ppm or less, is preferably used. Further, in order to prevent the proliferation of various molds and fungi that will proliferate in a hydrophilic colloid layer, to deteriorate an image, preferably mildew-proofing agents, as described in JP-A No. 271247/1988, are added.

When the light-sensitive material of the present invention is subjected to printer exposure, it is preferable to use a band stop filter described in U.S. Pat. No. 4,880,726, by which light color-mixing is removed, to noticeably improve color reproduction.

Although the above various additives are used in the light-sensitive material in the art, other various additives can also be used, depending on the purpose.

These additives are described in more detail in Research Disclosure Item 17643 (December 1978), Research Disclosure Item 18716 (November 1979), and Research Disclosure Item 307105 (November 1989); and the particular sections are summarized in the Table given below.

TABLE 3

| Type of additive | RD17643 | RD18716 | RD307105 |
|---|---|---|---|
| 1 Chemical sensitizers | page 23 | page 648, right column | page 996 |
| 2 Sensitivity increasers | | page 648, right column | |
| 3 Spectral sensitizers, Super sensitizers | pages 23–24 | page 648, right column to page 649, right column | page 996, right column to page 998, right column |
| 4 Whitening agents | page 24 | | page 998, right column |
| 5 Antifoggant, Stabilizer | pges 24–25 | page 649, right column | pge 998, right column |

TABLE 3-continued

| Type of additive | RD17643 | RD18716 | RD307105 |
|---|---|---|---|
| | | to | to page 1000, right column |
| 6 Light absorbing agent, Filter dyes, Ultraviolet absorbers | pages 25–26 | page 649, right column to page 650, left column | page 1003, left column to page 1003, right column |
| 7 Antistaining agents | page 25, right column | page 650, left to right column | |
| 8 Dye image stabilizers | page 25 | | |
| 9 Hardeners | page 26 | page 651, left column | page 1004, right column to page 1005, left column |
| 10 Binders | page 26 | page 651, left column | page 1003, right column to page 1004, right column |
| 11 Plasticizers, and lubricants | page 27 | page 650, right column | page 1006, left column to page 1006, right column |
| 12 Coating aids, Surface-active agents | pages 26–27 | page 650, right column | page 1005, left column to page 1006, left column |
| 13 Antistatic agents | page 27 | page 650, right column | page 1006, right column to page 1007, left column |

In the light-sensitive material of the present invention, preferably the total coating amount of silver is 0.003 to 1 g per $m^2$ in terms of silver, because, for example, a desilvering step can be omitted, to allow further quick processing and to enable the load of waste liquid to be reduced. The coating amount of silver in each layer is preferably 0.001 to 0.4 g per $m^2$ in one photosensitive layer. Particularly when the light-sensitive material of the present invention is subjected to an intensification process, preferably the coating amount of silver is 0.003 to 0.3 g, more preferably 0.01 to 0.1 g, and particularly preferably 0.015 to 0.05 g, per $m^2$. In that case, the coating amount of silver is preferably 0.001 to 0.1 g, and more preferably 0.003 to 0.03 g, per $m^2$ of photosensitive layer.

In the present invention, if the coating amount of silver in each photographic material layer is less than 0.001 g per $m^2$, dissolution of a silver salt proceeds, and therefore satisfactory color density cannot be obtained; while when an intensification process is performed, if the coating amount of silver is over 0.1 g, the Dmin is increased and bubbles are formed, which makes the resulting photography be bad to look at.

The light-sensitive material of the present invention is used in a print system using usual negative printers, and also it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the light-sensitive material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the susal three regions, the blue region, the green region and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III–V group semiconductor laser is present now only in from the red region to the infrared region. However, on the laboratory level, the oscillation of a II–VI group semiconductor laser in the green or blue region is confirmed and it is highly expected that these semiconductor lasers can be used inexpensively and stably if production technique for the semiconductor lasers is developed. In that event, the necessity that each of at least two layers has a spectral sensitivity maximum at 670 nm or over becomes lower.

In such scanning exposure, the time for which the silver halide in the light-sensitive material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure time is defined as the time for which a picture size is exposed with the density of the picture element being 400 dpi, preferably the exposure time is $10^{-4}$ sec or less, more preferably $10^{-6}$ sec or less. The lower limit is not particularly restricted, but it is preferably $10^{-10}$ sec. More preferably, the exposure time is in a range between $10^{-10}$ to $10^{-4}$ sec.

Processing materials and processing methods used in the present invention will now be described. In the present invention, the light-sensitive material is developed (silver development/cross oxidation of the built-in reducing agent), (desilvered), washed with water, and stabilized. In some cases, after the washing with water or the stabilizing processing, a treatment of alkalinization for color formation intensification (alkali treatment) is carried out.

When the light-sensitive material of the present invention is developed, the developing solution contains a compound that serves as a developing agent of silver halides and/or allows the developing agent oxidation product resulting from the silver development to cross-oxidize the reducing agent for color formation built in the light-sensitive material. Preferably, pyrazolidones, dihydroxybenzenes, reductones, and aminophenols are used, and particularly preferably pyrazolidones are used.

Among pyrazolidones, 1-phenyl-3-pyrazolidones are preferable, and they include 1-phenyl-3-pyrazolidone, 1-phenyl-4,4-dimethyl-3-pyrazolidone, 1-phenyl-4-methyl-4-hydroxylmethyl-3-pyrazolidone, 1-phenyl-4,4-dihydroxymethyl-3-pyrazolidone, 1-phenyl-5-methyl-3-pyrazolidone, 1-phenyl-5-phenyl-3-pyrazolidone, 1-p-tolyl-4-methyl-4-hydroxymethyl-3-pyrazolidone, 1-p-chlorophenyl-4-methyl-4-hydroxymethyl-3-pyrazolidone, 1-phenyl-2-hydroxymethyl-4,4-dimethyl-3-pyrazolidone, 1-phenyl-2-acetyl-3-pyrazolidone, and 1-phenyl-2-hydroxymethyl-5-phenyl-3-pyrazolidone.

Dihydroxybenzenes include hydroquinone, chlorohydroquinone, bromohydroquinone, isopropylhydroquinone, methylhydroquinone, 2,3-dichlorohydroquinone, 2,5-dichlorohydroquinone, 2,5-dimethylhydroquinone, and potassium hydroquinonemonosulfonate.

Among reductones, ascorbic acid and derivatives thereof are preferable, and compounds described in JP-A No. 148822/1994 on pages 3 to 10 can be used. Particularly, sodium L-ascorbate and sodium erysorbate are preferable.

P-aminophenols include N-methyl-p-aminophenol, N-(β-hydroxyethyl)-p-aminophenol, N(4-hydroxyphenyl)glycine, 2-methyl-p-aminophenol.

Although these compounds are generally used alone, use of two or more of them in combination is also preferable, to enhance the development and cross oxidation activity.

The amount of these compounds to be used in the developing solution is generally $2.5\times10^{-4}$ to 0.2 mol/liter, preferably 0.0025 to 0.1 mol/liter, and more preferably 0.001 to 0.05 mol/liter.

The developing solution used in the present invention preferably has a pH of 8 to 13, and more preferably 9 to 12.

To retain the above pH, it is preferable to use various buffers. And in the developing solution, an organic preservative, a development accelerator, antisettling agent, fluorescent whitening agent, which were known before, can be added.

The processing temperature of the developing solution to be applied to the present invention is 20° to 50° C., and preferably 30° to 45° C. The processing time is 5 sec to 2 min, and preferably 10 sec to 1 min. With respect to the replenishing rate, although a small amount is preferable, the replenishing rate is 15 to 600 ml, preferably 25 to 200 ml, and more preferably 35 to 100 ml, per $m^2$ of the light-sensitive material.

After the development, a desilvering process is generally carried out. The desilvering process comprises a fixing process, or both bleaching process and a fixing process. When both bleaching and fixing are carried out, the bleaching process and the fixing process may be carried out separately or simultaneously (bleach-fixing process). Also, according to the purpose, the processing may be carried out in a bleach-fixing bath having two successive tanks; or the fixing process may be carried out before the bleach-fixing process; or the bleach-fixing may be carried out after the bleach-fixing process. As these bleaching bath and fixing bath, those known before can be used.

It is preferable to carry out the stabilizing process, to stabilize silver salts and dye images, without carrying out the desilvering process after the development.

After the development, an image-reinforcing process (intensification) that uses peroxides, halorous acids, iodoso compounds, and cobalt(III) complex compounds, described, for example, in West German Patent (OLS) Nos. 1,813,920, 2,044,993, and 2,735,262, and JP-A Nos. 9728/1973, 84240/1974, 102314/1974, 53826/1976, 13336/1977, and 73731/1977, can be carried out. In order to reinforce an image further, the above oxidizing agent for reinforcing an image can be added to the above developing solution, so that the development and the image intensifying can be conducted in one bath simultaneously. Particularly, hydrogen peroxide is preferable, because the amplification rate is high. These image-intensifying methods are a processing method that is preferable in view of environmental conservation, because the amount of silver in the light-sensitive material can be reduced drastically, for example, to make a bleaching process unnecessary and to allow silver (and silver salts) not to be discharged in a stabilizing process or the like.

The processing temperature of the desilvering step is 20° to 50° C., and preferably 30° to 45° C. The processing time is 5 sec to 2 min, and preferably 10 sec to 1 min. Although a small replenishing rate is preferable, the replenishing rate is generally 15 to 600 ml, preferably 25 to 200 ml, and more preferably 35 to 100 ml, per $m^2$ of the light-sensitive material. The processing is also preferably carried out without replenishment in such a way that the evaporated amount is supplemented with water.

The light-sensitive material of the present invention is generally passed through a washing (rinsing) step after the desilvering process. If a stabilizing process is carried out, the washing step can be omitted.

The pH of the washing liquid and the stabilizing solution is 4 to 9, and preferably 5 to 8. The processing temperature is 15° to 45° C., and preferably 25° to 40° C. The processing time is 5 sec to 2 min, and preferably 5 sec to 40 sec.

The overflow liquid associated with the replenishment of the above washing liquid and/or the stabilizing solution, can be reused in other processes, such as the desilvering process.

The amount of the washing liquid and/or the stabilizing solution can be set in a wide range depending on various conditions, and the replenishing rate is preferably 15 to 360 ml, and more preferably 25 to 120 ml, per $m^2$ of the light-sensitive material.

The processing time in each process according to the present invention means the time required from the start of the processing of the light-sensitive material at any process, to the start of the processing in the next process. The actual processing time in an automatic developing machine is determined generally by the linear speed and the volume of the processing bath, and in the present invention, as the linear speed, 500 to 4,000 mm/min can be mentioned as a guide. Particularly in the case of a small-sized developing machine, 500 to 2,500 mm/min is preferable.

The processing time in the whole processing steps, that is, the processing time from the developing process to the drying process, is preferably 360 sec or below, more preferably 120 sec or below, and particularly preferably 90 to 30 sec. Herein the processing time means the time from the dipping of the light-sensitive material into the developing solution, till the emergence from the drying part of the processor.

The silver halide color photographic light-sensitive material of the present invention makes possible a development process with low replenishment and low discharge of a color developer, and it exhibits an excellent effect that the color-forming properties are good even when the coating film's pH is low. Further, even when the light-sensitive material of the present invention is stored for a long period of time in an unused state, stain does not occur, and stains of the processed film are also reduced.

EXAMPLES

The present invention will now be described specifically with reference to the Examples, but of course the present invention is not limited to them.

Example 1

A surface of a paper base, both surfaces of which had been laminated with a polyethylene, was subjected to corona discharge treatment; then it was provided with a gelatin undercoat layer containing sodium dodecylbenzensulfonate, and it was coated with two photographic constitutional layers, to produce a photographic printing paper (100) having the two-layer constitution shown below. The coating liquids were prepared as follows.

First-Layer Coating Liquid 17 g of a coupler (C-21), 20 g of a reducing agent for color formation (36), and 80 g of a solvent (Solv-1) were dissolved in ethyl acetate, and the resulting solution was emulsified and dispersed into 270 g of a 16% gelatin aqueous solution containing 16 ml of 10% sodium dodecylbenzensulfonate and 0.4 g of citric acid, to prepare an emulsified dispersion A.

On the other hand, a silver chlorobromide emulsion A (cubes, a mixture of a large-size emulsion A having an average grain size of 0.88 μm, and a small-size emulsion A having an average grain size of 0.70 μm (3:7 in terms of mol of silver), the deviation coefficients of the grain size distributions being 0.08 and 0.10 respectively, and each emulsion having 0.3 mol % of silver bromide locally contained in part of the grain surface whose substrate was made up of silver chloride) was prepared. To the large-size emulsion A of this emulsion, had been added $1.4\times10^{-4}$ mol, per mol of silver, of each of blue-sensitive sensitizing dyes A, B, and C shown below, and to the small-size emulsion A of this emulsion, had been added $1.7\times10^{-4}$ mol, per mol of silver, of each of blue-sensitive sensitizing dyes A, B, and C shown below. The chemical ripening of this emulsion was carried out optimally with a sulfur sensitizer and a gold sensitizer being added. The above emulsified dispersion A and this silver chlorobromide emulsion A were mixed and dissolved, and a first-layer coating liquid was prepared so that it would have the composition shown below. The coating amount of the emulsion is in terms of silver.

As the gelatin hardener for each layer, 1-oxy-3,5-dichloro-s-triazine sodium salt was used.

Further, to each layer, were added Cpd-2, Cpd-3, Cpd-4, and Cpd-5, so that the total amounts would be 15.0 mg/$m^2$, 60.0 mg/$m^2$, 50.0 mg/$m^2$, and 10.0 mg/$m^2$, respectively.

For the silver chlorobromide emulsion of the first layer, the following spectral sensitizing dye was used.

Sensitizing dye A

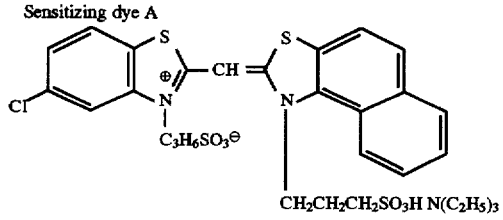

-continued

Sensitizing dye B

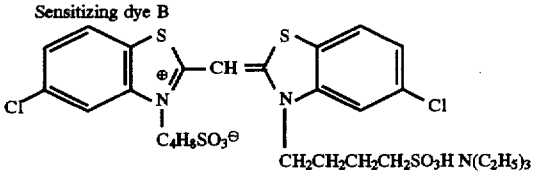

Sensitizing dye C

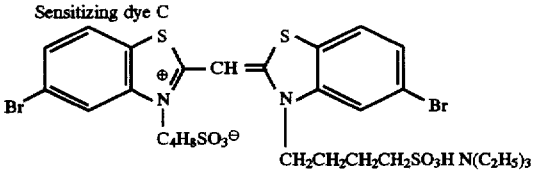

Further, 1-(5-methylureidophenyl)-5-mercaptoterazol was added in amount of $3.0\times10^{-3}$ mol per mol of the silver halide.

Layer Constitution

The composition of each layer is shown below. The numbers show coating amounts (g/m$^2$). In the case of the silver halide emulsion, the coating amount is in terms of silver.

Base

Polyethylene-Laminated Paper

[The polyethylene on the first layer side contained a white pigment ($TiO_2$ 14% by weight ratio) and a blue dye (ultramarine)]

| First Layer | |
|---|---|
| The above silver chlorobromide emulsion A | 0.20 |
| Gelatin | 1.50 |
| Yellow coupler (C-21) | 0.17 |
| Reducing agent for color formation (36) | 0.20 |
| Solvent (Solv-1) | 0.80 |

-continued

| Second Layer (protective layer) | |
|---|---|
| Gelatin | 1.01 |
| Acryl-modified copolymer of polyvinyl alcohol (modification degree: 17%) | 0.04 |
| Liquid paraffin | 0.02 |
| Surface-active agent (Cpd-1) | 0.01 |

The procedure for preparing Sample (100) was repeated, except that, the yellow coupler and the reducing agent for color formation in the coating liquid of the first layer were changed to the yellow couplers and the reducing agents for color formation, in the same molar amounts, shown in Tables 4 to 6, and the high-boiling-point organic solvent was changed to the high-boiling-point organic solvents, in the same weight amounts, shown in Tables 4 to 6, thereby preparing Samples (101) to (147).

Further, the procedure for preparing Sample (100) was repeated, except that, in the coating liquid of the first layer, the silver chlorobromide emulsion A was changed to the following silver chlorobromide emulsion B, in the same amount of silver, and the coupler and the reducing agent for color formation were changed to the magenta couplers and the reducing agents for color formation, in the same molar amounts, shown in Tables 7 and 8, and the high-boiling-point organic solvent was changed to the high-boiling-point organic solvents, in the same weight amounts, shown in Tables 7 and 8, thereby preparing Samples (200) to (239).

A silver chlorobromide emulsion B: cubes, a mixture of a large-size emulsion B having an average grain size of 0.55 μm, and a small-size emulsion B having an average grain size of 0.39 μm (1:3 in terms of mol of silver). The deviation coefficients of the grain size distributions were 0.10 and 0.08, respectively, and each emulsion had 0.8 mol % of AgBr locally contained in part of the grain surface whose substrate was made up of silver chloride.

For the silver chlorobromide emulsion B, the following spectrally sensitizing dyes were used:

Sensitizing dye D

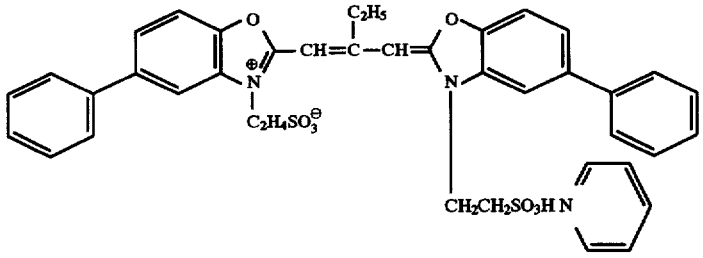

Sensitizing dye E

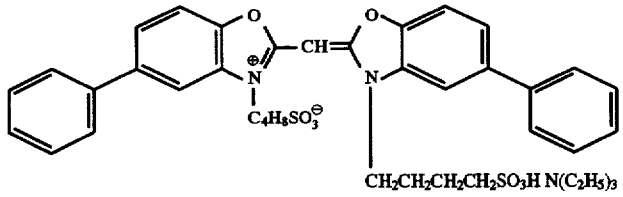

Sensitizing dye F

-continued

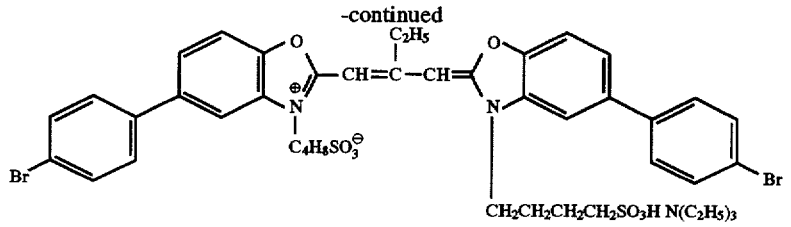

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.)

Further, the procedure for preparing Sample (100) was repeated, except that, in the coating liquid of the first layer, the silver chlorobromide emulsion A was changed to the following silver chlorobromide emulsion C, in the same amount of silver, the coupler and the reducing agent for color formation were changed to the cyan couplers and the reducing agents for color formation, in the same molar amounts, shown in Tables 9 and 10, and the high-boiling-point organic solvent was changed to the high-boiling-point organic solvents, in the same weight amounts, shown in Tables 9 and 10, thereby preparing Samples (300) to (339).

A silver chlorobromide emulsion C: cubes, a mixture of a large-size emulsion C having an average grain size of 0.5 μm, and a small-size emulsion having an average grain size of 0.41 μm (1:4 in terms of mol of silver). The deviation coefficients of the grain size distributions were 0.09 and 0.11, respectively, and each emulsion had 0.8 mol % of AgBr locally contained in part of the grain surface whose substrate was made up of silver chloride.

For the silver chlorobromide C, the following spectrally sensitizing dyes were used:

Sensitizing dye G

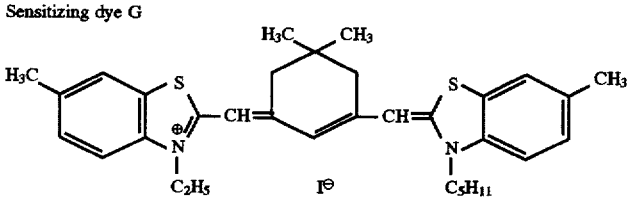

Sensitizing dye H

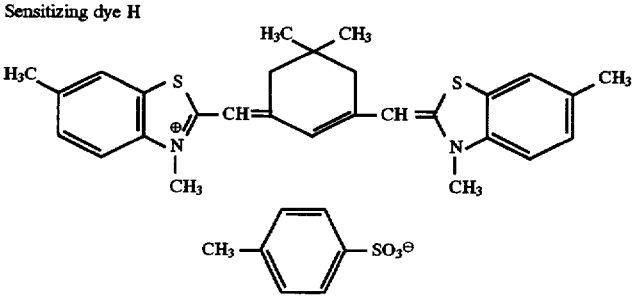

(Each was added to the large-size emulsion in an amount of $5.0\times10^{-5}$ mol per mol of the silver halide, and to the small-size emulsion in an amount of $8.0\times10^{-5}$ per mol of the silver halide.)

(Cpd-1) Surface-active agent
7:3 mixture (by weight ratio) of

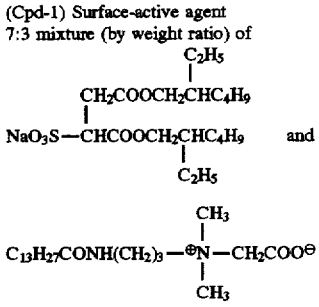

and (Cpd-2) Antiseptic

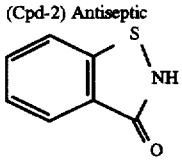

(Cpd-3) Antiseptic

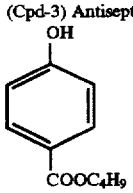

(Cpd-4) Antiseptic
1:1:1:1 mixture of a, b, c, d

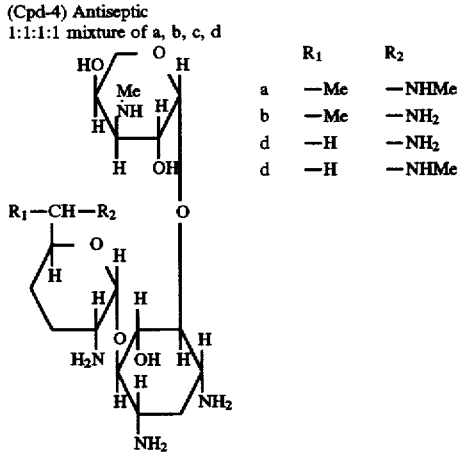

| | $R_1$ | $R_2$ |
|---|---|---|
| a | —Me | —NHMe |
| b | —Me | —$NH_2$ |
| d | —H | —$NH_2$ |
| d | —H | —NHMe |

(Cpd-5) Antiseptic

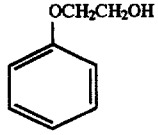

(Solv-1) Solvent

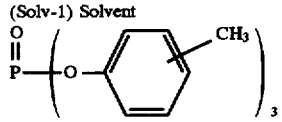

Using an FWH-type sensitometer (color temperature of the light source: 3,200° K), manufactured by Fuji Photo Film Co., Ltd., gradation exposure was given to the thus prepared Samples (100) to (147) through a blue filter for sensitometry, to the thus prepared Samples (200) to (239) through a green filter for sensitometry, and to the thus prepared Samples (300) to (339) through a red filter for sensitometry.

The thus exposed Samples were processed with the following processing solutions in the following processing steps and color formation properties, especially those properties at low pH, were evaluated when pH was changed in the alkali processing.

| Processing step | Temperature | Time |
|---|---|---|
| Development | 40° C. | 15 sec |
| Bleach-fix | 40° C. | 45 sec |
| Rinse | room temperature | 45 sec |
| Alkali processing | room temperature | 30 sec |

| Developing Solution | |
|---|---|
| Water | 600 ml |
| Potassium phosphate | 40 g |
| Disodium N,N-bis(sulfonatoethyl)hydroxylamine | 10 g |
| KCl | 5 g |
| Hydroxylethylidene-1,1-diphosphonic acid (30%) | 4 ml |
| 1-phenyl-4-methyl-4-hydroxymethyl-3-pyrazolidone | 1 g |
| Water to make | 1,000 ml |
| pH (at 25° C. by using potassium hydroxide) | 12 |

| Bleach-fix Solution | |
|---|---|
| Water | 600 ml |
| Ammonium thiosulfate (700 g/liter) | 93 ml |
| Ammonium sulfite | 40 ml |
| Ethylenediaminetetraacetic acid iron (III) ammonium salt | 55 g |
| Ethylenediaminetetraacetic acid | 2 g |
| Nitric acid (67%) | 30 g |
| Water to make | 1,000 ml |
| pH (at 25° C. by using acetic acid and ammonia water) | |

| Rinsing Solution | |
|---|---|
| Sodium chlorinated isocyanurate | 0.02 g |
| Deionized water (conductivity: 5 μS/cm or below) | 1,000 ml |
| pH | 6.5 |

| Alkali Processing Solution | |
|---|---|
| Water | 800 ml |
| Potassium carbonate | 30 g |
| Water to make | 1,000 ml |
| pH | shown in Tables 4 to 10 |

The maximum color density part of the processed Samples (100) to (147) was measured using blue light; the maximum color density part of the processed Samples (200) to (239) was measured using green light; and the maximum color density part of the processed Samples (300) to (339) was measured using red light. The results are shown in Tables 4 to 6, 7 and 8, and 9 and 10, respectively.

TABLE 4

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| 100 | 36 | C-21 | Solv-1 | 0.76 | 0.70 | 0.65 | Comparative Example |
| 101 | " | " | S-8 | 0.92 | 0.90 | 0.89 | This invention |
| 102 | " | " | S-9 | 0.87 | 0.86 | 0.85 | This invention |
| 103 | " | " | S-29 | 0.89 | 0.88 | 0.86 | This |

TABLE 4-continued

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| | | | | | | | invention |
| 104 | " | " | S-41 | 0.89 | 0.87 | 0.86 | This invention |
| 105 | " | " | S-45 | 0.86 | 0.85 | 0.84 | This invention |
| 106 | " | " | S-2 | 0.90 | 0.88 | 0.86 | This invention |
| 107 | " | " | S-46 | 0.96 | 0.96 | 0.92 | This invention |
| 108 | " | " | S-47 | 0.94 | 0.94 | 0.94 | This invention |
| 109 | " | " | S-52 | 0.98 | 0.98 | 0.98 | This invention |
| 110 | 1 | " | Solv-1 | 0.78 | 0.74 | 0.68 | Comparative Example |
| 111 | " | " | S-8 | 0.94 | 0.93 | 0.92 | This invention |
| 112 | " | " | S-9 | 0.92 | 0.91 | 0.90 | This invention |
| 113 | " | " | S-29 | 0.91 | 0.90 | 0.89 | This invention |
| 114 | " | " | S-41 | 0.91 | 0.90 | 0.88 | This invention |
| 115 | " | " | S-45 | 0.89 | 0.87 | 0.86 | This invention |
| 116 | " | " | S-2 | 0.93 | 0.92 | 0.90 | This invention |
| 117 | " | " | S-41 | 0.99 | 0.99 | 0.99 | This invention |
| 118 | " | " | S-47 | 0.96 | 0.96 | 0.96 | This invention |
| 119 | " | " | S-52 | 1.02 | 1.02 | 1.02 | This invention |

TABLE 5

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| 120 | 36 | C-16 | Solv-1 | 0.72 | 0.64 | 0.58 | Comparative Example |
| 121 | " | " | S-8 | 0.88 | 0.87 | 0.86 | This invention |
| 122 | " | " | S-29 | 0.86 | 0.85 | 0.84 | This invention |
| 123 | " | " | S-46 | 0.92 | 0.92 | 0.92 | This invention |
| 124 | " | " | S-52 | 0.94 | 0.94 | 0.94 | This invention |
| 125 | 57 | C-21 | Solv-1 | 0.36 | 0.30 | 0.24 | Comparative Example |
| 126 | " | " | S-8 | 0.42 | 0.40 | 0.39 | This invention |
| 127 | 46 | " | Solv-1 | 0.62 | 0.54 | 0.42 | Comparative Example |
| 128 | " | " | S-8 | 0.72 | 0.70 | 0.68 | This invention |
| 129 | 38 | " | Solv-1 | 0.72 | 0.64 | 0.52 | Comparative Example |
| 130 | " | " | S-8 | 0.83 | 0.82 | 0.80 | This invention |

TABLE 5-continued

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| 131 | 52 | " | Solv-1 | 0.32 | 0.26 | 0.20 | Comparative Example |
| 132 | " | " | S-8 | 0.42 | 0.40 | 0.39 | This invention |
| 133 | 14 | " | Solv-1 | 0.39 | 0.31 | 0.25 | Comparative Example |
| 134 | " | " | S-8 | 0.49 | 0.47 | 0.46 | This invention |
| 135 | 13 | " | Solv-1 | 0.56 | 0.48 | 0.42 | Comparative Example |
| 136 | " | " | S-8 | 0.66 | 0.64 | 0.63 | This invention |
| 137 | 3 | " | Solv-1 | 0.66 | 0.58 | 0.52 | Comparative Example |
| 138 | " | " | S-8 | 0.75 | 0.74 | 0.73 | This invention |
| 139 | 2 | " | Solv-1 | 0.68 | 0.59 | 0.55 | Comparative Example |

TABLE 6

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| 140 | 2 | C-21 | S-8 | 0.82 | 0.80 | 0.79 | This invention |
| 141 | 24 | " | Solv-1 | 0.33 | 0.25 | 0.20 | Comparative Example |
| 142 | " | " | S-8 | 0.42 | 0.40 | 0.39 | This invention |
| 143 | 1 | C-16 | Solve-1 | 0.74 | 0.68 | 0.62 | Comparative Example |
| 144 | " | " | S-8 | 0.82 | 0.80 | 0.79 | This invention |
| 145 | " | " | S-29 | 0.80 | 0.79 | 0.76 | This invention |
| 146 | " | " | S-46 | 0.84 | 0.84 | 0.84 | This invention |
| 147 | " | " | S-52 | 0.85 | 0.85 | 0.85 | This invention |

TABLE 7

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| 200 | 36 | C-40 | Solv-1 | 0.56 | 0.42 | 0.36 | Comparative Example |
| 201 | " | " | S-8 | 1.37 | 1.35 | 1.34 | This invention |
| 202 | " | " | S-9 | 1.34 | 1.32 | 1.30 | This invention |
| 203 | " | " | S-2 | 1.35 | 1.34 | 1.33 | This |

TABLE 7-continued

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| | | | | | | | invention |
| 204 | " | " | S-41 | 1.33 | 1.32 | 1.31 | This invention |
| 205 | " | " | S-45 | 1.31 | 1.29 | 1.27 | This invention |
| 206 | " | " | S-2 | 1.36 | 1.34 | 1.33 | This invention |
| 207 | " | " | S-46 | 1.39 | 1.39 | 1.39 | This invention |
| 208 | " | " | S-47 | 1.38 | 1.38 | 1.38 | This invention |
| 209 | " | " | S-52 | 1.42 | 1.42 | 1.42 | This invention |
| 210 | 1 | C-28 | Solv-1 | 2.34 | 2.20 | 2.04 | Comparative Example |
| 211 | " | " | S-8 | 2.54 | 2.50 | 2.48 | This invention |
| 212 | " | " | S-9 | 2.42 | 2.40 | 2.37 | This invention |
| 213 | " | " | S-29 | 2.48 | 2.46 | 2.43 | This invention |
| 214 | " | " | S-41 | 2.46 | 2.44 | 2.42 | This invention |
| 215 | " | " | S-45 | 2.44 | 2.42 | 2.40 | This invention |
| 216 | " | " | S-2 | 2.58 | 2.54 | 2.52 | This invention |
| 217 | " | " | S-46 | 2.60 | 2.60 | 2.60 | This invention |
| 218 | " | " | S-47 | 2.58 | 2.58 | 2.58 | This invention |
| 219 | " | " | S-52 | 2.64 | 2.64 | 2.64 | This invention |

TABLE 8

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| 220 | 57 | C-40 | Solv-1 | 0.32 | 0.27 | 0.24 | Comparative Example |
| 221 | " | " | S-8 | 0.49 | 0.48 | 0.46 | This Invention |
| 222 | 44 | " | Solv-1 | 0.52 | 0.40 | 0.32 | Comparative Example |
| 223 | " | " | S-8 | 1.03 | 1.02 | 1.00 | This Invention |
| 224 | 46 | " | Solv-1 | 0.54 | 0.43 | 0.35 | Comparative Invention |
| 225 | " | " | S-8 | 1.04 | 1.02 | 1.00 | This Invention |
| 226 | 38 | " | Solv-1 | 0.55 | 0.43 | 0.35 | Comparative Example |
| 227 | " | " | S-8 | 1.30 | 1.28 | 1.26 | This Invention |
| 228 | 52 | " | Solv-1 | 0.36 | 0.29 | 0.22 | Comparative Example |
| 229 | " | " | S-8 | 0.43 | 0.42 | 0.40 | This Invention |
| 230 | 14 | C-28 | Solv-1 | 1.05 | 0.89 | 0.72 | Comparative Example |

TABLE 8-continued

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| 231 | " | " | S-8 | 1.29 | 1.27 | 1.25 | This Invention |
| 232 | 13 | " | Solv-1 | 1.56 | 1.42 | 1.30 | Comparative Example |
| 233 | " | " | S-8 | 1.72 | 1.70 | 1.68 | This Invention |
| 234 | 3 | " | Solv-1 | 1.85 | 1.72 | 1.66 | Comparative Example |
| 235 | " | " | S-8 | 1.99 | 1.97 | 1.96 | This Invention |
| 236 | 2 | " | Solv-1 | 2.17 | 2.02 | 1.92 | Comparative Example |
| 237 | " | " | S-8 | 2.38 | 2.36 | 2.34 | This Invention |
| 238 | 24 | " | Solv-1 | 0.33 | 0.28 | 0.23 | Comparative Example |
| 239 | " | " | S-8 | 0.52 | 0.50 | 0.48 | This Invention |

TABLE 9

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| 300 | 36 | C-43 | Solv-1 | 1.46 | 1.20 | 0.96 | Comparative Example |
| 301 | " | " | S-8 | 1.56 | 1.52 | 1.46 | This Invention |
| 302 | " | " | S-9 | 1.52 | 1.46 | 1.42 | This Invention |
| 303 | " | " | S-29 | 1.53 | 1.47 | 1.43 | This Invention |
| 304 | " | " | S-41 | 1.50 | 1.46 | 1.40 | This Invention |
| 305 | " | " | S-45 | 1.52 | 1.48 | 1.44 | This Invention |
| 306 | " | " | S-2 | 1.55 | 1.50 | 1.46 | This Invention |
| 307 | " | " | S-46 | 1.59 | 1.59 | 1.59 | This Invention |
| 308 | " | " | S-47 | 1.57 | 1.57 | 1.57 | This Invention |
| 309 | " | " | S-52 | 1.62 | 1.62 | 1.62 | This Invention |
| 310 | 1 | C-41 | Solv-1 | 1.49 | 1.25 | 1.08 | Comparative Example |
| 311 | " | " | S-8 | 1.59 | 1.56 | 1.52 | This Invention |
| 312 | " | " | S-9 | 1.56 | 1.53 | 1.50 | This Invention |
| 313 | " | " | S-29 | 1.54 | 1.52 | 1.48 | This Invention |
| 314 | " | " | S-41 | 1.52 | 1.48 | 1.44 | This Invention |
| 315 | " | " | S-45 | 1.53 | 1.50 | 1.47 | This Invention |
| 316 | " | " | S-2 | 1.58 | 1.54 | 1.50 | This Invention |
| 317 | " | " | S-46 | 1.62 | 1.62 | 1.62 | This Invention |

TABLE 9-continued

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| 318 | " | " | S-47 | 1.63 | 1.63 | 1.63 | This Invention |
| 319 | " | " | S-52 | 1.66 | 1.66 | 1.66 | This Invention |

TABLE 10

| Sample No. | Reducing agent for color formation | Coupler | High-boiling-point organic solvent | Maximum color density (Dmax) pH 10 | pH 9 | pH 8 | Remarks |
|---|---|---|---|---|---|---|---|
| 320 | 57 | C-43 | Solv-1 | 0.49 | 0.35 | 0.21 | Comparative Example |
| 321 | " | " | S-8 | 0.54 | 0.50 | 0.48 | This invention |
| 322 | 44 | " | Solv-1 | 0.99 | 0.84 | 0.72 | Comparative Example |
| 323 | " | " | S-8 | 1.08 | 1.04 | 0.99 | This invention |
| 324 | 46 | " | Solv-1 | 1.01 | 0.89 | 0.78 | Comparative Example |
| 325 | " | " | S-8 | 1.12 | 1.08 | 1.04 | This invention |
| 326 | 38 | " | Solv-1 | 1.45 | 1.38 | 1.24 | Comparative Example |
| 327 | " | " | S-8 | 1.58 | 1.54 | 1.51 | This invention |
| 328 | 52 | " | Solv-1 | 0.39 | 0.30 | 0.20 | Comparative Example |
| 329 | " | " | S-8 | 0.44 | 0.40 | 0.38 | This invention |
| 330 | 14 | C-41 | Solv-1 | 0.52 | 0.44 | 0.32 | Comparative Example |
| 331 | " | " | S-8 | 0.62 | 0.59 | 0.56 | This invention |
| 332 | 13 | " | Solv-1 | 0.70 | 0.62 | 0.54 | Comparative Example |
| 333 | " | " | S-8 | 0.87 | 0.83 | 0.80 | This invention |
| 334 | 3 | " | Solv-1 | 1.44 | 1.30 | 1.22 | Comparative Example |
| 335 | " | " | S-8 | 1.55 | 1.52 | 1.49 | This invention |
| 336 | 2 | " | Solv-1 | 1.47 | 1.33 | 1.25 | Comparative Example |
| 337 | " | " | S-8 | 1.56 | 1.53 | 1.50 | This invention |
| 338 | 24 | " | Solv-1 | 0.38 | 0.29 | 0.25 | Comparative Example |
| 339 | " | " | S-8 | 0.44 | 0.42 | 0.39 | This invention |

As is apparent from the results shown in Tables 4 to 10, it can be understood that, in comparison with the Samples wherein a comparative high-boiling-point organic solvent is used, in the case of the Samples wherein the high-boiling-point organic solvent according to the present invention is used, when they are immersed in an alkali with a pH of 10, the color-forming properties are excellent. Further, it can be understood that, in comparison with the case when Samples are immersed in an alkali with a pH of 10, in the case of the Samples wherein a comparative high-boiling-point organic solvent is used, when the Samples are immersed in an alkali with a low pH, such as a pH of 9 or 8, the color density is lowered considerably; whereas in the case of Samples wherein the high-boiling-point organic solvent according to the present invention is used, the degree of such lowering of the density is small.

Further, it can be understood that, for any of cyan, magenta, and yellow couplers, in comparison with the Samples wherein 24 and 54, for example, out of the reducing agents for color formation represented by formula (I), are used, the Samples wherein Reducing Agent for Color Formation (57), represented by formula (IV), and Reducing Agent for Color Formation (14), represented by formula (V), are used are high in color-forming properties; and the Samples wherein Reducing Agent for Color Formation (13), represented by formula (VI), and Reducing Agent for Color Formation (46), represented by formula (VII), are used are further high in color-forming properties. It can be understood that, in comparison with the Samples wherein (13) and (46) are used, the Samples wherein Reducing Agents for Color Formation (36) and (38), represented by formula (VIII), and Reducing Agents for Color Formation (1) and (3), represented by formula (IX), are used are particularly high in color-forming properties.

Example 2

Polyethylene laminate paper base which surface was subjected to surface treatment and provided with undercoat layer same as in Example 1 was coated with various photographic constitutional layers, to produce a multi-layer photographic color printing paper (400) having the layer constitution shown below.

First layer coating liquid used in Example 1 was used.

In the similar way as the method of preparing of the first-layer coating liquid, coating liquids for the second layer to the seventh layer were prepared. As the gelatin hardeners for each layers, 1-oxy-3,5-dichloro-s-triazine sodium salt was used.

Further, to each layer, were added the antiseptic agents that are the same as used in Example 1, Cpd-2, Cpd-3, Cpd-4, and Cpd-5, so that the total amounts would be 15.0 mg/m$^2$, 60.00 mg/m$^2$, 50.0 mg/m$^2$, and 10.0 mg/m$^2$, respectively.

For the silver chlorobromide emulsion of each photosensitive emulsion layer, the spectral sensitizing dyes used in Example 1 were used in the same amount used in Example 1.

The following compound was further added to the fifth layer (red sensitive layer) in an amount of $2.6\times10^{-2}$ mol per mol of the silver halide.

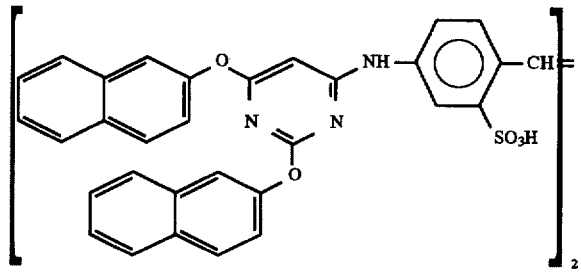

To the blue-sensitive emulsion layer, the green-sensitive emulsion layer, and the red-sensitive emulsion layer, was added 1-(5-methylureidophenyl)-5-mercaptotetrazole in amounts of $3.5\times10^{-4}$ mol, $3.0\times10^{-3}$ mol, and $2.5\times10^{-4}$ mol, respectively, per mol of the silver halide. Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to prevent irradiation, the following dye was added to the emulsion layers (the coating amount is shown in parentheses).

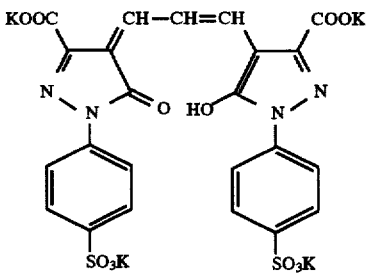

(10 mg/m²)

and

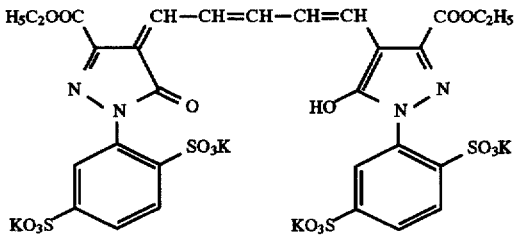

(40 mg/m²)

Layer Constitution

The composition of each layer is shown below. The numbers show coating amounts (g/m²). In the case of the silver halide emulsion, the coating amount is in terms of silver.

Base

Polyethylene-Laminated Paper

[The polyethylene on the first layer side contained a white pigment ($TiO_2$ 15% by weight ratio) and a blue dye (ultramarine)]

| | |
|---|---|
| First Layer (Blue-Sensitive Emulsion Layer) | |
| The above silver chlorobromide emulsion A | 0.40 |
| Gelatin | 3.00 |
| Yellwo coupler (C-21) | 0.34 |
| Reducing agent for color formation (36) | 0.40 |
| Solvent (Solv-1) | 1.60 |
| Second Layer (Color Mixing Inhibiting Layer) | |
| Gelatin | 1.09 |
| Color mixing inhibitor (Cpd-6) | 0.11 |
| Solvent (Solv-1) | 0.19 |
| Solvent (Solv-2) | 0.07 |
| Solvent (Solv-3) | 0.25 |
| Solvent (Solv-4) | 0.09 |
| Third Layer (Green-Sensitive Emulsion Layer) | |
| The above silver chlorobromide emulsion B | 0.12 |
| Gelatin | 0.09 |
| Magenta coupler (C-40) | 0.14 |
| Reducing agent for color formation (36) | 0.12 |
| Solvent (Solv-1) | 0.48 |

-continued

| | |
|---|---|
| Fourth Layer (Color Mixing Inhibition Layer) | |
| Gelatin | 0.77 |
| Color mixing inhibitor (Cpd-6) | 0.08 |
| Solvent (Solv-1) | 0.14 |
| Solvent (Solv-2) | 0.05 |
| Solvent (Solv-3) | 0.14 |
| Solvent (Solv-4) | 0.06 |
| Fifth Layer (Red-Sensitive Emulsion Layer) | |
| The above silver chlorobromide emulsion C | 0.20 |
| Gelatin | 0.15 |
| Cyan coupler (C-43) | 0.20 |
| Reducing agent for color formation (36) | 0.20 |
| Solvent (Solv-1) | 0.18 |
| Sixth Layer (Ultraviolet Absorbing Layer) | |
| Gelatin | 0.64 |
| Ultraviolet absorbing agent (UV-1) | 0.39 |
| Color image stabilizer (Cpd-7) | 0.05 |
| Solvent (Solv-5) | 0.05 |
| Seventh Layer (Protective Layer) | |
| Gelatin | 1.01 |
| Acryl-modified copolymer of polyvinyl alcohol (modification degree: 17%) | 0.04 |
| Liquid paraffin | 0.02 |
| Surface-active agent (Cpd-1) | 0.01 |

(Cpd-6) Color mixing inhibitor (1)

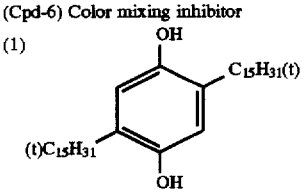

(2)

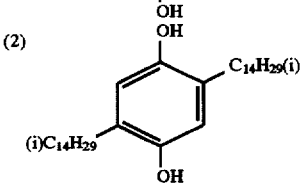

(3)

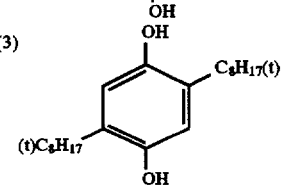

(1):(2):(3) = 1:1:1 mixture (weight ratio)

(Cpd-7) Color image stabilizer

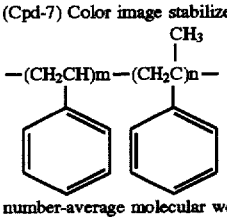

number-average molecular weight 600 m/n = 9/1

(Solv-2) Solvent $C_8H_{17}CH-CH(CH_2)_7COOC_8H_{17}$ (O)

(Solv-3) Solvent

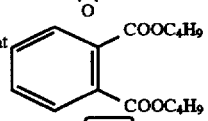

(Solv-4) Solvent HO — $COOC_{16}H_{33}(n)$ (Solv-5) Solvent $C_8H_{17}OCO-(CH_2)_8-COOC_8H_{17}$ (UV-1) Ultraviolet absorbing agent -continued (1)

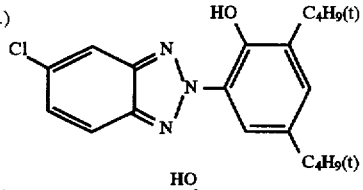

(2)

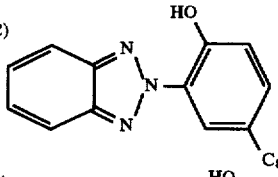

(3)

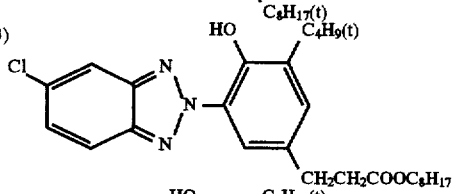

(4)

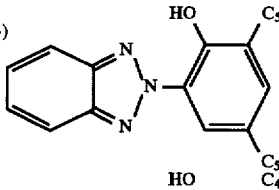

(5)

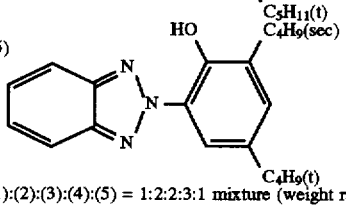

(1):(2):(3):(4):(5) = 1:2:2:3:1 mixture (weight ratio)

The procedure for the preparation of Sample (400) was repeated, except that instead of the coupler and the reducing agent for color formation, the couplers and the reducing agents for color formation shown in Tables 11 and 12 were used, in the same molar amounts, thereby preparing Samples (401) to (413).

By using an FWH-type sensitometer (color temperature of the light source: 3,200° K), manufactured by Fuji Photo Film Co., Ltd., gradation exposure was given to all of the thus prepared Samples through a three color separation filter for sensitometry.

The thus exposed Samples were processed with the following processing solutions in the following processing steps:

| Processing step | Temperature | Time |
|---|---|---|
| Development | 40° C. | 30 sec |
| Bleach-fix | 40° C. | 45 sec |
| Rinse | room temperature | 45 sec |
| Alkali processing | room temperature | 30 sec |

| Developing Solution | |
|---|---|
| Water | 600 ml |
| Potassium phosphate | 40 g |
| Disodium N,N-bis(sulfonatoethyl)hydroxylamine | 10 g |
| KCl | 5 g |
| Hydroxyethylidene-1,1-diphosphonic acid (30%) | 4 ml |
| 1-phenyl-4-methyl-4-hydroxymethyl-3-pyrazolidone | 1 g |
| Water to make | 1,000 ml |
| pH (at 25° C. by using potassium hydroxide) | 12 |
| **Bleach-fix Solution** | |
| Water | 600 ml |
| Ammonium thiosulfate (700 g/liter) | 93 ml |
| Ammonium sulfite | 40 ml |
| Ethylenediaminetetraacetic acid iron (III) ammonium salt | 55 g |
| Ethylenediaminetetraacetic acid | 2 g |
| Nitric acid (67%) | 30 g |
| Water to make | 1,000 ml |
| pH (at 25° C. by using acetic acid and ammonia water) | 5.8 |
| **Rinsing Solution** | |
| Sodium chlorinated isocyanurate | 0.02 g |
| Deionized water (conductivity: 5 μS/cm or below) | 1,000 ml |
| pH | 6.5 |
| **Alkali Processing Solution** | |
| Water | 800 ml |
| Potassium cabonate | 30 g |
| Water to make | 1,000 ml |
| pH | shown in Tables 11 and 12 |

The maximum color density part in each processed Samples was measured using red light, green light, and blue light. The results are shown in tables 11 and 12.

TABLE 11

| Sample No. | Reducing agent for color formation | Yellow Coupler | Magenta Coupler | Cyan Coupler | High-boiling-point organic solvent | Alkali dipping pH | Yellow Dmax | Magenta Dmax | Cyan Dmax | Remarks |
|---|---|---|---|---|---|---|---|---|---|---|
| 400 | 36 | C-21 | C-40 | C-43 | Solv-1 | 10 | 1.48 | 0.58 | 1.40 | Comparative |
| | | | | | | 9 | 1.42 | 0.44 | 1.20 | Example |
| | | | | | | 8 | 1.34 | 0.38 | 0.95 | |
| 401 | 36 | C-21 | C-40 | C-43 | S-8 | 10 | 1.60 | 1.32 | 1.56 | This invention |
| | | | | | | 9 | 1.58 | 1.30 | 1.52 | |
| | | | | | | 8 | 1.56 | 1.28 | 1.48 | |
| 402 | 36 | C-21 | C-40 | C-43 | S-9 | 10 | 1.58 | 1.30 | 1.54 | This invention |
| | | | | | | 9 | 1.56 | 1.27 | 1.50 | |
| | | | | | | 8 | 1.55 | 1.26 | 1.47 | |
| 403 | 36 | C-21 | C-40 | C-43 | S-46 | 10 | 1.62 | 1.34 | 1.60 | This invention |
| | | | | | | 9 | 1.62 | 1.34 | 1.60 | |
| | | | | | | 8 | 1.62 | 1.34 | 1.60 | |
| 404 | 36 | C-21 | C-40 | C-43 | S-52 | 10 | 1.65 | 1.40 | 1.64 | This invention |
| | | | | | | 9 | 1.65 | 1.40 | 1.64 | |

TABLE 11-continued

| Sample No. | Reducing agent for color formation | Yellow Coupler | Magenta Coupler | Cyan Coupler | High-boiling-point organic solvent | Alkali dipping pH | Yellow Dmax | Magenta Dmax | Cyan Dmax | Remarks |
|---|---|---|---|---|---|---|---|---|---|---|
| | | | | | | 8 | 1.65 | 1.40 | 1.64 | |
| 405 | 38 | C-21 | C-40 | C-43 | Solv-1 | 10 | 1.40 | 0.56 | 1.38 | Comparative |
| | | | | | | 9 | 1.30 | 0.42 | 1.18 | Example |
| | | | | | | 8 | 1.21 | 0.34 | 0.92 | |
| 406 | 38 | C-21 | C-40 | C-43 | S-8 | 10 | 1.58 | 1.40 | 1.52 | This invention |
| | | | | | | 9 | 1.56 | 1.38 | 1.48 | |
| | | | | | | 8 | 1.54 | 1.37 | 1.44 | |

15

TABLE 12

| Sample No. | Reducing agent for color formation | Yellow Coupler | Magenta Coupler | Cyan Coupler | High-boiling-point organic solvent | Alkali dipping pH | Yellow Dmax | Magenta Dmax | Cyan Dmax | Remarks |
|---|---|---|---|---|---|---|---|---|---|---|
| 407 | 1 | C-21 | C-28 | C-41 | Solv-1 | 10 | 1.46 | 1.40 | 1.42 | Comparative |
| | | | | | | 9 | 1.30 | 1.32 | 1.21 | Example |
| | | | | | | 8 | 1.22 | 1.18 | 0.98 | |
| 408 | 1 | C-21 | C-28 | C-41 | S-8 | 10 | 1.56 | 1.56 | 1.60 | This invention |
| | | | | | | 9 | 1.54 | 1.54 | 1.56 | |
| | | | | | | 8 | 1.50 | 1.51 | 1.52 | |
| 409 | 1 | C-21 | C-28 | C-41 | S-9 | 10 | 1.54 | 1.54 | 1.58 | This invention |
| | | | | | | 9 | 1.52 | 1.52 | 1.52 | |
| | | | | | | 8 | 1.50 | 1.50 | 1.50 | |
| 410 | 1 | C-21 | C-28 | C-41 | S-46 | 10 | 1.60 | 1.59 | 1.64 | This invention |
| | | | | | | 9 | 1.60 | 1.59 | 1.64 | |
| | | | | | | 8 | 1.60 | 1.59 | 1.64 | |
| 411 | 1 | C-21 | C-28 | C-41 | S-52 | 10 | 1.64 | 1.63 | 1.69 | This invention |
| | | | | | | 9 | 1.64 | 1.63 | 1.69 | |
| | | | | | | 8 | 1.64 | 1.63 | 1.69 | |
| 412 | 3 | C-21 | C-28 | C-41 | Solv-1 | 10 | 1.38 | 1.45 | 1.38 | Comparative |
| | | | | | | 9 | 1.28 | 1.30 | 1.19 | Example |
| | | | | | | 8 | 1.16 | 1.16 | 0.96 | |
| 413 | 3 | C-21 | C-28 | C-41 | S-8 | 10 | 1.56 | 1.54 | 1.58 | This invention |
| | | | | | | 9 | 1.54 | 1.52 | 1.54 | |
| | | | | | | 8 | 1.51 | 1.50 | 1.48 | |

As is apparent from the results shown in Tables 11 and 12, the multi-layer light-sensitive materials gave similar results to those of the single-layer light-sensitive materials shown in Example 1.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic light-sensitive material having at least one photographic constitutional layer on a support, wherein at least one reducing agent for color formation represented by formula (I):

$$R^{11}—NHNH—X—R^{12} \quad \text{formula (I)}$$

wherein $R^{11}$ represents an aryl group or a heterocyclic group; $R^{12}$ represents an alkyl group, an alkenyl group, an alkynyl group, an aryl group, or a heterocyclic group; and X represents $—SO_2—$, —CO—, —COCO—, —CO—O—, $—CON(R^{13})—$, —COCO—O—, $—COCO—N(R^{13})—$ or $—SO_2—N(R^{13})—$, in which $R^{13}$ represents a hydrogen atom or a group represented by $R^{12}$ that is defined above, at least one dye-forming coupler, and at least one high-boiling-point organic solvent whose electron-donative parameter $\Delta v_D$ at 25° C. is within the range of 80 to 180, are contained in said at least one photographic constitutional layer or may be contained in different layers when two or more of said photographic constitutional layer are present.

2. The silver halide color photographic light-sensitive material as claimed in claim 1, wherein $R^{11}$ in formula (I) represents an aryl group having 6 to 14 carbon atoms, or a saturated or unsaturated 5-, 6-, or 7-membered heterocyclic ring containing at least one of nitrogen, oxygen, sulfur and selenium.

3. The silver halide color photographic light-sensitive material as claimed in claim 1, wherein $R^{12}$ in formula (I) represents a straight-chain, branched, or cyclic alkyl group having 1 to 16 carbon atoms, a chain or cyclic alkenyl group having 2 to 16 carbon atoms, an alkynyl group having 2 to 16 carbon atoms, an aryl group having 6 to 14 carbon atoms, or a saturated or unsaturated 5-, 6-, or 7-membered heterocyclic ring containing at least one of nitrogen, oxygen, sulfur and selenium.

4. The silver halide color photographic light-sensitive material as claimed in claim 1, wherein X in formula (I) represents —CON($R^{13}$)— wherein $R^{13}$ has same meaning as defined in claim 1.

5. The silver halide color photographic light-sensitive material as claimed in claim 1, wherein the reducing agent for color formation represented by formula (I) and the dye-forming coupler are dissolved/dispersed, to be contained in the high-boiling-point organic solvent whose electron-donative parameter $\Delta v_D$ at 25° C. is within the range of 80 to 180.

6. The silver halide color photographic light-sensitive material as claimed in claim 1, wherein the compound represented by formula (I) is represented by formula (II) or (III):

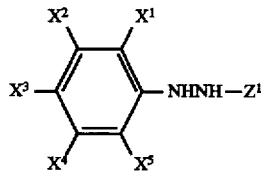

formula (II)

$R^3$—NHNH—$Z^2$ formula (III)

wherein $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$, and $X^5$ each represent a hydrogen atom or a substituent, provided that the combined sum of the Hammett substituent constant σp values of $X^1$, $X^3$, and $X^5$, with the sum of the Hammett substituent constant era values of $X^2$ and $X^4$, is 0.08 or more but 3.80 or below; and $R^3$ represents a heterocyclic group.

7. The silver halide color photographic light-sensitive material as claimed in claim 6, wherein $R^3$ in formula (III) represents a saturated or unsaturated 3- to 12- membered monocyclic or condensed heterocyclic group having 1 to 50 carbon atoms, containing at least one hetero-atom selected from a nitrogen atom, an oxygen atom and a sulfur atom, and having at least one electron-attracting group.

8. The silver halide color photographic light-sensitive material as claimed in claim 6, wherein the compound represented by formula (II) or (III) is represented by formula (IV) or (V), respectively:

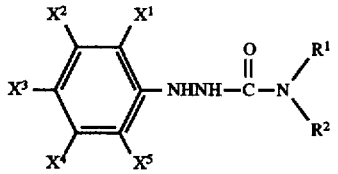

formula (IV)

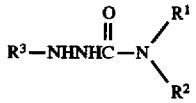

formula (V)

wherein $R^1$, $R^2$, $X^1$, $X^2$, $X^3$, $X^4$ and $X^5$ each represent a hydrogen atom or a substituted or unsubstituted substituent selected from the group consisting of a straight-chain alkyl group, a branched-chain alkyl group, or a cycloalkyl group, having 1 to 50 carbon atoms; a straight-chain alkenyl group, a branched chain alkenyl group, or a cycloalkenyl group, having 2 to 50 carbon atoms; an alkynyl group having 2 to 50 carbon atoms, an aryl group having 6 to 50 carbon atoms, an acyloxy group having 1 to 50 carbon atoms, a carbamoyloxy group having 1 to 50 carbon atoms, a carbonamido group having 1 to 50 carbon atoms, a sulfonamido group having 1 to 50 carbon atoms, a carbamoyl group having 1 to 50 carbon atoms, a sulfamoyl group having 0 to 50 carbon atoms, an alkoxy group having 1 to 50 carbon atoms, an aryloxy group having 6 to 50 carbon atoms, an aryloxycarbonyl group having 7 to 50 carbon atoms, an alkoxycarbonyl group having 2 to 50 carbon atoms, an N-acylsulfamoyl group having 1 to 50 carbon atoms, an alkylsulfonyl group having 1 to 50 carbon atoms, an arylsulfonyl group having 6 to 50 carbon atoms, an alkoxycarbonylamino group having 2 to 50 carbon atoms, an aryloxycarbonylamino group having 7 to 50 carbon atoms, an amino group having 0 to 50 carbon atoms, a cyano group, a nitro group, a carboxyl group, a hydroxy group, a sulfo group, a mercapto group, an alkylsulfinyl group having 1 to 50 carbon atoms, an arylsulfinyl having 6 to 50 carbon atoms, an alkylthio group having 1 to 50 carbon atoms, an arylthio group having 6 to 50 carbon atoms, a ureido group having 1 to 50 carbon atoms, a heterocyclic group having 2 to 50 carbon atoms, an acyl group having 1 to.50 carbon atoms, a sulfamoylamino group having 0 to 50 carbon atoms, a silyl group having 3 to 50 carbon atoms and a halogen atom, and $X^1$, $X^2$, $X^3$, $X^4$ and $X^5$ may bond together to form a condensed ring, provided that for $X^1$, $X^2$, $X^3$ $X^4$, and $X^5$ the combined value of the sum of the Hammett substituent constant σp values of $X^1$, $X^3$, and $X^5$, with the sum of the Hammett substituent constant σm values of $X^2$, and $X^4$, is 0.80 or more but 3.80 or below; and $R^3$ represents a heterocyclic group.

9. The silver halide color photographic light-sensitive material as claimed in claim 8, wherein $R^1$ and $R^2$ in formulae (IV) and (V) each represent a hydrogen atom, an alkyl group having 1 to 50 carbon atoms, an aryl group having 6 to 50 carbon atoms, or a heterocyclic group having 1 to 50 carbon atoms, and at least one of $R^1$ and $R^2$ is a hydrogen atom.

10. The silver halide color photographic light-sensitive material as claimed in claim 8, wherein $R^3$ in formula (V) represents a saturated or unsaturated 3- to 12-membered monocyclic or condensed heterocyclic group having 1 to 50 carbon atoms, containing at least one hetero-atom selected from a nitrogen atom, an oxygen atom and a sulfur atom, and having at least one electron-attracting group.

11. The silver halide color photographic light-sensitive material as claimed in claim 8, wherein the compound represented by formula (IV) or (V) is represented by formula (VI) or (VII), respectively:

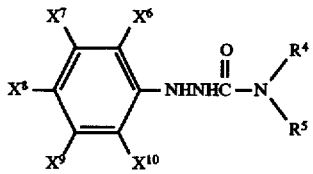

formula (VI)

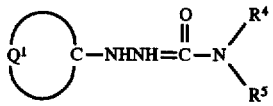

formula (VII)

wherein $R^4$ and $R^5$ each represent a hydrogen atom or a substituent, and $X^6$, $X^7$, $X^8$, $X^9$, and $X^{10}$ each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, provided that the combined value of the sum of the Hammett substituent constant σp values of $X^6$, $X^8$, and $X^{10}$, with the sum of the Hammett substituent constant σm values of $X^7$ and $X^9$, is 1.20 or more but 3.80 or below;

$Q^1$ represents a group of nonmetal atoms required to form, together with the C, a nitrogen-containing 5- to 8-membered heterocyclic ring.

12. The silver halide color photographic light-sensitive material as claimed in claim 11, wherein $R^4$ and $R^5$ in formulae (VI) and (VII) each represent a hydrogen atom, an alkyl group having 1 to 50 carbon atoms, an aryl group having 6 to 50 carbon atoms, or a heterocyclic group having 1 to 50 carbon atoms, and at least one of $R^4$ and $R^5$ is a hydrogen atom.

13. The silver halide color photographic light-sensitive material as claimed in claim 11, wherein the compound represented by formula (VI) or (VII) is represented by formula (VIII) or (IX), respectively:

formula (VIII)

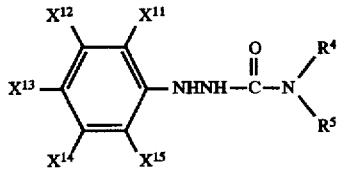

formula (IX)

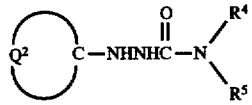

wherein $R^4$ and $R^5$ each represent a hydrogen atom or a substituent, and $X^{11}$, $X^{12}$, $X^{13}$, $X^{14}$, and $X^{15}$ each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, provided that the combined value of the sum of the Hammett substituent constant σp values of $X^{11}$, $X^{13}$, and $X^{15}$, with the sum of the Hammett substituent constant σm values of $X^{12}$ and $X^{14}$, is 1.50 or more but 3.80 or below;

$Q^2$ represents a group of nonmetal atoms required to form, together with the C, a nitrogen-containing 5-membered to 8-membered heterocyclic ring, to which a benzene ring or a heterocyclic ring is condensed.

14. The silver halide color photographic light-sensitive material as claimed in claim 13, wherein $R^4$ and $R^5$ in formulae (VIII) and (IX) each represent a hydrogen atom, an alkyl group having 1 to 50 carbon atoms, an aryl group having 6 to 50 carbon atoms, or a heterocyclic group having 1 to 50 carbon atoms, and at least one of $R^4$ and $R^5$ is a hydrogen atom.

15. The silver halide color photographic light-sensitive material as claimed in claim 1, wherein the high-boiling-point organic solvent having a ΔvD of within the range of 80 to 180 is selected from compounds represented by the following formula (S):

formula (S)

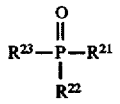

wherein $R^{21}$, $R^{22}$, and $R^{23}$ each independently represent an aliphatic acid group, an aryl group, an aliphatic acid oxy group, an aryloxy group, or an amino group, provided that $R^{21}$, $R^{22}$, and $R^{23}$ do not represent aryloxy groups simultaneously.

16. The silver halide color photographic light-sensitive material as claimed in claim 1, wherein the amount of the high-boiling-point organic solvent whose electron-donative parameter $\Delta v_D$ at 25° C. is within the range of 80 and 180 to be used is in the range of from 0.01 to 20, in terms of weight ratio to the reducing agent for color formation of formula (I).

17. The silver halide color photographic light-sensitive material as claimed in claim 1, wherein at least one of said photographic constitutional layers is a silver halide emulsion layer containing silver chlorobromide or silver chloride grains whose silver chloride content is 95 mol % or more.

18. The silver halide color photographic light-sensitive material as claimed in claim 1, wherein the total coating amount of silver in the silver halide color photographic light-sensitive material is 0.003 to 1 g per $m^2$ in terms of silver.

19. The silver halide color photographic light-sensitive material as claimed in claim 1, wherein the photographic constitutional layers comprise at least three photosensitive silver halide emulsion layers, and the coating amount of silver in each layer is 0.001 to 0.4 g per $m^2$ in one photosensitive layer.

* * * * *